US007105285B2

(12) United States Patent
Ninomiya et al.

(10) Patent No.: US 7,105,285 B2
(45) Date of Patent: Sep. 12, 2006

(54) SILVER HALIDE COLOR PHOTOSENSITIVE MATERIAL

(75) Inventors: Toshitaka Ninomiya, Minami-Ashigara (JP); Kiyoshi Morimoto, Minami-Ashigara (JP); Koichi Yokota, Minami-Ashigara (JP); Masahiko Taniguchi, Minami-Ashigara (JP); Terukazu Yanagi, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/947,196

(22) Filed: Sep. 23, 2004

(65) Prior Publication Data

US 2005/0069824 A1 Mar. 31, 2005

(30) Foreign Application Priority Data

Sep. 25, 2003 (JP) ..... 2003-332628

(51) Int. Cl.

| | |
|---|---|
| ***G03C 1/815*** | (2006.01) |
| ***G03C 1/825*** | (2006.01) |
| ***G03C 1/85*** | (2006.01) |
| ***G03C 1/46*** | (2006.01) |
| ***G03C 3/02*** | (2006.01) |

(52) U.S. Cl. ..... 430/512; 430/527; 430/529; 430/631; 430/635; 430/501; 430/507; 430/634

(58) Field of Classification Search ..... 430/512, 430/527, 529, 631, 635, 501, 507, 634
See application file for complete search history.

(56) References Cited

U.S. PATENT DOCUMENTS

| | | | | |
|---|---|---|---|---|
| 5,747,235 | A | 5/1998 | Farid et al. | |
| 6,689,554 | B1 | 2/2004 | Yamada et al. | |
| 6,855,488 | B1 * | 2/2005 | Yamada et al. | 430/566 |
| 2004/0018458 | A1 * | 1/2004 | Nakagawa | 430/619 |
| 2004/0137386 | A1 | 7/2004 | Yokota et al. | |

* cited by examiner

*Primary Examiner*—Geraldine Letscher
(74) *Attorney, Agent, or Firm*—Sughrue Mion, PLLC

(57) ABSTRACT

A silver halide color photosensitive material comprises a blue-sensitive layer, a green-sensitive layer, a red-sensitive layer and a non-light-sensitive layer on a support. The silver halide color photosensitive material contains a compound selected from the following type 1 and type 2 compounds, and wherein the blue-sensitive layer meets the relationship of the following formula (I):

$$S_B(370\text{ nm})/S_B(420\text{ nm})<0.7 \quad \text{(I)}$$

wherein $S_B(\lambda)$ represents a spectral sensitivity at a wavelength of $\lambda$, (type 1)

a compound capable of undergoing a one-electron oxidation to thereby form a one-electron oxidation product thereof, wherein the one-electron oxidation product is capable of releasing further one or more electrons accompanying a subsequent bond cleavage reaction, and (type 2)

a compound capable of undergoing a one-electron oxidation to thereby form a one-electron oxidation product thereof, wherein the one-electron oxidation product is capable of releasing further one or more electrons accompanying a subsequent bond-forming reaction.

3 Claims, No Drawings

SILVER HALIDE COLOR PHOTOSENSITIVE MATERIAL

CROSS-REFERENCE TO RELATED APPLICATIONS

This application is based upon and claims the benefit of priority from prior Japanese Patent Application No. 2003-332628, filed Sep. 25, 2003, the entire contents of which are incorporated herein by reference.

BACKGROUND OF THE INVENTION

1. Field of the Invention

The present invention relates to a silver halide color photosensitive material of high speed improved with respect to static-induced fog and radiation-induced fog, and relates to a silver halide color photosensitive material which can reduce cissing occurring at high-speed coating, etc. and can be produced stably.

2. Description of the Related Art

Various techniques have been employed for enhancing the photo-sensitivity of silver halide photosensitive materials.

Recently, the technique of sensitizing with the use of a compound capable of being one-electron oxidized to thereby form a one-electron oxidation product which by the subsequent bond cleavage reaction, can further emit one electron has been reported (see, for example, Jpn. Pat. Appln. KOKAI Publication No. (hereinafter referred to as JP-A-) 9-211769 and U.S. Pat. No. (hereinafter referred to as "USP") 5,747,235). Moreover, the technique of sensitizing with the use of a compound capable of being one-electron oxidized to thereby form a one-electron oxidation product which by the subsequent bond cleavage reaction, can further emit one electron or more electrons has been reported (see, for example, JP-A's-2003-114487 and 2003-114488).

On the other hand, with respect to photosensitive materials, the greater the enhancement of sensitivity, the more serious the problem of photographic characteristics deterioration by prolonged storage. The causes of the photographic characteristics deterioration by prolonged storage involve not only hitherto well-known heat and moisture but also natural radiation (environmental radiation or cosmic rays). The photosensitive material having been exposed to natural radiation suffers an increase of fog density and, accompanying the same, a deterioration of graininess. The silver halide photosensitive materials having the sensitivity enhanced by the techniques described in the above literature suffer intense radiation-induced fog, so that improvement has been desired thereto.

The photosensitive materials are brought into contact with various materials during the production, use for shooting and development processing thereof. For example, when a photosensitive material is in wound form during the processing, the back layer provided on the back side of the support may be brought into contact with the surface layer. Further, while being conveyed during the processing, the photosensitive material may be brought into contact with stainless steel, rubber rollers, etc. When brought into contact with these materials, the photosensitive material at the surface (gelatin layer) thereof is likely to have positive charge and occasionally induces unwanted electric discharge with the result that undesirable exposure marks (known as static marks) remain on the photosensitive material. Incorporating of a material capable of controlling the spectral sensitivity in the ultraviolet region in the protective layer is known as means for reducing undesirable exposure marks on the photosensitive material even when unwanted discharge occurs.

The photosensitive materials having been sensitized by the use of compounds as the above spectral sensitivity controlling material pose a problem of static-induced fog.

BRIEF SUMMARY OF THE INVENTION

It is an object of the present invention to provide a silver halide photosensitive material which realizes high sensitivity and which can suppress static-induced fog and radiation-induced fog.

While conducting extensive and intensive studies with a view toward obtaining a photosensitive material improved with respect to static-induced fog through appropriate use of an ultraviolet absorber so as to lower the sensitivity in the ultraviolet region in order to effect suppression of static-induced fog, surprisingly, the inventor has found that a photosensitive material improved with respect to not only static-induced fog but also radiation-induced fog can be obtained.

The above object has been attained by the following means.

(I) A silver halide color photosensitive material comprising at least one each of a blue-sensitive layer, a green-sensitive layer, a red-sensitive layer and a non-light-sensitive layer on a support, wherein the silver halide color photosensitive material contains a compound selected from among the following type 1 and type 2 compounds, and wherein the blue-sensitive layer meets the relationship of the following formula (I):

$$S_B(370\text{ nm})/S_B(420\text{ nm})<0.7 \quad \text{(I)}$$

wherein $S_B(\lambda)$ represents a spectral sensitivity at a wavelength of $\lambda$, (Type 1)

a compound capable of undergoing a one-electron oxidation to thereby form a one-electron oxidation product thereof, wherein the one-electron oxidation product is capable of releasing further one or more electrons accompanying a subsequent bond cleavage reaction, and (Type 2)

a compound capable of undergoing a one-electron oxidation to thereby form a one-electron oxidation product thereof, wherein the one-electron oxidation product is capable of releasing further one or more electrons accompanying a subsequent bond-forming reaction.

(II) The silver halide color photosensitive material according to item (I) above, wherein the silver halide color photosensitive material further contains at least one fluorinated surfactant selected from the group consisting of compounds represented by general formula (A) and compounds represented by general formula (B):

General formula (A)

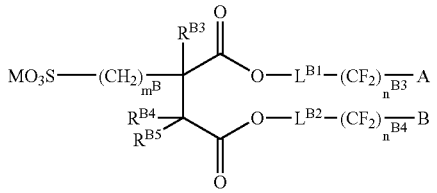

In the general formula (A), each of $R^{B3}$, $R^{B4}$ and $R^{B5}$ independently represents a hydrogen atom or substituent. Each of A and B independently represents a fluorine atom or hydrogen atom. Each of $n^{B3}$ and $n^{B4}$ is independently an integer of 4 to 8. Each of $L^{B1}$ and $L^{B2}$ independently represents a substituted or unsubstituted alkylene group, substituted or unsubstituted alkyleneoxy group, or bivalent linking group composed of a combination thereof. $m^B$ is 0 or 1. M represents a cation.

General formula (B)

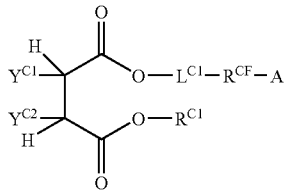

In the general formula (B), $R^{C1}$ represents a substituted or unsubstituted alkyl group, provided that the substituent does not include a fluorine atom. $R^{CF}$ represents a perfluoroalkylene group. A represents a hydrogen atom or fluorine atom. $L^{C1}$ represents a substituted or unsubstituted alkylene group, substituted or unsubstituted alkyleneoxy group, or bivalent linking group composed of a combination thereof. One of $Y^{C1}$ and $Y^{C2}$ represents a hydrogen atom while the other represents $-L^{C2}-SO_3M$ in which $L^{C2}$ represents a single bond or a substituted or unsubstituted alkylene group and M represents a cation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The compounds of types 1 and 2 contained in the silver halide color photosensitive material of the present invention will be described below.

(Type 1)

A compound capable of undergoing a one-electron oxidation to thereby form a one-electron oxidation product thereof, wherein the one-electron oxidation product is capable of releasing further one or more electrons accompanying a subsequent bond cleavage reaction; and (Type 2)

A compound capable of undergoing a one-electron oxidation to thereby form a one-electron oxidation product thereof, wherein the one-electron oxidation product is capable of releasing further one or more electrons accompanying a subsequent bond-forming reaction.

First, the compound of type 1 will be described.

Among the compounds of type 1, examples of the compounds capable of undergoing a one-electron oxidation to thereby form a one-electron oxidation product thereof, wherein the one-electron oxidation product is capable of releasing further one electron accompanying a subsequent bond cleavage reaction are compounds described as "one photon two electrons sensitizers" or "deprotonating electron-donating sensitizers" in the patent publications and specifications of, for example, JP-A-9-211769 (compounds PMT-1 to S-37 listed in Tables E and F on pages 28 to 32), JP-A-9-211774, JP-A-11-95355 (compounds INV 1 to 36), Japanese Patent Application KOHYO Publication 2001-500996 (compounds 1 to 74, 80 to 87 and 92 to 122), U.S. Pat. Nos. 5,747,235 and 5,747,236, EP 786692A1 (compounds INV 1 to 35), EP 893732A1 and U.S. Pat. Nos. 6,054,260 and 5,994,051, the entire contents of which are incorporated herein by reference. Preferable scopes of these compounds are the same as the preferable scopes described in the referred patent specifications.

Further, as the compound capable of undergoing a one-electron oxidation to thereby form a one-electron oxidation product thereof, wherein the one-electron oxidation product is capable of releasing further one or more electrons accompanying a subsequent bond cleavage reaction includes compounds represented by the general formula (1) (having the same meaning as the general formula (1) described in JP-A-2003-114487), the general formula (2) (having the same meaning as the general formula (2) described in JP-A-2003-114487), the general formula (3) (having the same meaning as the general formula (1) described in JP-A-2003-114488), the general formula (4) (having the same meaning as the general formula (2) described in JP-A-2003-114488), the general formula (5) (having the same meaning as the general formula (3) described in JP-A-2003-114488), the general formula (6) (having the same meaning as the general formula (1) described in JP-A-2003-75950), the general formula (7) (having the same meaning as the general formula (2) described in JP-A-2003-75950), the general formula (8) (having the same meaning as the general formula (1) described in Japanese Patent Application No. 2003-25886), and compounds represented by the general formula (9) (having the same meaning as the general formula (3) described in Japanese Patent Application No. 2003-33446) included among the compounds capable of undergoing the chemical reaction of the formula (1) (having the same meaning as the chemical reaction formula (1) described in Japanese Patent Application No. 2003-33446, the entire contents which disclose the compound of type a mentioned above are incorporated herein by reference. Preferable scopes of these compounds are the same as the preferable scopes described in the referred patent specifications.

General formula (1)

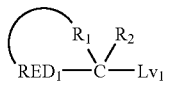

General formula (2)

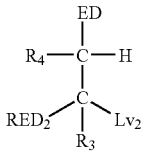

In the general formulas (1) and (2), $RED_1$ and $RED_2$ each represent a reducing group. $R_1$ represents a nonmetallic atomic group capable of forming, together with carbon atom (C) and $RED_1$, a cyclic structure corresponding to a tetrahydro form, or octahydro form of a 5-membered or 6-membered aromatic ring (including an aromatic heterocycle). $R_2$, $R_3$, and $R_4$ each represents a hydrogen atom or substituent. $Lv_1$ and $Lv_2$ each represent a split-off group. ED represents an electron-donating group.

General formula (3)

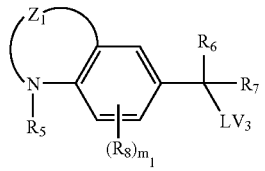

General formula (4)

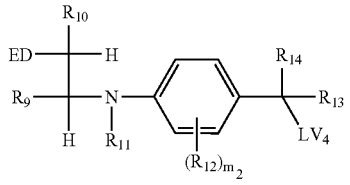

General formula (5)

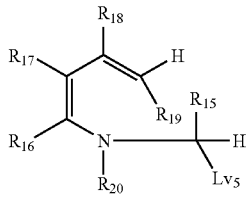

In the general formulas (3), (4) and (5) $Z_1$ represents an atomic group capable of forming a 6-membered ring together with the nitrogen atom and the two carbon atoms of the benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ each represent a hydrogen atom or substituent. $R_{20}$ represents a hydrogen atom or substituent, provided that when $R_{20}$ represents a group other than an aryl group, $R_{16}$ and $R_{17}$ bond together to form an aromatic ring or aromatic hetero ring. $R_8$ and $R_{12}$ each represent a substituent capable of substituting on the benzene ring. $m_1$ represents an integer of 0 to 3, and $m_2$ represents an integer of 0 to 4. Lv3, Lv4, and Lv5 each represent a splitting-off group.

General formula (6)

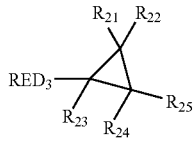

General formula (7)

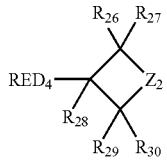

In the general formulas (6) and (7), $RED_3$ and $RED_4$ each represent a reducing group. $R_{21}$ to $R_{30}$ each represent a hydrogen atom or substituent. $Z_2$ represents —$CR_{11}1R_{112}$—, —$NR_{113}$—, or —O—. $R_{111}$ and $R_{112}$ each independently represent a hydrogen atom or substituent. $R_{113}$ represents a hydrogen atom, alkyl group, aryl group or heterocyclic group.

General formula (8)

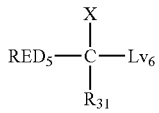

In the general formula (8), $RED_5$ represents a reducing group, which includes an arylamino group or heterocyclicamino group. $R_{31}$ represents a hydrogen atom or substituent. X represents an alkoxy group, aryloxy group, heterocyclicoxy group, alkylthio group, arylthio group, heterocyclic thio group, alkylamino group, arylamino group or heterocyclicamino group. $Lv_6$ represents a splitting-off group, which includes a carboxy group or salt thereof, or a hydrogen atom.

Chemical reaction formula (1)

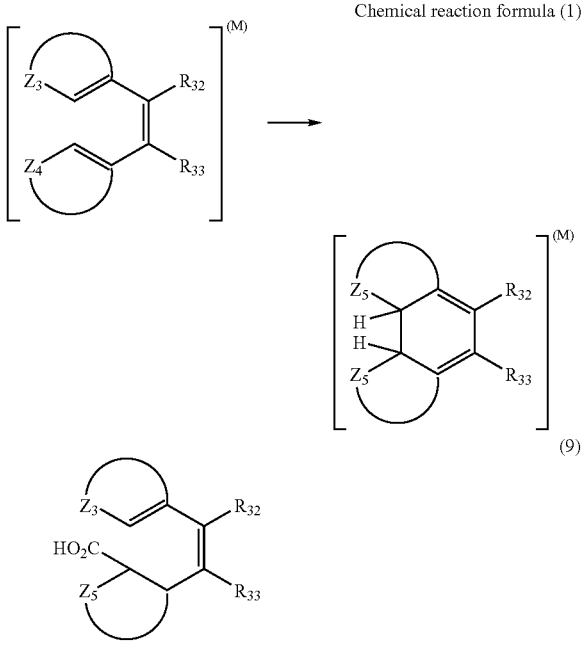

(9)

The compound represented by the general formula (9) is one that, after undergoing through two-electron oxidation accompanying decarboxylation, undergoes the bond-forming reaction formula represented by the chemical reaction of (1). In the chemical reaction formula (1), $R_{32}$ and $R_{33}$ each represents a hydrogen atom or substituent. $Z_3$ represents a group to form a 5-memenered or 6-membered hetero ring together with C═C. $Z_4$ represents a group to form a 5-membered or 6-membered aryl group or heterocyclic group together with C═C. M represents a radical, radical ion or cation. In the general formula (9), $R_{32}$, $R_{33}$, and $Z_3$ have the same meaning as those in the chemical reaction formula (1), respectively. $Z_5$ represents a group to form a 5-memebered or 6-membered cyclic aliphatic hydrocarbon group or heterocyclic group together with C—C.

Now the compound of type 2 will be described.

Examples of the compounds of type 2 that is capable of undergoing a one-electron oxidation to thereby form a one-electron oxidation product thereof, wherein the one-electron oxidation product is capable of releasing further one or more electrons accompanying a subsequent bond-forming reaction, are those represented by the general formula (1)

(having the same meaning as the general formula (1) of JP-A-2003-140287), and those capable of undergoing the chemical reaction formula (1) (having the same meaning as the chemical reaction formula (1) of Japanese Patent Application No. 2003-140287) and represented by the general formula (11) (having the same meaning as the general formula (2) of Japanese Patent Application No. 2003-33446). Preferable scopes of these compounds are the same as the preferable scopes described in the referred patent specifications.

$RED_6$-Q-Y General formula (10)

In the general formula (10), $RED_6$ represents a reducing group capable of undergoing one-electron oxidation. Y represent a reactive group having a carbon-carbon double bond moiety, carbon-carbon triple bond moiety, aromatic moiety or benzo-condensed nonaromatic heterocyclic group, and capable of reacting with a one-electron oxidation product formed as a result of a one-electron oxidation of $RED_6$ to thereby form a new bond. Q represents a linking group to link $RED_6$ and Y.

Chemical reaction formula (1)

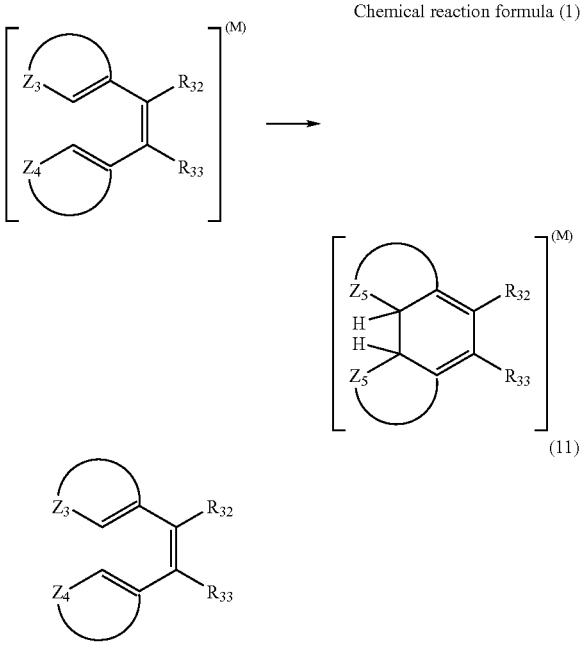

The compound represented by the general formula (11) is one that undergoes, by being oxidized, the bond-forming reaction represented by the chemical reaction formula (1). In the chemical reaction formula (1), $R_{32}$ and $R_{33}$ each represent a hydrogen atom or substituent. $Z_3$ represents a group to for a 5-membered or 6-membered hetero ring together with C═C. $Z_4$ represents a group to for a 5-membered or 6-membered aryl group or heterocyclic group together with C═C. $Z_5$ represents a group to form a 5-membered or 6-membered cyclic aliphatic hydrocarbon group or heterocyclic group. M represents a radical, radical ion or cation. In the general formula (11), $R_{32}$, $R_{33}$, $Z_3$ and $Z_4$ have the same meaning as those in the chemical reaction formula (1), respectively.

Among the compounds of types 1 and 2, "a compound having an adsorptive group to silver halide in a molecular" or "a compound having a partial structure of a spectrally sensitizing dye in a molecular" is preferable. Representative ones of the adsorptive group to silver halide are the groups described in the specification on page 16, right column, line 1 to page 17, right column line 12 of JP-A-2003-156823. The partial structure of the spectrally sensitizing dye is the structure described on page 17, right column, line 34 to page 18, left column, line 6 of the same specification, the entire contents of which are incorporated herein by reference.

As the compounds of types 1 and 2 "a compound having at least one adsorptive group to silver halide in a molecular" is preferable. "A compound having at least two adsorptive groups to silver halide in a molecular" is more preferable. When there are two or more adsorptive groups in a single molecular these adsorptive groups may be the same or different to each other.

As the adsorptive groups preferred ones are nitrogen-containing heterocyclic groups substituted with mercapto (e.g., a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group or 1,5-dimethyl-1,2,4-triazolium-3-thiolate group), or a nitrogen-containing heterocyclic group having an —NH— group capable of forming an iminosilver (>NAg) as a partial structure of the heterocycle (e.g., a benzotriazole group, benzimidazole group or indazole group). More preferably, the adsorptive group is a 5-mercaptotetrazole group, 3-mercapto-1,2,4-triazole group or benzotriazole group. Most preferably, the adsorptive group is a 3-mercapto-1,2,4-triazole group or 5-mercaptotetrazole group.

Among the compounds of the present invention, those having, in its molecule, two or more mercapto groups as partial structures are also especially preferred. Herein, the mercapto group (—SH) may become a thione group when it can be tautomerized. Preferable examples of such compounds possessing in its molecule two or more adsorptive groups as a partial structure (e.g., dimercapto substituted nitrogen-containing heterocyclic group) are 2,4-dimercaptopyrimidine group, 2,4-dimercaptotriazine group, and 3,5-dimercapto-1,2,4-triazole group.

A quaternary salt structure of nitrogen or phosphor may be preferably used as the adsorptive group. The quaternary salt structure of nitrogen specifically is an ammonio group (e.g., trialkylammonio group, dialkylaryl (or heteroaryl) ammonio grup, alkyldiaryl (or heteroaryl) ammonio group) or a group containing a nitrogen-containing group including a quaternary nitrogen atom. The quaternary salt structure of phosphor specifically is a phosphonio group (e.g., trialkylphosphonio, dialkylaryl(or heteroaryl)phosphonio, alkyldiaryl(or heteroaryl)phosphonio group, or triaryl(or heteroaryl)phosphonio). A quaternary salt structure of nitrogen is more preferably used as the adsorptive group, a 5-membered or 6-membered nitrogen-containing aromatic heterocyclic group including a quaternary nitrogen atom is much more preferably used. A pyridinio, quinolinio or isoquinolinio is especially preferably used. These nitrogen-containing heterocyclic group including a quaternary nitrogen atom may have a substituent.

As an example of a counter anion of the quaternary salt, halide ion, carboxylate ion, sulfonate ion, sulfate ion, perchlorite ion, carbonate ion, nitrate ion, $BF_4^-$, $PF_6^-$ or $Ph_4B$ may be mentioned. When a group having a negative charge is present in carboxylate an etc., in a molecular, a intra molecular salt may be formed together with it. As a counter anion that is not present in a molecular, chloride ion, bromide ion, or methansulfonate ion is especially preferable.

Preferable examples of the compound represented by types 1 and 2 having a quaternary salt structure of phosphor or nitrogen as an adsorptive group are represented by general formula (X)

$$(P\text{-}Q_1\text{-})_i\text{-}R(\text{-}Q_2\text{-}S)_j \qquad \text{General formula (X)}$$

In general formula (X), P and R each independently represent a quaternary salt structure of nitrogen or phosphor that is not a partial structure of a sensitizing dye. $Q_1$ and $Q_2$ each independently represent a linking group, specifically a simple bond, alkylene, arylene, heterocyclic group, —O—, —S—, —$NR_N$—, —C(═O)—, —$SO_2$—, —SO— or —P(═O)— alone or combination of these groups. Herein, $R_N$ represents a hydrogen atom, alkyl group, aryl group or heterocyclic group. S represents a residue of the compound represented by type one or two from which an atom is removed. Each of i and j is an integer of 1 or more, and selected from the scope in which i+j is 2 to 6. Preferably, i is 1 to 3, and j is 1 to 2. More preferably, i is one or two and j is 1. Especially preferably, i is 1 and j is 1. The compounds represented by the general formula (X) are those having the total carbon atoms within the scope of preferably 10 to 100, more preferably 10 to 70, much more preferably 11 to 60 and especially preferably 12 to 50.

Specific examples of the compounds of types 1 and 2 are set forth below, but the present invention is not limited to these.

1

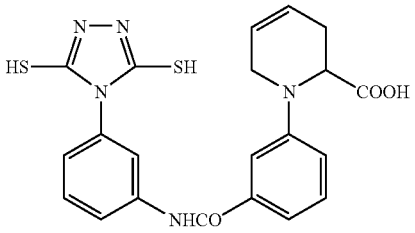

2

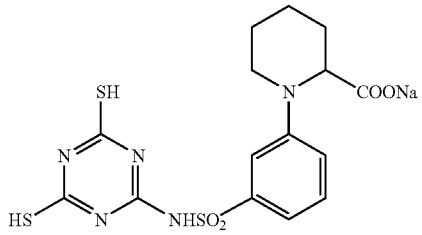

3

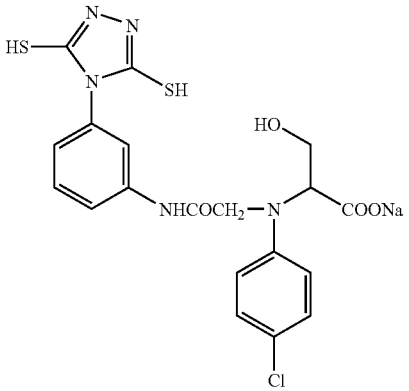

4

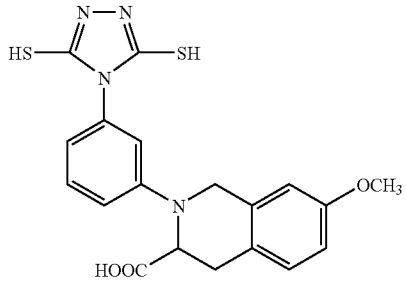

5

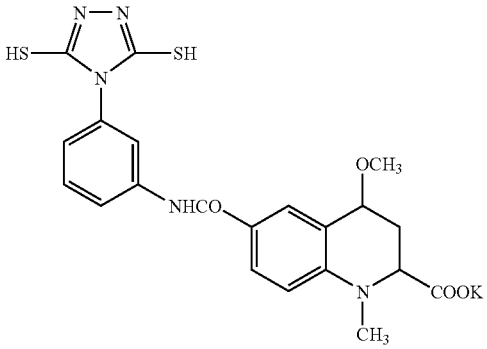

6

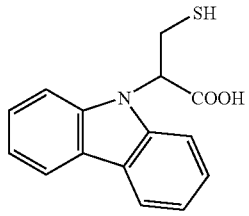

-continued
7
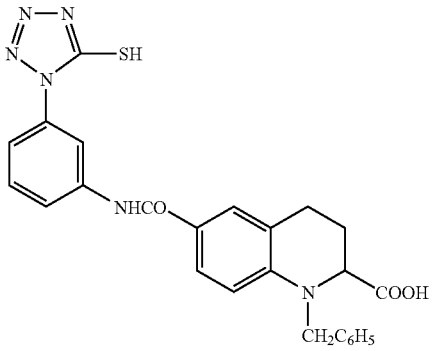
8
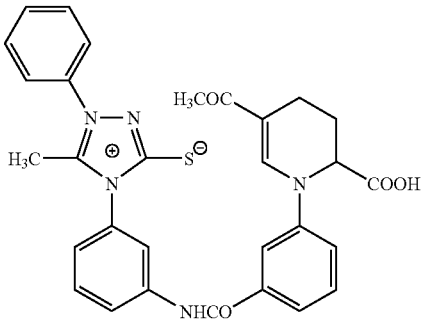
9
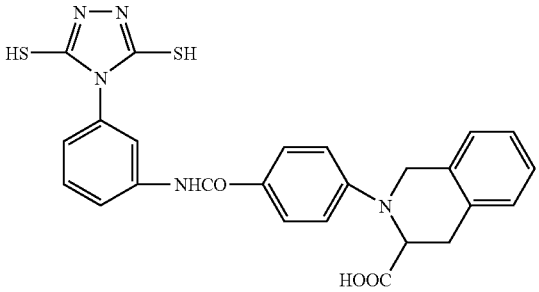
10
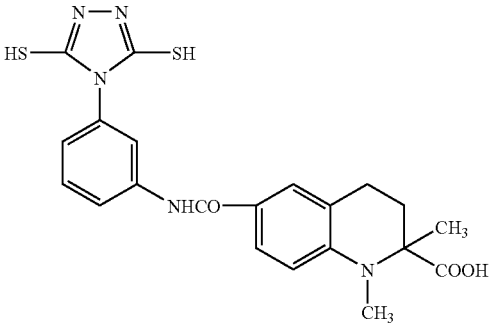
11
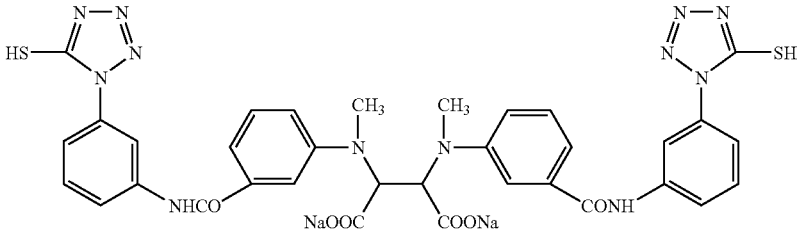
12
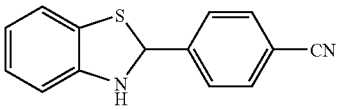
13
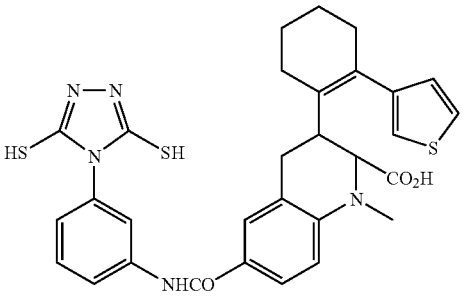
14
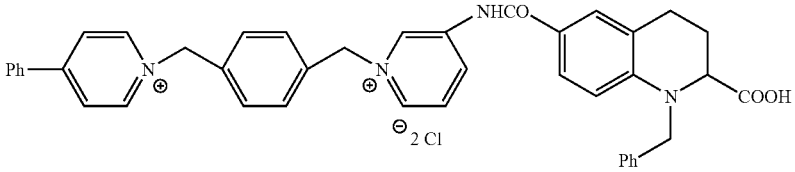

-continued
15
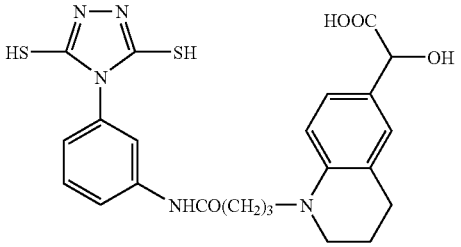
16
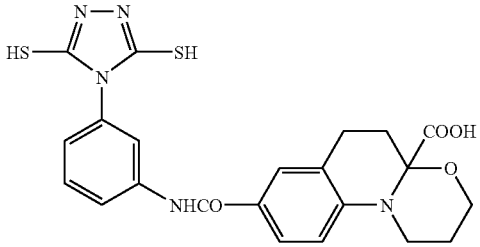
17
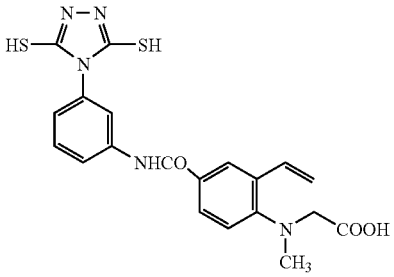
18
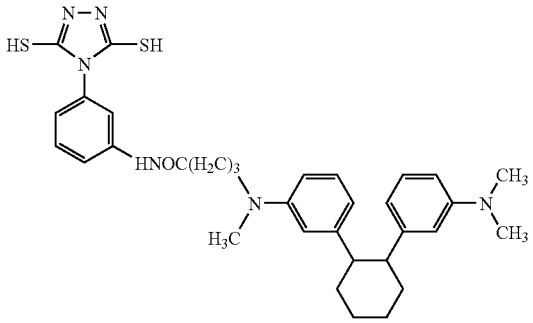
19
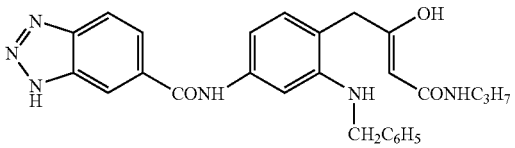
20
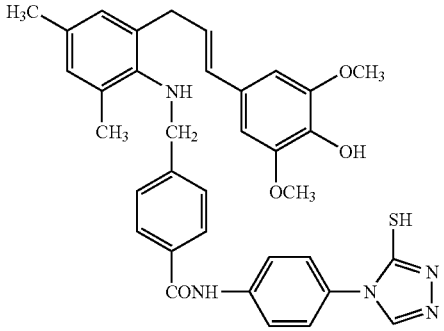
21
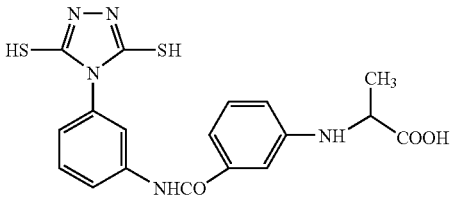
22
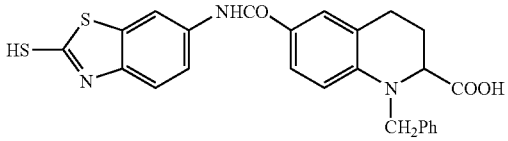
23
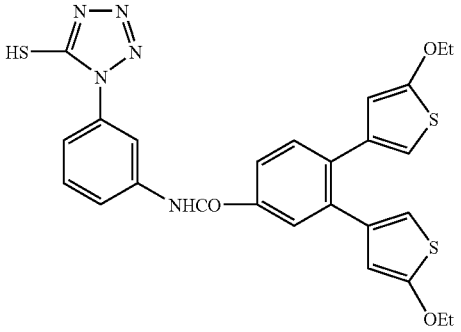

-continued
24
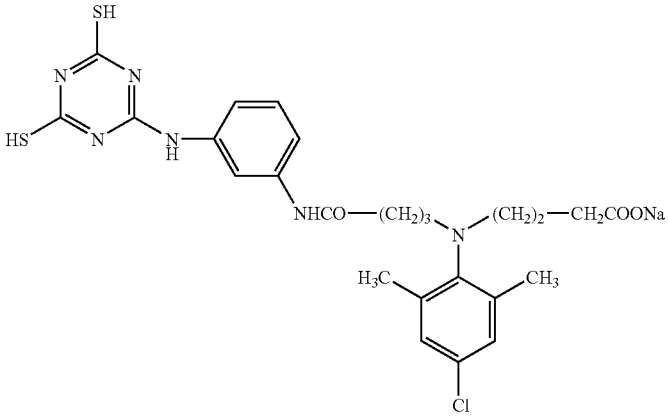
25
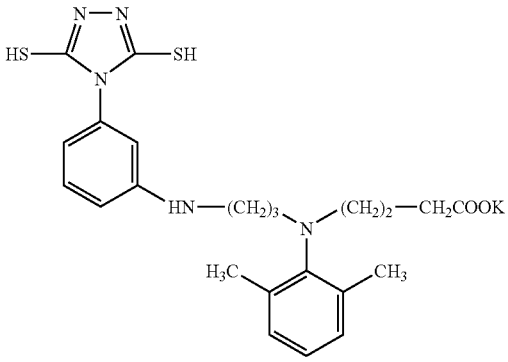
26
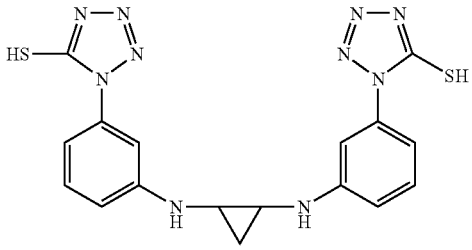
26
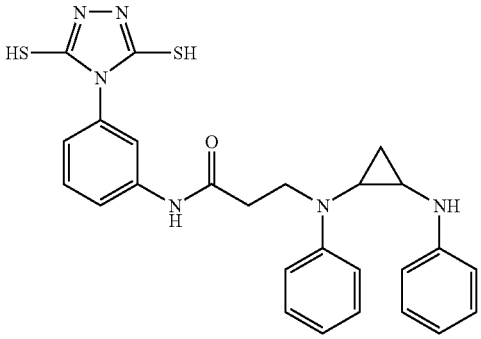
27
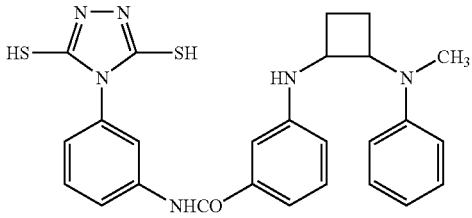
28
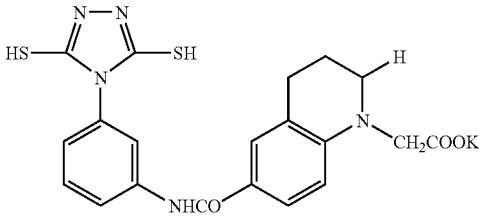
29
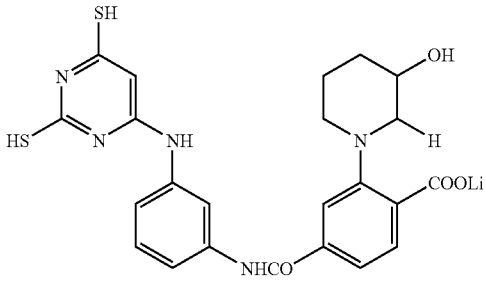

-continued
30
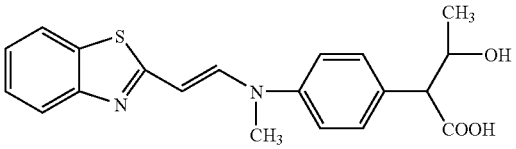
31
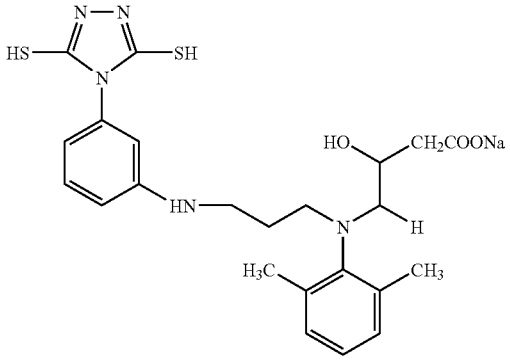
32
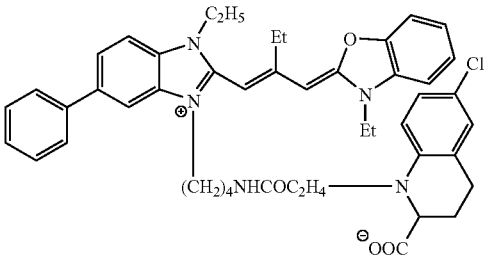
33
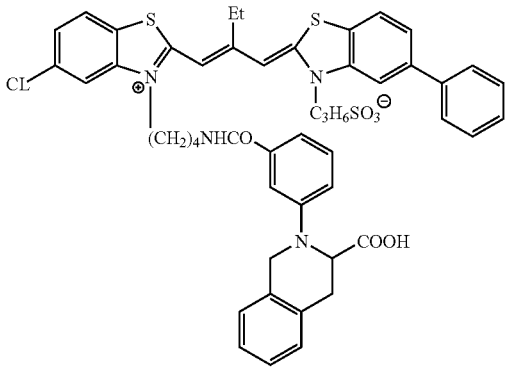
35
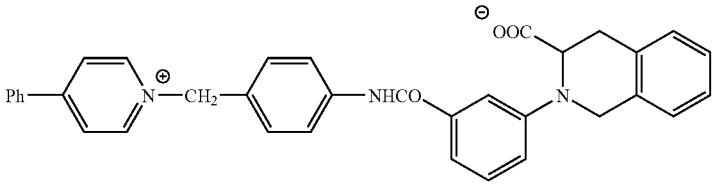
36
37
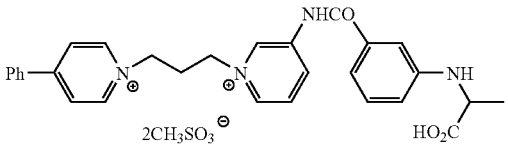
38
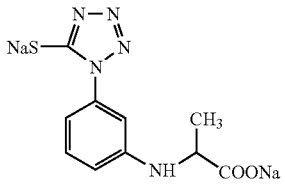
39
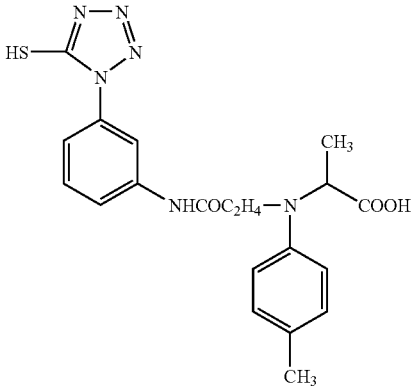
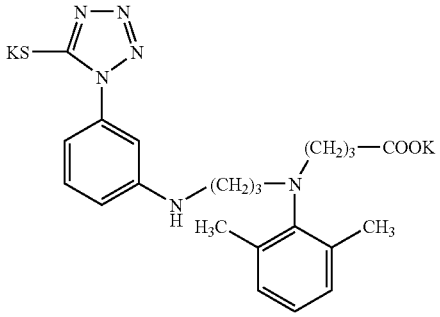

-continued
40
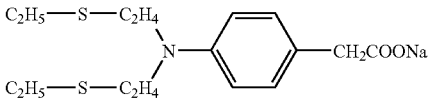
41
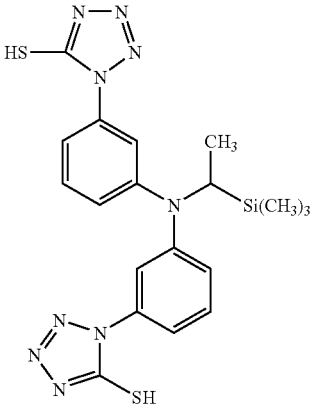
42
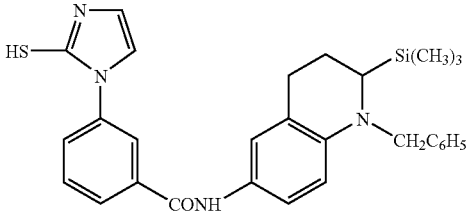
43
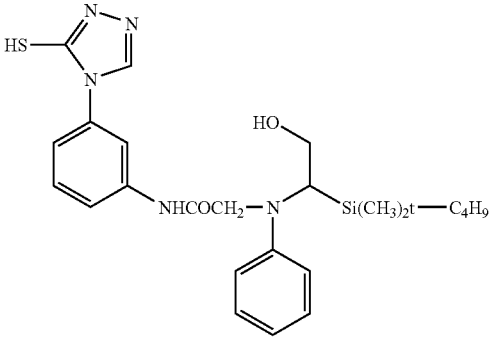
44
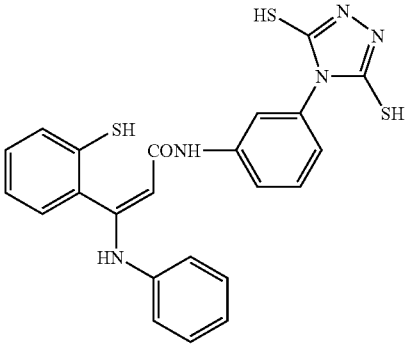
45
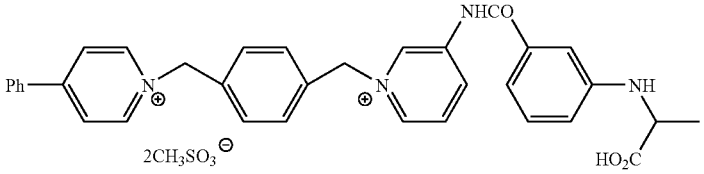
46
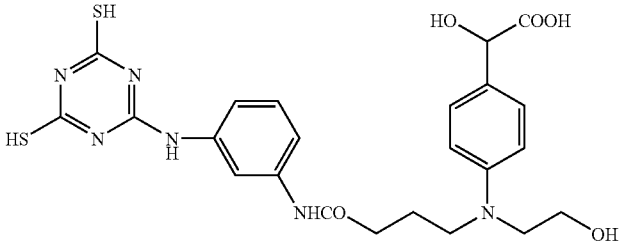

-continued

47

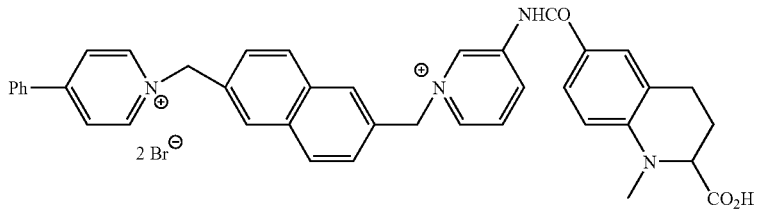

The compound of type 1 and type 2 may be used at any time during emulsion preparation or in photosensitive material manufacturing step, for example, during grain formation, at desalting step, at the time of chemical sensitization, or before coating. The compound may be added separately in a plurality of times during the steps. Preferable addition timing is from the completion of grain formation to before a desalting step, at the time of chemical sensitization (immediately before the initiation of chemical sensitization to immediately after the completion thereof), or before coating. More preferable addition timing is at chemical sensitization or before coating.

The compound of type 1 and type 2 may preferable be added by dissolving it to a water or water-soluble solvent such as methanol, ethanol or a mixture of solvents. When the compound is added to water, if the solubility of the compound increases in a case where pH is raised or lowered, the compound may be added to the solvent by raising or lowering the pH thereof.

It is preferable that the compound of type 1 and types 2 is used in an emulsion layer, but the compound may be added in a protective layer or interlayer together with the emulsion layer, thereby making the compound diffuse during coating. The addition time of the compound of the invention is irrespective of before or after the addition time of a sensitizing dye. Each of the compounds is preferably contained in a silver halide emulsion layer in an amount of $1\times10^{-9}$ to $5\times10^{-2}$ mol, more preferably $1\times10^{-8}$ to $2\times10^{-3}$ mol pre mol of silver halide.

In the present invention, the terminology "spectral sensitivity distribution" refers to a function of photographic speed versus wavelength, the photographic speed at each wavelength referring to the inverse number of exposure amount capable of realizing a given density at each wavelength when spectral exposure with intervals of several nanometers (nm) from 350 to 700 nm is applied to a silver halide color photosensitive material. In the present invention, the spectral sensitivity distribution of blue-sensitive layer $S_B(\lambda)$ refers to a sensitivity distribution which realizes yellow density.

In the spectral sensitivity distribution preferred in the present invention, with the spectral sensitivity referring to the inverse number of exposure amount capable of realizing a given density, the spectral sensitivity of blue-sensitive layer $S_B(\lambda)$ is expressed by the following relationship at wavelengths of 370 nm and 420 nm.

With respect to the following general formulas, although it is satisfactory for the spectral sensitivity at any density to fall within the ranges, it is preferred that the spectral sensitivity at any of the density range from Dmin+0.3 to Dmin+1.0 fall within the following ranges. With respect to the development processing conditions for realizing the spectral sensitivity distribution, although any of common color negative development processing techniques is satisfactory, it is preferred to employ the development processing described in Example 1 of this application.

$S_B(370\text{ nm})/S_B(420\text{ nm})<0.7$, preferably $S_B(370\text{ nm})/S_B(420\text{ nm})<0.6$, more preferably $S_B(370\text{ nm})/S_B(420\text{ nm})<0.5$, and most preferably, $S_B(370\text{ nm})/S_B(420\text{ nm})<0.3$.

A silver halide photosensitive material of unprecedented antistatic performance and excellent high-speed coatability can be provided by incorporation of the fluorinated surfactant represented by the general formula (A) and/or general formula (B) according to the present invention in the coating film.

The general formula (A) will be described in detail below.

First, the compound represented by the following general formula (A) will be described in detail.

General formula (A)

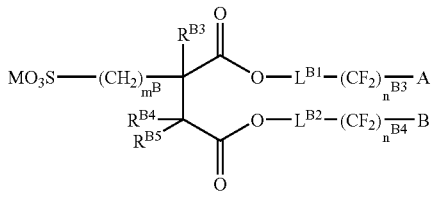

In the general formula (A), each of $R^{B3}$, $R^{B4}$ and $R^{B5}$ independently represents a hydrogen atom or substituent. Each of A and B independently represents a fluorine atom or hydrogen atom. Each of $n^{B3}$ and $n^{B4}$ is independently an integer of 4 to 8. Each of $L^{B1}$ and $L^{B2}$ independently represents a substituted or unsubstituted alkylene group, substituted or unsubstituted alkyleneoxy group, or bivalent linking group composed of a substituted or unsubstituted alkylene group combined with a substituted or unsubstituted alkyleneoxy group. $m^B$ is 0 or 1. M represents a cation.

In the general formula (A), each of $R^{B3}$, $R^{B4}$ and $R^{B5}$ independently represents a hydrogen atom or substituent. Any of the substituents described as T to be referred to later can be used as the substituent.

Each of $R^{B3}$, $R^{B4}$ and $R^{B5}$ preferably represents an alkyl group or hydrogen atom; more preferably an alkyl group having 1 to 12 carbon atoms or hydrogen atom; still more preferably a methyl group or hydrogen atom; and most preferably a hydrogen atom.

In the general formula (A), each of A and B independently represents a fluorine atom or hydrogen atom. Preferably, A and B simultaneously represent a fluorine atom or hydrogen atom. More preferably, A and B simultaneously represent a fluorine atom.

In the general formula (A), each of $n^{B3}$ and $n^{B4}$ is independently an integer of 4 to 8. Preferably, each of $n^{B3}$ and $n^{B4}$ is an integer of 4 to 6, and $n^{B3}=n^{B4}$. More preferably, each of $n^{B3}$ and $n^{B4}$ is an integer of 4 or 6, and $n^{B3}=n^{B4}$. Still more preferably, $n^{B3}=n^{B4}=4$.

In the general formula (A), $m^B$ is 0 or 1, both equally preferred.

In the general formula (A), each of $L^{B1}$ and $L^{B2}$ independently represents a substituted or unsubstituted alkylene group, substituted or unsubstituted alkyleneoxy group, or bivalent linking group composed of a substituted or unsubstituted alkylene group combined with a substituted or unsubstituted alkyleneoxy group. Any of the substituents described as T to be referred to later can be used as the substituent.

Each of $L^{B1}$ and $L^{B2}$ is preferably a group having 4 or less carbon atoms, and is preferably an unsubstituted alkylene.

M represents a cation. As the cation represented by M, preferred use is made of, for example, an alkali metal ion (lithium ion, sodium ion, potassium ion, etc.), an alkaline earth metal ion (barium ion, calcium ion, etc.), or ammonium ion. Lithium ion, sodium ion, potassium ion and ammonium ion are preferred. Lithium ion, sodium ion and potassium ion are more preferred. Sodium ion is still more preferred.

Among the compounds of the above general formula (A), compounds of the following general formula (A-1) are preferred.

General formula (A-1)

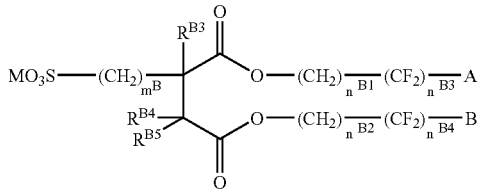

In the general formula (A-1), $R^{B3}$, $R^{B4}$, $R^{B5}$, $n^{B3}$, $n^{B4}$, $m^B$, A, B and M are as defined above with respect to the general formula (A). Preferred ranges thereof are also the same as mentioned above. Each of $n^{B1}$ and $n^{B2}$ is independently an integer of 1 to 6.

In the general formula (A-1), each of $n^{B1}$ and $n^{B2}$ is independently an integer of 1 to 6. Preferably, each of $n^{B1}$ and $n^{B2}$ is an integer of 1 to 6, and $n^{B1}=n^{B2}$. More preferably, each of $n^{B1}$ and $n^{B2}$ is an integer of 2 or 3, and $n^{B1}=n^{B2}$. Still more preferably, $n^{B1}=n^{B2}=2$.

Among the compounds of the above general formula (A), compounds of the following general formula (A-2) are more preferred.

General formula (A-2)

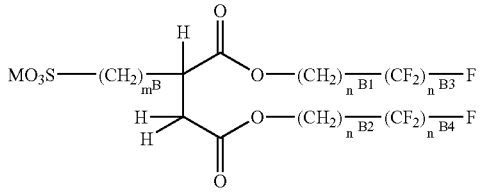

In the general formula (A-2), $n^{B3}$, $n^{B4}$, $m^B$ and M are as defined above with respect to the general formula (A). Preferred ranges thereof are also the same as mentioned above. In the general formula (A-2), $n^{B1}$ and $n^{B2}$ are as defined above with respect to the general formula (A-1). Preferred ranges thereof are also the same as mentioned above.

Among the compounds of the above general formula (A), compounds of the following general formula (A-3) are still more preferred.

General formula (A-3)

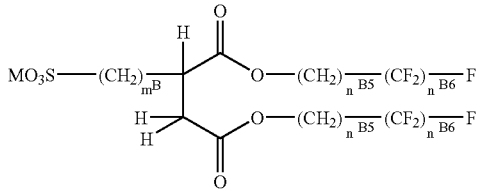

In the general formula (A-3), $n^{B5}$ is 2 or 3, and $n^{B6}$ is an integer of 4 to 6. $m^B$ is 0 or 1, both equally preferred. M is as defined above with respect to the general formula (A). Preferred range thereof is also the same as mentioned above.

Specific examples of the compounds of the above general formula (A) will be shown below, which however in no way limit the scope of the present invention.

FS-201

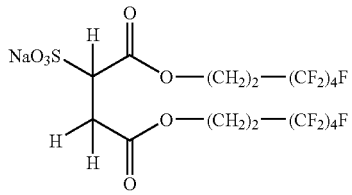

FS-202

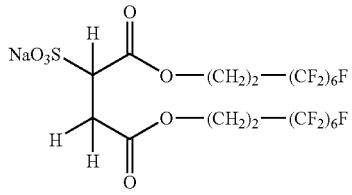

-continued
FS-203
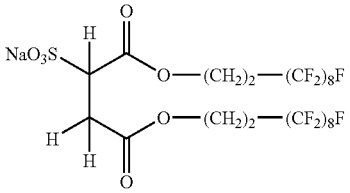
FS-204
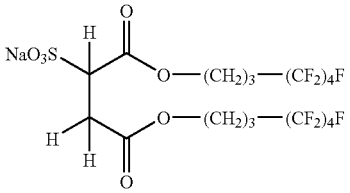
FS-205
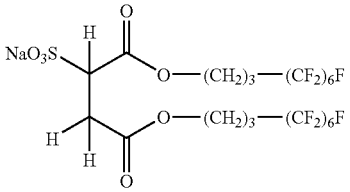
FS-206
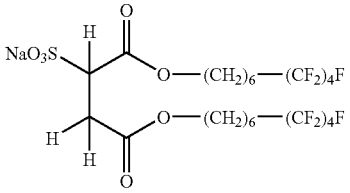
FS-207
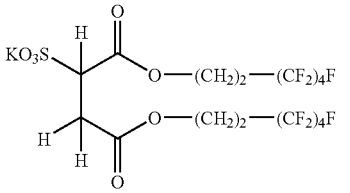
FS-208
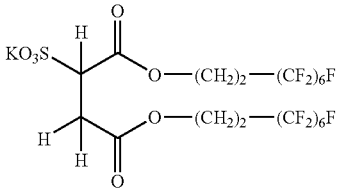
FS-209
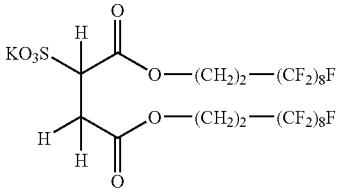
FS-210
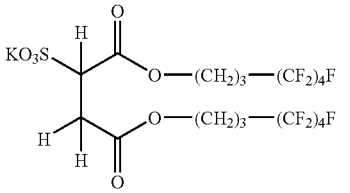
-continued
FS-211
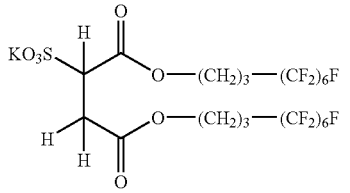
FS-212
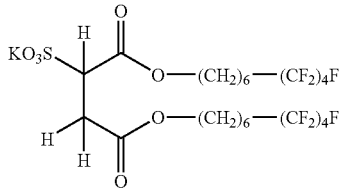
FS-213
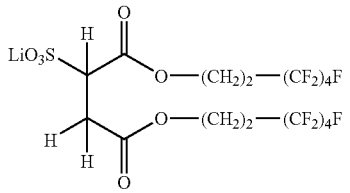
FS-214
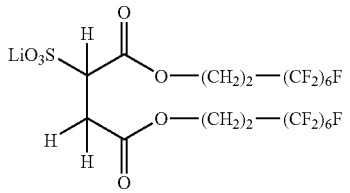
FS-215
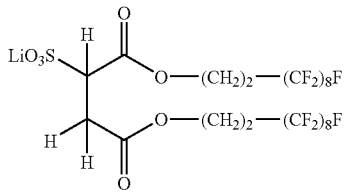
FS-216
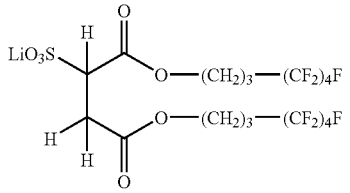
FS-217
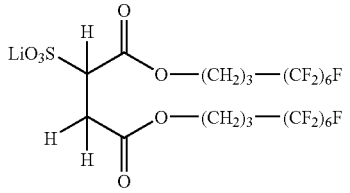
FS-218
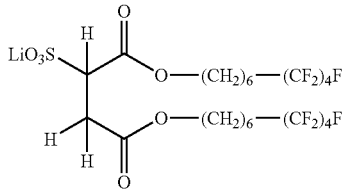

-continued
FS-219
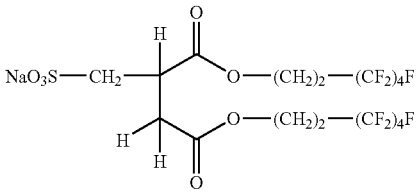
FS-220
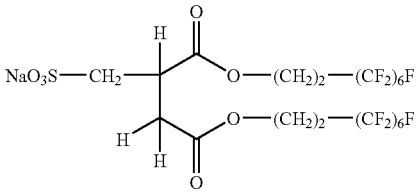
FS-221
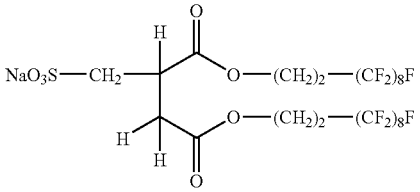
FS-222
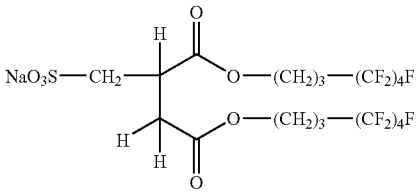
FS-223
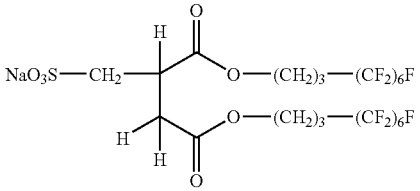
FS-224
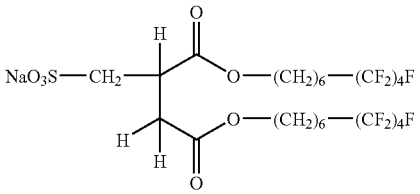
FS-225
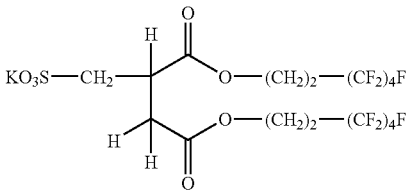
FS-226
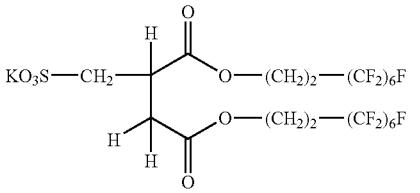
-continued
FS-227
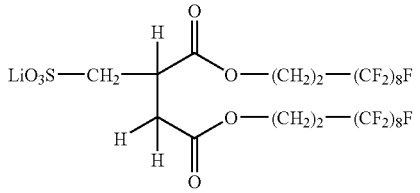
FS-228
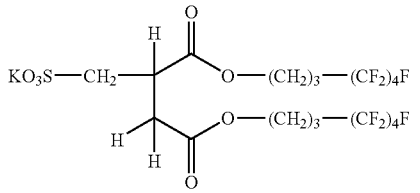
FS-229
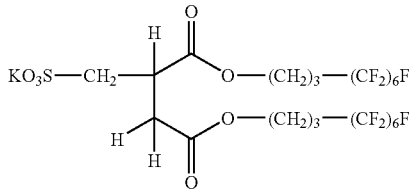
FS-230
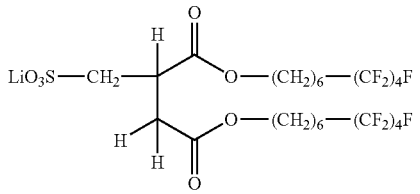
FS-231
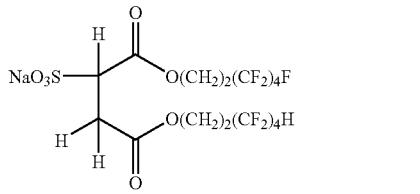
FS-232
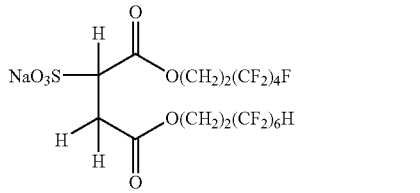
FS-233
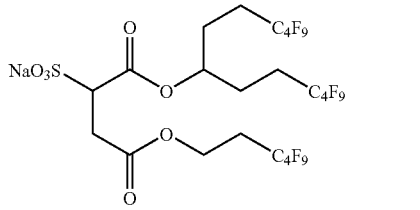

-continued

FS-234

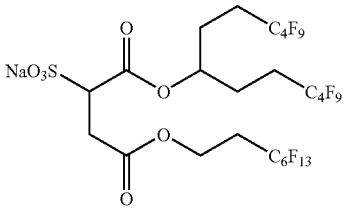

FS-235

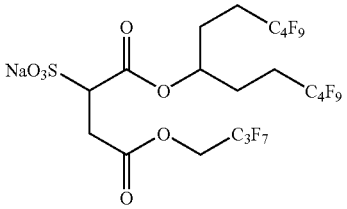

FS-236

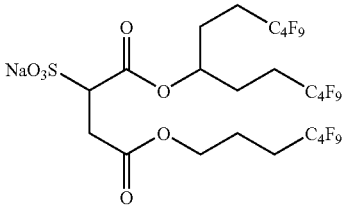

FS-237

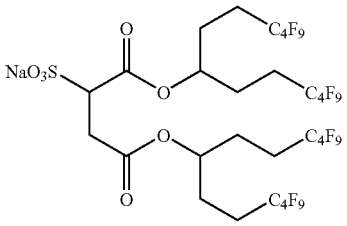

FS-238

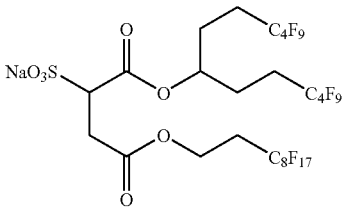

FS-239

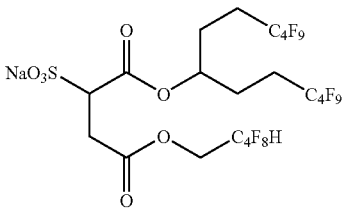

FS-240

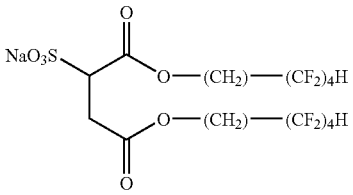

-continued

FS-241

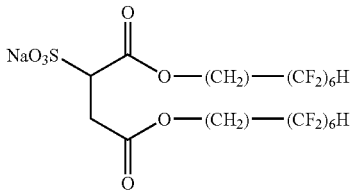

FS-242

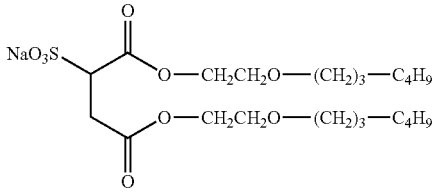

FS-243

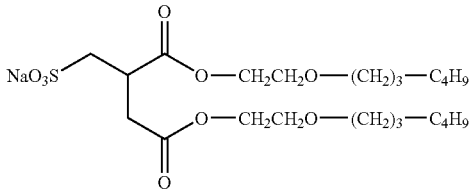

FS-244

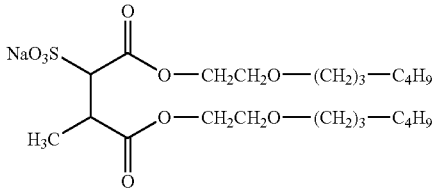

The compounds of the above general formula (A) can be easily synthesized by the use of common esterification reaction and sulfonation reaction in combination. The conversion of counter cation can be easily accomplished by the use of an ion exchange resin. Examples of representative synthetic methods will be described below, which however in no way limit the scope of the present invention.

SYNTHETIC EXAMPLE 1

Synthesis of Compound FS-201

1-1 Synthesis of di(3,3,4,4,5,5,6,6,6-nonafluorohexyl)maleate 90.5 g (0.924 mol) of maleic anhydride, 500 g (1.89 mol) of 3,3,4,4,5,5,6,6,6-nonafluorohexanol and 17.5 g (0.09 mol) of p-toluenesulfonic acid monohydrate were heated in 1000 L of toluene under reflux while distilling off formed water for 20 hr. The thus obtained reaction mixture was cooled to room temperature, and toluene was added thereto. The organic phase was washed with water, and the solvent was distilled off in vacuum, thereby obtaining 484 g of desired product (yield 86%) as a transparent liquid.

1-2 Synthesis of Compound FS-201

514 g (0.845 mol) of di(3,3,4,4,5,5,6,6,6-nonafluorohexyl)maleate, 91.0 g (0.875 mol) of sodium hydrogen sulfite and 250 mL of water/ethanol (1/1 v/v) were mixed together, and heated under reflux for 6 hr. 500 mL of ethyl acetate and 120 mL of a saturated aqueous solution of sodium chloride were added to the mixture, and an extraction was effected. The organic phase was recovered, and sodium sulfate was added so as to dehydrate the organic phase. Sodium sulfate was removed by filtration, and the filtrate was concentrated. 2.5 L of acetone was added to the concentrate, and heated. Undissolved matter was filtered off, and the solution was cooled to 0° C. 2.5 L of acetonitrile was slowly added to effect precipitation. Precipitated solid was collected by filtration, and obtained crystal was dried in vacuum at 80° C. As a result, 478 g (yield 79%) of desired compound as white crystal was obtained. $^1$H-NMR data of the obtained compound are as follows:

$^1$H-NMR (DMSO-$d_6$) δ 2.49–2.62 (m, 4H), 2.85–2.99 (m, 2H), 3.68 (dd, 1H), 4.23–4.35 (m, 4H).

Now, the compounds of the following general formula (B) will be described in detail.

General formula (B)

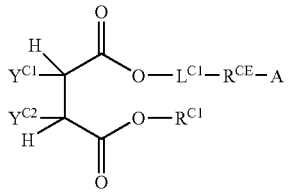

In the general formula (B), $R^{C1}$ represents a substituted or unsubstituted alkyl group (provided that the substituent does not include a fluorine atom). $R^{CF}$ represents a perfluoroalkylene group. A represents a hydrogen atom or fluorine atom. $L^{C1}$ represents a substituted or unsubstituted alkylene group, a substituted or unsubstituted alkyleneoxy group, or bivalent linking group composed of a combination of a substituted or unsubstituted alkylene group with a substituted or unsubstituted alkyleneoxy group. One of $Y^{C1}$ and $Y^{C2}$ represents a hydrogen atom while the other represents $-L^{C2}-SO_3M$ in which $L^{C2}$ represents a single bond or a substituted or unsubstituted alkylene group and M represents a cation.

In the general formula (B), $R^{C1}$ represents a substituted or unsubstituted alkyl group. The substituted or unsubstituted alkyl group represented by $R^{C1}$ may be linear, or may be in the form of a branched chain, or may have a cyclic structure. Any of the substituents described as T to be referred to later can be used as the substituent. As the substituent, there can preferably be mentioned an alkenyl group, aryl group, alkoxy group, halogen atom (more preferably Cl), carboxylic ester group, carbonamido group, carbamoyl group, oxycarbonyl group, phosphoric ester group or the like.

$R^{C1}$ preferably represents an unsubstituted alkyl group, more preferably an unsubstituted alkyl group having 2 to 24 carbon atoms, still more preferably an unsubstituted alkyl group having 4 to 20 carbon atoms, and especially preferably an unsubstituted alkyl group having 6 to 20 carbon atoms.

$R^{CF}$ represents a perfluoroalkylene group. Herein, the perfluoroalkylene group refers to an alkylene group having all the hydrogen atoms thereof replaced by fluorine. The perfluoroalkylene group may be linear, or may be in the form of a branched chain, or may have a cyclic structure. $R^{CF}$ preferably has 1 to 10 carbon atoms, more preferably 1 to 8 carbon atoms.

A represents a hydrogen atom or fluorine atom. A fluorine atom is preferred.

$L^{C1}$ represents a substituted or unsubstituted alkylene group, substituted or unsubstituted alkyleneoxy group, or a bivalent group composed of a combination of a substituted or unsubstituted alkylene group with a substituted or unsubstituted alkyleneoxy group. The substituent can be any of those of preferred range which have been mentioned above with respect to $R^{C1}$. $L_{C1}$ preferably has 4 or less carbon atoms, and it is preferred that $L^{C1}$ represent an unsubstituted alkylene.

One of $Y^{C1}$ and $Y^{C2}$ represents a hydrogen atom while the other represents $-L^{C2}-SO_3M$ in which M represents a cation. As the cation represented by M, preferred use is made of, for example, an alkali metal ion (lithium ion, sodium ion, potassium ion, etc.), an alkaline earth metal ion (barium ion, calcium ion, etc.), or ammonium ion. Lithium ion, sodium ion, potassium ion and ammonium ion are more preferred. Lithium ion, sodium ion and potassium ion are still more preferred. Appropriate cation can be selected depending on the total number of carbon atoms, substituent, degree of alkyl branching, etc. with respect to the compound of the above general formula (B). When the total number of carbon atoms had by $R^{C1}$, $R^{CF}$ and $L^{C1}$ is 16 or greater, the employment of lithium ion is advantageous from the viewpoint of simultaneous attainment of solubility (especially in water) and antistatic capability or coating uniformity.

$L^{C2}$ represents a single bond or a substituted or unsubstituted alkylene group. The substituent can be any of those of preferred range which have been mentioned above with respect to $R^{C1}$.

$L^{C2}$ preferably represents a single bond or an alkylene group having 2 or less carbon atoms, more preferably a single bond or an unsubstituted alkylene group, and still more preferably a single bond or a methylene group. Most preferably, $L^{C2}$ represents a single bond.

Among the compounds of the above general formula (B), compounds of the following general formula (B-1) are preferred.

General formula (B-1)

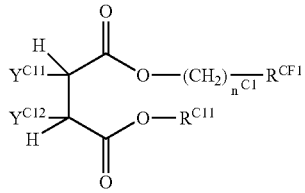

In the general formula (B-1), $R^{C11}$ represents a substituted or unsubstituted alkyl group whose total number of carbon atoms is 6 or greater. $R^{CF1}$ represents a perfluoroalkyl group having 6 or less carbon atoms. One of $Y^{C11}$ and $Y^{C12}$ represents a hydrogen atom while the other represents $SO_3MC$ in which MC represents a cation. $n^{C1}$ is an integer of 1 or greater.

In the general formula (B-1), $R^{C11}$ represents a substituted or unsubstituted alkyl group whose total number of carbon atoms is 6 or greater, provided that $R^{C11}$ is not a fluorinated alkyl group. The substituted or unsubstituted alkyl group represented by $R^{C11}$ may be linear, or may be in the form of a branched chain, or may have a cyclic structure. As the substituent, there can be mentioned an alkenyl group, an aryl group, an alkoxy group, a halogen atom excluding fluorine, a carboxylic ester group, a carbonamido group, a carbamoyl group, an oxycarbonyl group, a phosphoric ester group or the like.

The total number of carbon atoms of the substituted or unsubstituted alkyl group represented by $R^{C11}$ is preferably in the range of 6 to 24. Preferred examples of the unsubstituted alkyl groups having 6 to 24 carbon atoms include n-hexyl, n-heptyl, n-octyl, tert-octyl, 2-ethylhexyl, n-nonyl, 1,1,3-trimethylhexyl, n-decyl, n-dodecyl, cetyl, hexadecyl, 2-hexyldecyl, octadecyl, eicosyl, 2-octyldodecyl, docosyl, tetracosyl, 2-decyltetradecyl, tricosyl, cyclohexyl, cycloheptyl and the like. Preferred examples of the substituted alkyl groups whose total number of carbon atoms, inclusive of the carbon atoms of substituent, is in the range of 6 to 24 include 2-hexenyl, oleyl, linoleyl, linolenyl, benzyl, β-phenethyl, 2-methoxyethyl, 4-phenylbutyl, 4-acetoxyethyl, 6-phenoxyhexyl, 12-phenyldodecyl, 18-phenyloctadecyl, 12-(p-chlorophenyl)dodecyl, 2-(phosphatodiphenyl)ethyl and the like.

The total number of carbon atoms of the substituted or unsubstituted alkyl group represented by $R^{C11}$ is more preferably in the range of 6 to 18. Preferred examples of the unsubstituted alkyl groups having 6 to 18 carbon atoms include n-hexyl, cyclohexyl, n-heptyl, n-octyl, 2-ethylhexyl, n-nonyl, 1,1,3-trimethylhexyl, n-decyl, n-dodecyl, cetyl, hexadecyl, 2-hexyldecyl, octadecyl, 4-tert-butylcyclohexyl and the like. Preferred examples of the substituted alkyl groups whose total number of carbon atoms, inclusive of the carbon atoms of substituent, is in the range of 6 to 18 include phenethyl, 6-phenoxyhexyl, 12-phenyldodecyl, oleyl, linoleyl, linolenyl and the like. Still more preferably, $R^{C11}$ represents n-hexyl, cyclohexyl, n-heptyl, n-octyl, 2-ethylhexyl, n-nonyl, 1,1,3-trimethylhexyl, n-decyl, n-dodecyl, cetyl, hexadecyl, 2-hexyldecyl, octadecyl, oleyl, linoleyl or linolenyl. It is most preferred that $R^{C11}$ represent a linear, cyclic or branched unsubstituted alkyl group having 8 to 16 carbon atoms.

In the general formula (B-1), $R^{CF1}$ represents a perfluoroalkyl group having 6 or less carbon atoms. Herein, the perfluoroalkyl group refers to an alkyl group having all the hydrogen atoms thereof replaced by fluorine. The alkyl of the perfluoroalkyl group may be linear, or may be in the form of a branched chain, or may have a cyclic structure. The perfluoroalkyl group represented by $R^{CF1}$ can be, for example, any of trifluoromethyl, pentafluoroethyl, heptafluoro-n-propyl, heptafluoroisopropyl, nonafluoro-n-butyl, undecafluoro-n-pentyl, tridecafluoro-n-hexyl, undecafluorocyclohexyl and the like. Of these, perfluoroalkyl groups having 2 to 4 carbon atoms (e.g., pentafluoroethyl, heptafluoro-n-propyl, heptafluoroisopropyl and nonafluoro-n-butyl) are preferred. Heptafluoro-n-propyl and nonafluoro-n-butyl are especially preferred.

In the general formula (B-1), $n^{C1}$ is an integer of 1 or greater, preferably an integer of 1 to 4, and most preferably 1 or 2.

With respect to combinations of $n^{C1}$ and $R^{CF1}$, it is preferred that when $n^{C1}=1$, $R^{CF1}$ be heptafluoro-n-propyl or nonafluoro-n-butyl, and that when $n^{C1}=2$, $R^{CF1}$ be nonafluoro-n-butyl.

In the general formula (B-1), one of $Y^{C11}$ and $Y^{C12}$ represents a hydrogen atom while the other represents $SO_3MC$ in which MC represents a cation. As the cation represented by MC, preferred use is made of, for example, an alkali metal ion (lithium ion, sodium ion, potassium ion, etc.), an alkaline earth metal ion (barium ion, calcium ion, etc.), or ammonium ion. Among these, lithium ion, sodium ion, potassium ion and ammonium ion are more preferred. Sodium ion is most preferred.

Specific examples of the compounds of the above general formula (B) will be shown below, which however in no way limit the scope of the present invention.

FS-301

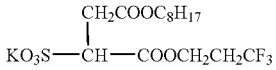

FS-302

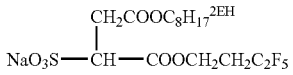

FS-303

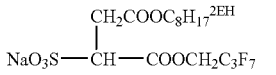

FS-304

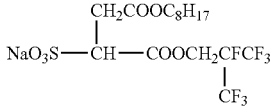

FS-305

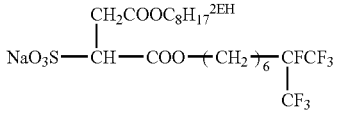

FS-306

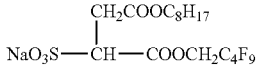

FS-307

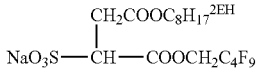

FS-308

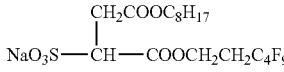

FS-309

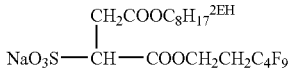

FS-310

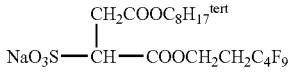

FS-311

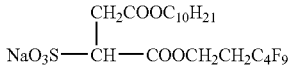

FS-312

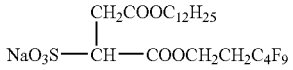

FS-313

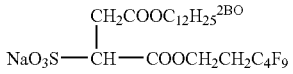

FS-314

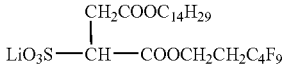

FS-315

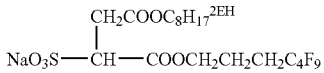

FS-316

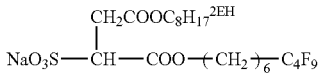

FS-317

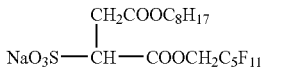

-continued

FS-318

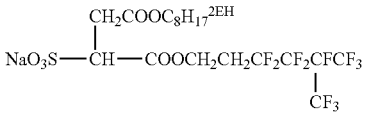

FS-319

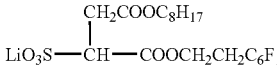

FS-320

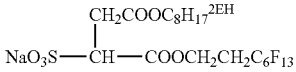

FS-321

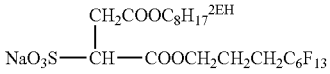

FS-322

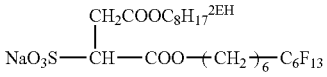

FS-323

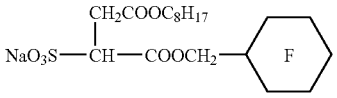

FS-324

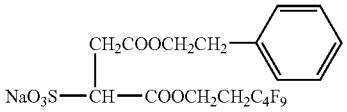

FS-325

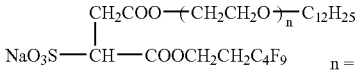

FS-326

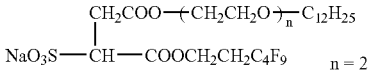

FS-327

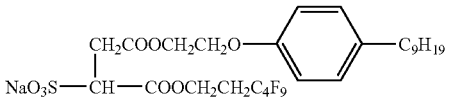

FS-328

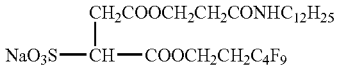

FS-329

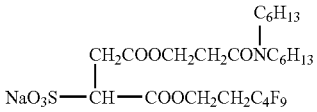

FS-330

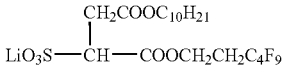

FS-331

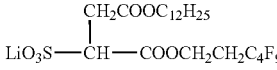

FS-332

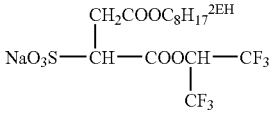

-continued

FS-333

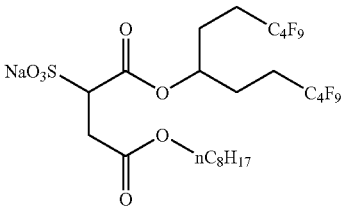

FS-334

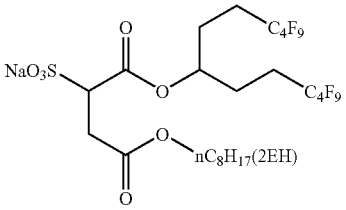

FS-335

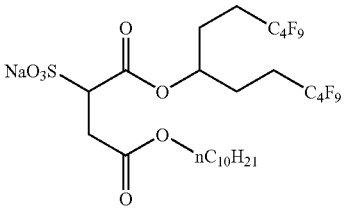

The compounds of the above general formula (B) can be easily synthesized by sequentially subjecting common maleic anhydride, etc. as a raw material to monoesterification reaction, acid halogenation, esterification reaction and sulfonation reaction. Further, the replacement of counter cation can be easily effected by the use of an ion exchange resin.

Examples of representative synthetic methods will be described below, which however in no way limit the scope of the present invention.

SYNTHETIC EXAMPLE 2

Synthesis of Compound FS-303

2-1 Synthesis of 2-ethylhexyl maleate chloride 4.5 g (20 mmol) of mono(2-ethylhexyl)maleate, product of Aldrich, was slowly dropped in 4.1 g (20 mmol) of phosphorus pentachloride while maintaining the temperature of the mixture at 30° C. or below. After the completion of dropping, the mixture was agitated at room temperature for 1 hr. Thereafter, the mixture was heated to 60° C., and the pressure was reduced by an aspirator to thereby distill off formed phosphorus oxychloride. As a result, there was obtained 4.5 g (yield: 92%) of light brown oily compound consisting of 2-ethylhexyl maleate chloride.

2-2 Synthesis of mono(2-ethylhexyl)mono(2,2,3,3,4,4,4-heptafluorobutyl)maleate 66.8 g (0.334 mol) of 2,2,3,3,4,4,4-heptafluorobutanol and 29.6 mL (0.367 mol) of pyridine were dissolved in 180 mL of acetonitrile, and while maintaining the internal temperature at 20° C. or below by cooling with an ice bath, 90.6 g (0.367 mol) of mono(2-ethylhexyl)maleate chloride was dropped in the solution. After the completion of dropping, the mixture was agitated at room temperature for 1 hr. Thereafter, 1000 mL of ethyl acetate was added, and the organic phase was washed with a 1 mol/L aqueous hydrochloric acid solution and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 80.3 g (yield: 59%) of desired compound as a colorless transparent oily compound.

2-3 Synthesis of sodium mono(2-ethylhexyl)mono(2,2,3,3,4,4,4-heptafluorobutyl)sulfosuccinate (FS-303)

80.3 g (0.196 mol) of mono(2-ethylhexyl)mono(2,2,3,3,4,4,4-heptafluorobutyl)maleate, 20.4 g (0.196 mol) of sodium hydrogen sulfite and 80 mL of water/ethanol (1/1 v/v) were mixed together and heated under reflux for 10 hr. Thereafter, 1000 mL of ethyl acetate was added, and the organic phase was washed with a saturated aqueous sodium chloride solution. The resultant organic layer was collected, and the organic solvent was distilled off in vacuum. Purification by silica gel column chromatography (chloroform/methanol: 9/1 v/v) was performed. The collected organic phase was washed with a saturated aqueous sodium chloride solution, and the organic solvent was distilled off in vacuum, thereby obtaining 32 g (yield: 32%) of desired compound as a colorless transparent solid.

$^1$H-NMR data of the obtained compound are as follows:

$^1$H-NMR (DMSO-$d_6$) δ 0.81–0.87 (m, 6H), 1.24 (m, 8H), 1.50 (b r, 1H), 2.77–2.99 (m, 2H), 3.63–3.71 (m, 1H), 3.86–3.98 (m, 3H), 4.62–4.84 (br, 1H).

SYNTHETIC EXAMPLE 3

Synthesis of Compound FS-312

3-1 Synthesis of monodecyl mono(3,3,4,4,5,5,6,6,6-nonafluorohexyl)maleate 164.6 g (623 mmol) of 3,3,4,4,5,5,6,6,6-nonafluorohexanol and 49.3 mL (623 mmol) of pyridine were dissolved in 280 mL of chloroform, and while maintaining the internal temperature at 20° C. or below by cooling with an ice bath, 155.8 g (566 mmol) of monodecyl maleate chloride was dropped in the solution. After the completion of dropping, the mixture was agitated at room temperature for 1 hr. Thereafter, ethyl acetate was added, and the organic phase was washed with a 1 mol/L aqueous hydrochloric acid solution and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 48.2 g (yield: 18%) of desired compound.

3-2 Synthesis of sodium monodecyl mono(3,3,4,4,5,5,6,6,6-nonafluorohexyl)sulfosuccinate (FS-312)

48.0 g (90 mmol) of monodecyl mono(3,3,4,4,5,5,6,6,6-nonafluorohexyl)maleate, 10.4 g (99 mmol) of sodium hydrogen sulfite and 50 mL of water/ethanol (1/1 v/v) were mixed together and heated under reflux for 5 hr. Thereafter, ethyl acetate was added, and the organic phase was washed with a saturated aqueous sodium chloride solution. The resultant organic layer was collected, and the organic solvent was distilled off in vacuum. Recrystallization from acetonitrile was performed, thereby obtaining 12.5 g (yield: 22%) of desired compound as a colorless transparent solid.

$^1$H-NMR data of the obtained compound are as follows:

$^1$H-NMR (DMSO-$d_6$) δ 0.81–0.87 (t, 3H), 1.24 (m, 18H), 1.51 (br, 2H), 2.50–2.70 (m, 2H), 2.70–2.95 (m, 2H), 3.61–3.70 (m, 1H), 3.96 (m, 2H), 4.28 (ms, 2H).

SYNTHETIC EXAMPLE 4

Synthesis of Compound FS-309

4-1 Synthesis of mono(2-ethylhexyl)mono(3,3,4,4,5,5,6,6,6-nonafluorohexyl)maleate 515 g (1.95 mol) of 3,3,4,4,5,5,6,6,6-nonafluorohexanol, 169 g (2.13 mol) of pyridine and 394 mL (3.89 mol) of triethylamine were dissolved in 1000 mL of chloroform, and while maintaining the internal temperature at 20° C. or below by cooling with an ice bath, 530 g (2.14 mol) of 2-ethylhexyl maleate chloride was dropped in the solution. After the completion of dropping, the mixture was agitated at room temperature for 1 hr. Thereafter, chloroform was added, and the organic phase was washed with water and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 508 g (yield: 50%) of colorless transparent desired compound.

4-2 Synthesis of sodium mono(2-ethylhexyl)mono(3,3,4,4,5,5,6,6,6-nonafluorohexyl)sulfosuccinate (FS-309)

137.5 g (0.29 mol) of mono(2-ethylhexyl)mono(3,3,4,4,5,5,6,6,6-nonafluorohexyl)maleate, 33.2 g (0.32 mol) of sodium hydrogen sulfite and 140 mL of water/ethanol (1/1 v/v) were mixed together and heated under reflux for 2 hr. Thereafter, 1000 mL of ethyl acetate was added, and the organic phase was washed with a saturated aqueous sodium chloride solution. The resultant organic layer was collected, and the organic solvent was distilled off in vacuum. Recrystallization from 800 mL of toluene was performed. Crystal was precipitated by cooling with an ice bath, and finally collected by filtration. As a result, there was obtained 140 g (yield: 84%) of colorless transparent desired compound.

$^1$H-NMR data of the obtained compound are as follows:

$^1$H-NMR (DMSO-$d_6$) δ 0.82–0.93 (m, 6H), 1.13–1.32 (m, 8H), 1.50 (br, 1H), 2.57–2.65 (m, 2H), 2.84–2.98 (m, 2H), 3.63–3.68 (m, 1H), 3.90 (d, 2H), 4.30 (m, 2H).

SYNTHETIC EXAMPLE 5

Synthesis of Compound FS-332

5-1 Synthesis of mono(2-ethylhexyl)mono(1,1,1,3,3,3-hexafluoro-2-propyl)maleate 33.7 g (201 mmol) of 1,1,1,3,3,3-hexafluoro-2-propanol (HFIP) and 17.9 mL (220 mmol) of pyridine were dissolved in 80 mL of acetonitrile, and while maintaining the internal temperature at 20° C. or below by cooling with an ice bath, 41.8 g (220 mmol) of mono(2-ethylhexyl)maleate chloride was dropped in the solution. After the completion of dropping, the mixture was agitated at room temperature for 1 hr. Thereafter, ethyl acetate was added, and the organic phase was washed with a 1 mol/L aqueous hydrochloric acid solution and a saturated aqueous sodium chloride solution. The resultant organic layer was collected, and the organic solvent was distilled off in vacuum. Purification by silica gel column chromatography (hexane/chloroform: 10/0 to 7/3 v/v) was performed, thereby obtaining 10.6 g (yield: 14%) of desired compound as a colorless transparent oily compound.

5-2 Synthesis of Compound FS-332

10.6 g (28 mmol) of mono(2-ethylhexyl)mono(1,1,1,3,3,3-hexafluoro-2-propyl)maleate, 3.2 g (31 mmol) of sodium hydrogen sulfite and 10 mL of water/ethanol (1/1 v/v) were mixed together and heated under reflux for 10 hr. Thereafter, ethyl acetate was added, and the organic phase was washed with a saturated aqueous sodium chloride solution. The resultant organic layer was collected, and the organic solvent was distilled off in vacuum. Recrystallization from acetonitrile was performed, thereby obtaining 1.7 g (yield: 13%) of desired compound as a colorless transparent solid.

$^1$H-NMR data of the obtained compound are as follows:

$^1$H-NMR (DMSO-$d_6$) δ 0.81–0.87 (m, 6H), 1.25 (m, 8H), 1.50 (br, 1H), 2.73–2.85 (m, 2H), 3.59 (m, 1H), 3.85–3.90 (m, 2H), 12.23 (br, 1H).

Among the above various compounds, ionic surfactants can be used in the form of various salts produced by ion exchange, neutralization or other means, or used in the presence of at least one counter ion, in accordance with the purpose of use thereof, needed properties, etc.

The layer to be loaded with the fluorinated compound of the present invention and the amount thereof are not particularly limited. The use amount thereof can be arbitrarily decided in conformity with the structure and usage of employed compound, the type and amount of materials contained in water-base composition, the constitution of medium, etc. For example, when it is intended to use the water-base coating composition of the present invention as a coating liquid for the hydrophilic colloid (gelatin) layer constituting the uppermost layer of silver halide photosensitive material, it is preferred that the concentration in coating composition of the fluorinated compound of the present invention be in the range of 0.003 to 0.5% by weight and, based on gelatin solid contents, 0.03 to 5% by weight.

In the present invention, at least one compound selected from the fluorinated compound represented by the general formula (A) and the fluorinated compound represented by the general formula (B) may be contained. A plurality of compounds selected from those represented by the general formula (A) alone, by the general formula (B) alone, or by both the general formula (A) and the general formula (B) may also be used in combination.

The substituent, T, as an example of substituents which may be possessed by groups capable of substitution in the above general formulas will be described below.

The substituent, T, can be, for example, any of an alkyl group (preferably having 1 to 20 carbon atoms, more preferably 1 to 12 carbon atoms and especially preferably 1 to 8 carbon atoms; e.g., methyl, ethyl, isopropyl, tert-butyl, n-octyl, n-decyl, n-hexadecyl, cyclopropyl, cyclopentyl or cyclohexyl), alkenyl group (preferably having 2 to 20 carbon atoms, more preferably 2 to 12 carbon atoms and especially preferably 2 to 8 carbon atoms; e.g., vinyl, allyl, 2-butenyl or 3-pentenyl), alkynyl group (preferably having 2 to 20 carbon atoms, more preferably 2 to 12 carbon atoms and especially preferably 2 to 8 carbon atoms; e.g., propargyl or 3-pentynyl), aryl group (preferably having 6 to 30 carbon atoms, more preferably 6 to 20 carbon atoms and especially preferably 6 to 12 carbon atoms; e.g., phenyl, p-methylphenyl or naphthyl), substituted or unsubstituted amino group (preferably having 0 to 20 carbon atoms, more preferably 0 to 10 carbon atoms and especially preferably 0 to 6 carbon atoms; e.g., unsubstituted amino, methylamino, dimethylamino, diethylamino or dibenzylamino), alkoxy group (preferably having 1 to 20 carbon atoms, more preferably 1 to 12 carbon atoms and especially preferably 1 to 8 carbon atoms; e.g., methoxy, ethoxy or butoxy), aryloxy group (preferably having 6 to 20 carbon atoms, more preferably 6 to 16 carbon atoms and especially preferably 6 to 12 carbon atoms; e.g., phenyloxy or 2-naphthyloxy), acyl group (preferably having 1 to 20 carbon atoms, more preferably 1 to 16 carbon atoms and especially preferably 1 to 12 carbon atoms; e.g., acetyl, benzoyl, formyl or pivaloyl), alkoxycarbonyl group (preferably having 2 to 20 carbon atoms, more preferably 2 to 16 carbon atoms and especially preferably 2 to 12 carbon atoms; e.g., methoxycarbonyl or ethoxycarbonyl), aryloxycarbonyl group (preferably having 7 to 20 carbon atoms, more preferably 7 to 16 carbon atoms and especially preferably 7 to 10 carbon atoms; e.g., phenyloxycarbonyl), acyloxy group (preferably having 2 to 20 carbon atoms, more preferably 2 to 16 carbon atoms and especially preferably 2 to 10 carbon atoms; e.g., acetoxy or benzoyloxy), acylamino group (preferably having 2 to 20 carbon atoms, more preferably 2 to 16 carbon atoms and especially preferably 2 to 10 carbon atoms; e.g., acetylamino or benzoylamino), alkoxycarbonylamino group (preferably having 2 to 20 carbon atoms, more preferably 2 to 16 carbon atoms and especially preferably 2 to 12 carbon atoms; e.g., methoxycarbonylamino), aryloxycarbonylamino group (preferably having 7 to 20 carbon atoms, more preferably 7 to 16 carbon atoms and especially preferably 7 to 12 carbon atoms; e.g., phenyloxycarbonylamino), sulfonylamino group (preferably having 1 to 20 carbon atoms, more preferably 1 to 16 carbon atoms and especially preferably 1 to 12 carbon atoms; e.g., methanesulfonylamino or benzenesulfonylamino), sulfamoyl group (preferably having 0 to 20 carbon atoms, more preferably 0 to 16 carbon atoms and especially preferably 0 to 12 carbon atoms; e.g., sulfamoyl, methylsulfamoyl, dimethylsulfamoyl or phenylsulfamoyl), carbamoyl group (preferably having 1 to 20 carbon atoms, more preferably 1 to 16 carbon atoms and especially preferably 1 to 12 carbon atoms; e.g., unsubstituted carbamoyl, methylcarbamoyl, diethylcarbamoyl or phenylcarbamoyl), alkylthio group (preferably having 1 to 20 carbon atoms, more preferably 1 to 16 carbon atoms and especially preferably 1 to 12 carbon atoms; e.g., methylthio or ethylthio), arylthio group (preferably having 6 to 20 carbon atoms, more preferably 6 to 16 carbon atoms and especially preferably 6 to 12 carbon atoms; e.g., phenylthio), sulfonyl group (preferably having 1 to 20 carbon atoms, more preferably 1 to 16 carbon atoms and especially preferably 1 to 12 carbon atoms; e.g., mesyl or tosyl), sulfinyl group (preferably having 1 to 20 carbon atoms, more preferably 1 to 16 carbon atoms and especially preferably 1 to 12 carbon atoms; e.g., methanesulfinyl or benzenesulfinyl), ureido group (preferably having 1 to 20 carbon atoms, more preferably 1 to 16 carbon atoms and especially preferably 1 to 12 carbon atoms; e.g., unsubstituted ureido, methylureido or phenylureido), phosphoramido group (preferably having 1 to 20 carbon atoms, more preferably 1 to 16 carbon atoms and especially preferably 1 to 12 carbon atoms; e.g., diethylphosphoramido or phenylphosphoramido), hydroxyl group, mercapto group, halogen atom (e.g., fluorine atom, chlorine atom, bromine atom or iodine atom), cyano group, sulfo group, carboxyl group, nitro group, hydroxamic acid group, sulfino group, hydrazino group, imino group, heterocyclic group (preferably having 1 to 30 carbon atoms, more preferably 1 to 12 carbon atoms, and containing a heteroatom such as a nitrogen atom, an oxygen atom or a sulfur atom; e.g., imidazolyl, pyridyl, quinolyl, furyl, piperidyl, morpholino, benzoxazolyl, benzimidazoyl or benzthiazolyl) and silyl group (preferably having 3 to 40 carbon atoms, more preferably 3 to 30 carbon atoms and especially preferably 3 to 24 carbon atoms; e.g., trimethylsilyl or triphenylsilyl). These substituents may have further substituents. In the use of two or more substituents, they may be identical with or different from each other. Moreover, if appropriate, the substituents may bond together to form a ring.

It is preferred that the silver halide emulsion for use in the photosensitive material of the present invention be a silver iodobromide, silver bromide or silver chloroiodobromide tabular grain emulsion.

With respect to the color photosensitive material of the present invention, preferably, each unit light-sensitive layer is constituted of multiple silver halide emulsion layers which exhibit substantially identical color sensitivity but are different in speed. Further, 50% or more of the total projected area of silver halide grains contained in at least one layer of the emulsion layers with the highest photographic speed among the silver halide emulsion layers constituting each of the unit light-sensitive layers consists of tabular silver halide grains (hereinafter also referred to as "tabular grains"). In the present invention, the average aspect ratio of such tabular grains is preferably 8 or higher, more preferably 12 or higher, and most preferably 15 or higher.

With respect to tabular grains, the aspect ratio refers to the ratio of diameter to thickness of silver halides. That is, the aspect ratio is the quotient of diameter divided by thickness with respect to each individual silver halide grain. Herein, the diameter refers to the diameter of a circle with an area equal to the projected area of grain exhibited when silver halide grains are observed through a microscope or an electron microscope. Further, herein, the average aspect ratio refers to the average of aspect ratios regarding all the tabular grains of each emulsion.

The method of taking a transmission electron micrograph by the replica technique and determining the equivalent circle diameter and thickness of each individual grain can be mentioned as an example of aspect ratio determining method. In the mentioned method, the thickness is calculated from the length of replica shadow.

The configuration of tabular grains of the present invention is generally hexagonal. The terminology "hexagonal configuration" means that the shape of the main plane of tabular grains is hexagonal, the neighboring side ratio (maximum side length/minimum side length) thereof being 2 or less. The neighboring side ratio is preferably 1.6 or less, more preferably 1.2 or less. That the lower limit thereof is 1.0 is needless to mention. In the grains of high aspect ratio, especially, triangular tabular grains are increased in the tabular grains. The triangular tabular grains are produced when the Ostwald ripening has excessively been advanced. From the viewpoint of obtaining substantially hexagonal tabular grains, it is preferred that the period of this ripening be minimized. For this purpose, it is requisite to endeavor to raise the tabular grain ratio by nucleation. It is preferred that one or both of an aqueous silver ion solution and an aqueous bromide ion solution contain gelatin for the purpose of raising the probability of occurrence of hexagonal tabular grains at the time of adding silver ions and bromide ions to a reaction mixture according to the double jet technique, as described in JP-A-63-11928 by Saito.

The hexagonal tabular grains for use in the present invention are formed through the steps of nucleation, Ostwald ripening and growth. Although all of these steps are important for suppressing the spread of grain size distribution, especial attention should be paid so as to prevent the spread of size distribution at the first nucleation step because the spread of size distribution brought about in a previous step cannot be narrowed by an ensuing step. What is important in the nucleation step is the relationship between the temperature of reaction mixture and the period of nucleation comprising adding silver ions and bromide ions to a reaction mixture according to the double jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

In order to obtain monodisperse tabular grains with high aspect ratio, gelatin is additionally added during grain formation. At this time, the gelatin use is preferably chemically modified gelatin described in JP-A's-10-148897 and 11-143002. The chemically modified gelatin is one characterized in that at the time of chemically modifying amino groups thereof, at least two carboxyl groups are introduced. Trimellitated gelatin is preferably used. Succinated gelatin is also preferable. The gelatin is preferably added before growth step, and more preferably added immediately after nucleation. The addition amount is preferably 60% or more, more preferably 80% or more, and especially preferably 90% or more to the total weight of dispersing medium during grain formation.

Tabular grain emulsion preferably comprises silver iodobromide or silver chloroiodobromide. Although silver chloride may be contained, the silver chloride content is preferably 8 mol % or less, more preferably 3 mol % or less, and most preferably 0 mol %. For silver iodide content, since the coefficient variation of grain size distribution of the tabular grain emulsion is preferably 30% or less, the silver iodide content is preferably 20 mol % or less. It becomes easier to reduce the variation coefficient of distribution of equivalent circle diameters of the tabular grain emulsion by reducing the silver iodide content. Especially, the coefficient variation of the distribution of grain sizes of the tabular grain emulsion is preferably 20% or less, and the silver iodide content is preferably 10 mol % or less.

The tabular grain emulsion preferably has an intra grain structure of silver iodide distribution. In this case, the structure of the silver iodide distribution may be a double structure, a triple structure, a quadruple structure, or higher structures.

In the present invention, the tabular grains preferably have dislocation lines. The dislocation lines of the tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 3, 5, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 μm in thickness) is preferred for ensuring clearer observation. The thus obtained photograph of grains enables determining the position and number of dislocation lines in each grain viewed in the direction perpendicular to the main planes.

In the emulsion of the present invention the number of dislocation lines of the tabular grains is preferably at least 10 per grain on the average and more preferably at least 20 per grain on the average. When dislocation lines are densely present or when dislocation lines are observed in the state of crossing each other, it happens that the number of dislocation lines per grain cannot accurately be counted. However, in this instance as well, rough counting on the order of, for example, 10, 20 or 30 dislocation lines can be effected, so that a clear distinction can be made from the presence of only a few dislocation lines. The average number of dislocation lines per grain is determined by counting the number of dislocation lines of each of at least 100 grains and calculating a number average thereof. There are instances when hundreds of dislocation lines are observed.

Dislocation lines can be introduced in, for example, the vicinity of the periphery of tabular grains. In this instance, the dislocation is nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grain. The dislocation lines are crystallographically oriented approximately in the (211) direction. However, the dislocation lines often meander and may also cross each other.

Dislocation lines may be positioned either nearly uniformly over the entire zone of the periphery of the tabular grains or local points of the periphery. That is, referring to, for example, hexagonal tabular silver halide grains, dislocation lines may be localized either only in the vicinity of six apexes or only in the vicinity of one of the apexes. Contrarily, dislocation lines can be localized only in the sides excluding the vicinity of six apexes.

Furthermore, dislocation lines may be formed over regions including the centers of two mutually parallel main planes of tabular grains. In the case where dislocation lines are formed over the entire regions of the main planes, the dislocation lines may crystallographically be oriented approximately in the (211) direction when viewed in the direction perpendicular to the main planes, and the formation of the dislocation lines may be effected either in the (110) direction or randomly. Further, the length of each dislocation line may be random, and the dislocation lines may be observed as short lines on the main planes or as long lines extending to the side (periphery). The dislocation lines may be straight or often meander. In many instances, the dislocation lines cross each other.

The position of dislocation lines may be localized on the periphery, or on main planes or local points thereof as mentioned above, or the formation of dislocation lines may be effected on a combination thereof. That is, dislocation lines may be concurrently present on both the periphery and the main planes.

The introduction of dislocation lines in the tabular grains can be accomplished by disposing a specified phase of high silver iodide content within the grains. In the dislocation line introduction, the phase of high silver iodide content may be provided with discontinuous regions of high silver iodide content. Practically, the phase of high silver iodide content within the grains can be obtained by first preparing base grains, providing them with a phase of high silver iodide content and covering the outside thereof with a phase of silver iodide content lower than that of the phase of high silver iodide content. The silver iodide content of the base tabular grains is lower than that of the phase of high silver iodide content, and is preferably 0 to 20 mol %, more preferably 0 to 15 mol %.

In the present invention, the terminology "phase of high silver iodide content within the grains" refers to a silver halide solid solution containing silver iodide. The silver halide of this solid solution is preferably silver iodide, silver iodobromide or silver chloroiodobromide, more preferably silver iodide or silver iodobromide (the silver iodide content is in the range of 10 to 40 mol % based on the silver halides contained in the phase of high silver iodide content). For selectively causing the phase of high silver iodide content within the grains (hereinafter referred to as "internal high silver iodide phase") to be present on any place of the sides, corners and faces of the base grains, it is desirable to control forming conditions for the base grains, forming conditions for the internal high silver iodide phase and forming conditions for the phase covering the outside thereof. With respect to the forming conditions for the base grains, the pAg (logarithm of inverse number of silver ion concentration), the presence or absence, type and amount of silver halide solvent and the temperature are important factors. Regulating the pAg at base grain growth to 8.5 or less, preferably 8 or less, enables selectively causing the internal high silver iodide phase to be present near the apex or on the face of the base grains in the subsequent step of forming the internal high silver iodide phase.

On the other hand, regulating the pAg at base grain growth to at least 8.5, preferably at least 9, enables causing the internal high silver iodide phase to be present on the side of the base grains in the subsequent step of forming the internal high silver iodide phase. The threshold value of the pAg is changed upward or downward depending on the temperature and the presence or absence, type and amount of silver halide solvent. When, for example, a thiocyanate is used as the silver halide solvent, the threshold value of the pAg is deviated toward a higher value. What is most important as the pAg at growth is the pAg at the termination of growth of base grains. On the other hand, even when the pAg at growth does not satisfy the above value, the selected position of the internal high silver iodide phase can be controlled by carrying out, after the growth of base grains, the regulation to the above pAg and a ripening. Ammonia, an amine compound, a thiourea derivative or a thiocyanate salt is effective as the silver halide solvent. For the formation of the internal high silver iodide phase, use can be made of the so-called conversion methods.

These conversion methods include one in which, during grain formation, halide ions whose salts formed with silver ions exhibit a solubility lower than that of the salts formed with the halide ions that are forming the grains or the vicinity of the surface of the grains occurring at the time of grain formation, are added. In the present invention, it is preferred that the amount of added low-solubility halide ions be at least some value (relating to halogen composition) relative to the surface area of grains occurring at the time of the addition. For example, it is preferred that, during grain formation, KI be added in an amount not smaller than some amount relative to the surface area of silver halide grains occurring at the time of the grain formation. Specifically, it is preferred that an iodide salt be added in an amount of at least $8.2\times10^{-5}$ mol/m$^2$.

Preferred process for forming the internal high silver iodide phase comprises adding an aqueous solution of a silver salt simultaneously with the addition of an aqueous solution of halide salts containing an iodide salt.

For example, an aqueous solution of $AgNO_3$ is added simultaneously with the addition of an aqueous solution of KI by the double jet. The addition initiating times and addition completing times of the aqueous solution of KI and the aqueous solution of $AgNO_3$ may be differed from each other, that is, the one may be earlier or later than the other. The addition molar ratio of an aqueous solution of $AgNO_3$ to an aqueous solution of KI is preferably at least 0.1, more preferably at least 0.5, and most preferably at least 1. The total addition molar amount of an aqueous solution of $AgNO_3$ relative to halide ions within the system and added iodide ions may fall in a silver excess region. It is preferred that the pAg exhibited when the aqueous solution of halide containing such iodide ions and the aqueous solution of silver salt are added by the double jet be decreased in accordance with the passage of double jet addition time. The pAg prior to the addition initiation is preferably in the range of 6.5 to 13, more preferably 7.0 to 11. The pAg at the time of addition completion is most preferably in the range of 6.5 to 10.0.

In the performing of the above process, it is preferred that the solubility in the mixture system be as low as possible. Accordingly, the temperature of the mixture system exhibited at the time of formation of the high silver iodide phase is preferably in the range of 30 to 80° C., more preferably 30 to 70° C.

Furthermore, the formation of the internal high silver iodide phase can preferably be performed by adding fine grains of silver iodide, fine grains of silver iodobromide, fine grains of silver chloroiodide or fine grains of silver chloroiodobromide. It is especially preferred that the formation be effected by adding fine grains of silver iodide. Although these fine grains generally have a size of 0.01 to 0.1 μm, use can also be made of fine grains with a size of not greater than 0.01 μm, or 0.1 μm or more. With respect to the process for preparing these fine grains of silver halide, reference can be made to descriptions of JP-A's-1-183417, 2-44335, 1-183644, 1-183645, 2-43534 and 2-43535. The internal high silver iodide phase can be provided by adding these fine grains of silver halide and conducting a ripening. When the fine grains are dissolved by ripening, use can be made of the aforementioned silver halide solvent. It is not needed that all these added fine grains be immediately dissolved and disappear. It is satisfactory if, when the final grains have been completed, they are dissolved and disappear.

The position of the internal high silver iodide phase, as measured from the center of, for example, a hexagon resulting from grain projection, is preferably present in the range of 5 to less than 100 mol %, more preferably 20 to less than 95 mol %, and most preferably 50 to less than 90 mol %, based on the amount of silver of the whole grain. The amount of silver halide forming this internal high silver iodide phase, in terms of the amount of silver, is 50 mol % or less, preferably 20 mol % or less, based on the amount of silver of the whole grain. With respect to the above high silver iodide phase, there are provided recipe values of the production of silver halide emulsion, not values obtained by measuring the halogen composition of final grains according to various analytical methods. The internal high silver iodide phase is often caused to completely disappear in final grains by, for example, recrystallization during the shell covering step, and all the above silver amounts relate to recipe values thereof.

Therefore, although the observation of dislocation lines can be easily performed in the final grains by the above method, the internal silver iodide phase introduced for the introduction of dislocation lines often cannot be confirmed as a clear phase because the boundary silver iodide composition is continuously changed. The halogen composition at each grain part can be determined by a combination of X-ray diffractometry, the EPMA method (also known as the XMA method, in which silver halide grains are scanned by electron beams to thereby detect the silver halide composition), the ESCA method (also known as the XPS method, in which X rays are irradiated and photoelectrons emitted from grain surface are separated into spectra), etc.

The outside phase which covers the internal high silver iodide phase has a silver iodide content lower than that of the internal high silver iodide phase. The silver iodide content of the covering outside phase is preferably in the range of 0 to 30 mol %, more preferably 0 to 20 mol %, and most preferably 0 to 10 mol %, based on the silver halide contained in the covering outside phase.

Although the temperature and pAg employed at the formation of the outside phase which covers the internal high silver iodide phase are arbitrary, the temperature preferably ranges from 30 to 80° C., most preferably from 35 to 70° C., and the pAg preferably ranges from 6.5 to 11.5. The use of the aforementioned silver halide solvent is occasionally preferred, and the most preferred silver halide solvent is a thiocyanate salt.

Another method of introducing dislocation lines in the tabular grains comprises using an iodide ion-releasing agent as described in JP-A-6-11782, which can preferably be employed.

Also, dislocation lines can be introduced by appropriately combining this method of introducing dislocation lines with the aforementioned method of introducing dislocation lines.

The variation coefficient of the intergranular iodine distribution of silver halide grains for use in the present invention is preferably 20% or less, more preferably 15% or less, and much more preferably 10% or less. When the variation coefficient of the iodine content distribution of each silver halide is greater than 20%, unfavorably, a high contrast is not realized and a sensitivity lowering is intense when a pressure is applied.

Any known processes such as the process of adding fine grains as described, for example, in JP-A-1-183417 and the process of using an iodide ion-releasing agent as described in JP-A-2-68538 can be employed either individually or in combination for the production of silver halide grains whose intergranular iodine distribution is narrow for use in the present invention.

The silver halide grains for use in the present invention preferably have a variation coefficient of intergranular iodine distribution of 20% or less. The process described in JP-A-3-213845 can be used as the most suitable process for converting the intergranular iodine distribution to a monodispersion. That is, a monodisperse intergranular iodine distribution can be accomplished by a process in which fine silver halide grains containing silver iodide in an amount of at least 95 mol % are formed by mixing together an aqueous solution of a water soluble silver salt and an aqueous solution of a water soluble halide (containing at least 95 mol % of iodide ions) by means of a mixer provided outside a reactor vessel for crystal growth and, immediately after the formation, fed in the reactor vessel. The terminology "reactor vessel" used herein means the vessel in which the nucleation and/or crystal growth of tabular silver halide grains is carried out.

With respect to the above process of mixer preparation followed by adding procedure and the preparatory means for use therein, the following three techniques can be employed as described in JP-A-3-213845:

(1) immediately after formation of fine grains in a mixer, the fine grains are transferred into a reactor vessel;

(2) powerful and effective agitation is carried out in the mixer; and (3) an aqueous solution of protective colloid is injected into the mixer.

The protective colloid used in technique (3) above may be separately injected in the mixer, or may be incorporated in the aqueous solution of silver halide or the aqueous solution of silver nitrate before the injection in the mixer. The concentration of protective colloid is at least 1% by weight, preferably in the range of 2 to 5% by weight. Examples of polymeric compounds exhibiting a protective colloid function to the silver halide grains for use in the present invention include polyacrylamide polymers, amino polymers, polymers having thioether groups, polyvinyl alcohol, acrylic polymers, hydroxyquinoline having polymers, cellulose, starch, acetal, polyvinylpyrrolidone and ternary polymers.

Low-molecular-weight gelatin can preferably be used as the above polymeric compound. The molecular weight of low-molecular-weight gelatin is preferably 30,000 or less, more preferably 10,000 or less.

The grain formation temperature in the preparation of fine silver halide grains is preferably 35° C. or below, more preferably 25° C. or below. The temperature of the reactor vessel in which fine silver halide grains are incorporated is at least 50° C., preferably at least 60° C., and more preferably at least 70° C.

The grain size of fine-size silver halide for use in the present invention can be determined by placing grains on a mesh and making a direct observation through a transmission electron microscope. The size of fine grains of the present invention is 0.3 μm or less, preferably 0.1 μm or less, and more preferably 0.01 μm or less. This fine silver halide may be added simultaneously with the addition of other halide ions and silver ions, or may be separately added. The fine silver halide grains are mixed in an amount of 0.005 to 20 mol %, preferably 0.01 to 10 mol %, based on the total silver halide.

The silver iodide content of each individual grain can be measured by analyzing the composition of each individual grain by means of an X-ray microanalyzer. The terminology "variation coefficient of intergranular iodine distribution" means a value defined by the formula:

variation coefficient=(standard deviation/av. silver iodide content)×100 wherein the standard deviation, specifically the standard deviation of silver iodide content, and the average silver iodide content are obtained by measuring the silver iodide contents of at least 100, preferably at least 200, and more preferably at least 300 emulsion grains. The measuring of the silver iodide content of each individual grain is described in, for example, EP No. 147,868. There are cases in which a correlation exists between the silver iodide content Yi (mol %) of each individual grain and the equivalent spherical diameter Xi (μm) of each individual grain and cases in which no such correlation exists. It is preferred that no correlation exist therebetween. The structure associated with the silver halide composition of grains of the present invention can be identified by, for example, a combination of X-ray diffractometry, the EPMA method (also known as the XMA method, in which silver halide grains are scanned by electron beams to thereby detect the silver halide composition) and the ESCA method (also known as the XPS method, in which X rays are irradiated and photoelectrons emitted from grain surface are separated into spectra). In the measuring of silver iodide content in the present invention, the terminology "grain surface" refers to the region whose depth from surface is about 5 nm, and the terminology "grain internal part" refers to the region other than the above surface. The halogen composition of such a grain surface can generally be measured by the ESCA method.

In the present invention, use can be made of not only the above tabular grains but also regular crystal grains such as cubic, octahedral and tetradecahedral grains and, further, irregular twinned crystal grains.

Selenium sensitization or gold sensitization is preferably performed on the silver halide emulsion of the present invention.

Selenium compounds disclosed in hitherto published patents can be used as the selenium sensitizer in the present invention. In the use of labile selenium compound and/or nonlabile selenium compound, generally, it is added to an emulsion and the emulsion is agitated at high temperature, preferably 40° C. or above, for a given period of time. Compounds described in, for example, Jpn. Pat. Appln. KOKOKU Publication No. (hereinafter referred to as JP-B-) 44-15748, JP-B-43-13489, JP-A's-4-25832 and 4-109240 are preferably used as the labile selenium compound.

Specific examples of the labile selenium sensitizers include isoselenocyanates (for example, aliphatic isoselenocyanates such as allyl isoselenocyanate), selenoureas, selenoketones, selenoamides, selenocarboxylic acids (for example, 2-selenopropionic acid and 2-selenobutyric acid), selenoesters, diacyl selenides (for example, bis(3-chloro-2, 6-dimethoxybenzoyl) selenide), selenophosphates, phosphine selenides and colloidal metal selenium.

The labile selenium compounds, although preferred types thereof are as mentioned above, are not limited thereto. It is generally understood by persons of ordinary skill in the art to which the invention pertains that the structure of the labile selenium compound as a photographic emulsion sensitizer is not so important as long as the selenium is labile and that the labile selenium compound plays no other role than having its selenium carried by organic portions of selenium sensitizer molecules and causing it to present in labile form in the emulsion. In the present invention, the labile selenium compounds of this broad concept can be used advantageously.

Compounds described in JP-B's-46-4553, 52-34492 and 52-34491 can be used as the nonlabile selenium compound in the present invention. Examples of the nonlabile selenium compounds include selenious acid, potassium selenocyanate, selenazoles, quaternary selenazole salts, diaryl selenides, diaryl diselenides, dialkyl selenides, dialkyl diselenides, 2-selenazolidinedione, 2-selenoxazolidinethione and derivatives thereof.

These selenium sensitizers are dissolved in water or an organic solvent such as methanol and ethanol or a mixed solvent of these, and added at the time of chemical sensitization. Preferably, the addition is performed prior to the initiation of chemical sensitization. The above selenium sensitizers can be used either individually or in combination. The joint use of an labile selenium compound and a nonlabile selenium compound is preferred.

The addition amount of selenium sensitizer for use in the present invention, although varied depending on the activity of employed selenium sensitizer, the type and size of silver halide, the ripening temperature and time, etc., is preferably in the range of $2\times10^{-6}$ to $5\times10^{-6}$ mol per mol of silver halide. The temperature of chemical sensitization in the use of a selenium sensitizer is preferably between 40° C. and 80° C. The pAg and pH are arbitrary. For example, with respect to pH, the effect of the present invention can be exerted even if it widely ranges from 4 to 9.

Selenium sensitization is effectively attained in the presence of a silver halide solvent.

Examples of the silver halide solvent usable in the present invention are (a) organic thioethers described in, e.g., U.S. Pat. Nos. 3,271,157, 3,531,289, and 3,574,628, and JP-A's-54-1019 and 54-158917, (b) thiourea derivatives described in, e.g., JP-A's-53-82408, 55-77737, and 55-2982, (c) a silver halide solvent having a thiocarbonyl group sandwiched between an oxygen or sulfur atom and a nitrogen atom described in JP-A-53-144319, (d) imidazoles described in JP-A-54-100717, (e) ammonia, and (f) thiocyanate.

Particularly preferable solvents are thiocyanate, ammonia, and tetramethylthiourea. Although the amount of a solvent used changes in accordance with the type of the solvent, a preferable amount of, e.g., thiocyanate is $1\times10^{-4}$ to $1\times10^{-2}$ mol per mol of a silver halide.

The oxidation number of gold of the gold sensitizer mentioned above may be either +1 or +3, and gold compounds customarily used as gold sensitizers can be employed. Representative examples thereof include chloroauric acid salts, potassium chloroaurate, auric trichloride, potassium auric thiocyanate, potassium iodoaurate, tetracyanoauric acid, ammonium aurothiocyanate, pyridyltrichlorogold, gold sulfide and gold selenide. The addition amount of gold sensitizer, although varied depending on various conditions, is preferably between $1\times10^{-7}$ mol and $5\times10^{-5}$ mol per mol of silver halide as a yardstick.

With respect to the emulsion for use in the present invention, it is desired to perform sulfur sensitization in combination for the chemical sensitization.

The sulfur sensitization is generally performed by adding a sulfur sensitizer and agitating the emulsion at high temperature, preferably 40° C. or above, for a given period of time.

In the above sulfur sensitization, those known as sulfur sensitizers can be used. For example, use can be made of thiosulfates, allylthiocarbamidothiourea, allyl isothiacyanate, cystine, p-toluenethiosulfonates and rhodanine. Use can also be made of other sulfur sensitizers described in, for example, U.S. Pat. Nos. 1,574,944, 2,410,689, 2,278,947, 2,728,668, 3,501,313 and 3,656,955, West German Patent No. 1,422,869, JP-B-56-24937 and JP-A-55-45016. The addition amount of sulfur sensitizer is satisfactory if it is sufficient to effectively increase the sensitivity of the emulsion. This amount, although varied to a large extent under various conditions such as the pH, temperature and size of silver halide grains, is preferably in the range of $1\times10^{-7}$ to $5\times10^{-5}$ mol per mol of silver halide.

The silver halide emulsion for use in the present invention can be subjected to a reduction sensitization during the grain formation, or after the grain formation but before the chemical sensitization, during the chemical sensitization or after the chemical sensitization.

The reduction sensitization can be performed by a method selected from among the method in which a reduction sensitizer is added to the silver halide emulsion, the method commonly known as silver ripening in which growth or ripening is carried out in an environment of pAg as low as 1 to 7 and the method commonly known as high-pH ripening in which growth or ripening is carried out in an environment of pH as high as 8 to 11. At least two of these methods can be used in combination.

The above method in which a reduction sensitizer is added is preferred from the viewpoint that the level of reduction sensitization can be finely regulated.

Examples of known reduction sensitizers include stannous salts, ascorbic acid and derivatives thereof, amines and polyamino acids, hydrazine derivatives, formamidinesulfinic acid, silane compounds and borane compounds. In the reduction sensitization employed in the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide.

Each reduction sensitizer is dissolved in water or any of organic solvents such as alcohols, glycols, ketones, esters and amides and added during the grain growth. Although the reduction sensitizer may be put in a reaction vessel in advance, it is preferred that the addition be effected at an appropriate time during the grain growth. It is also suitable to add in advance the reduction sensitizer to an aqueous solution of a water-soluble silver salt or a water-soluble alkali halide and to precipitate silver halide grains with the use of the resultant aqueous solution. Alternatively, the reduction sensitizer solution may preferably be either divided and added a plurality of times in accordance with the grain growth or continuously added over a prolonged period of time.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones.

The use of the silver oxidizer in combination with the above reduction sensitization is preferred. This combined use can be effected by performing the reduction sensitization after the use of the oxidizer or vice versa or by simultaneously performing the reduction sensitization and the use of the oxidizer. These methods can be performed during the step of grain formation or the step of chemical sensitization.

The photographic emulsion of the present invention can exhibit excellent color saturation by spectrally sensitizing preferably by methine dyes and other dyes. The dyes to be used include a cyanine dye, merocyanine dye, complex cyanine dye, complex merocyanine dye, holopolar cyanine dyes, hemicyanine dye, styryl dye, and hemioxonol dye. Especially useful dyes are those that belong to a cyanine dye, merocyanine dye, and complex merocyanine dye. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have a carbon atom being substituted.

In the merocyanine dyes and composite merocyanine dyes, any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, GB's 1,344,281 and 1,507,803, JP-B-43-4936 and 53-12375 and JP-A-52-110618 and 52-109925. The emulsion used in the present invention may contain a dye which itself exerts no spectral sensitizing effect or a substance which absorbs substantially none of visible radiation and exhibits supersensitization, together with the above spectral sensitizing dye.

Further, it is preferable to use a technique of improving light absorption ratio with a spectral sensitizing dye in combination with the present invention. For example, there can be mentioned a method in which a dye is adsorbed on the surface of silver halide grain in an amount of more than a single layer saturated adsorption (i.e., one layer adsorption) by using intermolecular force, or a method in which a compound consisting of a plurality of dye chromophores, so to called a linked dye, is adsorbed on a silver halide grain. Among these, the techniques described in the following patent applications are preferably used in combination with the present invention.

The publications and specifications of JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173, and 2001-356442, and EP's 0985965A, 0985964A, 0985966A, 0985967A, 1085372A, 1085373A, 1172688A, 1199595A and 887700A1.

Further, it is preferable to use the techniques described in the publications of JP-A's-10-239789, 2001-75222 and 10-171058 in combination.

The addition timing of the spectral sensitizing dye to the emulsion may be performed at any stage of the process for preparing the emulsion which is known as being useful. Although the doping is most usually conducted at a stage between the completion of the chemical sensitization and the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization and, also, the spectral sensitizing dye can be added prior to the completion of silver halide grain precipitation to thereby initiate the spectral sensitization as described in JP-A-58-113928. Further, the above sensitizing dye can be divided prior to addition, that is, part of the sensitizing dye can be added prior to the chemical sensitization with the rest of the sensitizing dye added after the chemical sensitization as taught in U.S. Pat. No. 4,225,666. Still further, the spectral sensitizing dye can be added at any stage during the formation of silver halide grains according to the method disclosed in U.S. Pat. No. 4,183,756 and other methods.

When a plurality of sensitizing dyes are added a suitable method may be selected depending on the selected type of the sensitizing dye and desired spectral sensitivity, for example, from a method of adding each one separately with intervals, a method of adding them as a mixture, a method of adding one kind of sensitizing dye from a group of sensitizing dyes precedentially and adding the remaining dyes as a mixture with other sensitizing dyes.

The addition amount of the sensitizing dye may be from $4\times10^{-6}$ to $8\times10^{-3}$ mol per mol of silver halide. For preferable silver halide grains having a size of 0.2 to 1.2 μm, about $5\times10^{-5}$ to $2\times10^{-3}$ mol per mol of silver is preferable.

Silver halide grains of the present invention has a twin plane distance of preferably 0.017 μm or less. More preferably, the twin plane distance is 0.007 to 0.017 μm, and especially preferably 0.007 to 0.015 μm.

The fogging during aging of the silver halide emulsion for use in the present invention can be improved by adding and dissolving a previously prepared silver iodobromide emulsion at the time of chemical sensitization. Although the timing of the addition is arbitrary as long as it is performed during chemical sensitization, it is preferred that the silver iodobromide emulsion be first added and dissolved and, thereafter, a sensitizing dye and a chemical sensitizer be added in this order. The employed silver iodobromide emulsion has an iodine content lower than the surface iodine content of host grains, which is preferably a pure silver bromide emulsion. This silver iodobromide emulsion, although the size thereof is not limited as long as it is completely dissolvable, preferably has an equivalent spherical diameter of 0.1 μm or less, more preferably 0.05 μm or less. Although the addition amount of silver iodobromide emulsion depends on employed host grains, basically, it preferably ranges from 0.005 to 5 mol %, more preferably from 0.1 to 1 mol %, based on the mole of silver.

The emulsion used in the present invention may use a conventional dopant that is known to be useful for a silver halide emulsion. Examples of the conventional dopant are Fe, Co, Ni, Ru, Rh, Pd, Re, Os, Ir, Pt, Au, Hg, Pb, and Tl. In the present invention, hexacyano iron(II) complex, an hexacyano lutenium complexes (hereinafter simply referred to as "metal complex") are preferably used.

The addition amount of the metal complex is preferably $10^{-7}$ mol or more but $10^{-3}$ mol or less per mol of silver halide, and more preferably $1.0\times10^{-5}$ mol or more but $5\times10^{-4}$ mol per mol of silver halide.

The metal complex used in the present invention may be added at any stage of the preparation of silver halide grains, such as during nucleation, growth, physical ripening, and before and after chemical sensitization. The metal complex may also be added in several times in a separate matter. However, 50% or more of the metal complex contained in a silver halide grain are preferably contained within the layer of 1/2, in terms of silver amount, from the outermost surface of the silver halide grain. A layer containing no metal complex may be provided at outer position from a support than a layer containing a metal complex mentioned above.

It is preferable for these metal complexes to dissolve into water or a suitable solvent, and add directly to a reaction solution during the formation of silver halide grains, or to add into an aqueous solution of halide or aqueous solution of silver salt for forming silver halide grains, or to add into a solution other than these, and then use the solutions to grain formation, thereby incorporating the metal complex into the silver halide grains. Further, it is also preferable to add and dissolve silver halide fine grains to which a metal complex is previously contained, and deposit them on other silver halide grains, thereby incorporation the metal complex into the silver halide grains.

The hydrogen ion concentration in the reaction solution at the addition of these metal complexes is preferably pH of 1 to 10, and more preferably pH of 3 to 7.

The silver halide color photosensitive material of the present invention may have at least one each of a red-sensitive silver halide emulsion layer, a green-sensitive silver halide emulsion layer, a blue-sensitive emulsion layer and a non-light-sensitive layer on a support. When each of the emulsion layers is composed of two or more sub-layers having substantially the same color sensitivity but different in speed, it is preferable that a highest-speed emulsion layer of one of the color-sensitive layers does not substantially contain a DIR compound capable of releasing a development inhibitor and/or a precursor of a development inhibitor.

With respect to a multi-layered silver halide color photosensitive material, the arrangement of unit light-sensitive layers is generally, from the side nearer to a support, a red-sensitive layer unit, a green-sensitive layer unit, and blue-sensitive layer unit. However, the order of the arrangement may be reversed or an arrangement order in which color-sensitive layers having the same color sensitivity sandwich a light-sensitive layer of different color sensitivity, depending on purposes. A none-light-sensitive layer may be provided as an upper most layer, or lower most layer, and between the silver halide light-sensitive layers. These layers may contain a coupler, DIR compound, color-mixing inhibitor and etc, to be described later. In the plurality of silver halide emulsion layers constituting each unit light-sensitive layer, it is preferred that two layers consisting of a high-speed emulsion layer and a low-speed emulsion layer be arranged so that the speed is sequentially decreased toward a support as described in DE 1,121,470 or GB 923,045. Also, as described in JP-A's-57-112751, 62-200350, 62-206541 and 62-206543, layers can be arranged so that a low-speed emulsion layer is formed on a side remote from a support while a high-speed emulsion layer is formed on a side close to the support.

Specifically, layers can be arranged, from the farthest side from a support, in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), or the order of BH/BL/GL/GH/RH/RL, or the order of BH/BL/GH/GL/RL/RH. or the like.

In addition, as described in JP-B-55-34932, layers can be arranged, from the farthest side from a support, in the order of blue-sensitive layer/GH/RH/GL/RL. Furthermore, as described in JP-A's-56-25738 and 62-63936, layers can be arranged, from the farthest side from a support, in the order of blue-sensitive layer/GL/RL/GH/RH.

As described in JP-B-49-15495, three layers can be arranged so that a silver halide emulsion layer having the highest speed is arranged as an upper layer, a silver halide emulsion layer having a speed lower than that of the upper layer is arranged as an inter layer, and a silver halide emulsion layer having a speed lower than that of the inter layer is arranged as a lower layer; i.e., three layers having different sensitivities can be arranged so that the speed is sequentially decreased toward the support. Even when a layer structure is constituted by three layers having different sensitivities as mentioned above, these layers can be arranged in the order of medium-speed emulsion layer/high-speed emulsion layer/low-speed emulsion layer from the farthest side from a support in layers of the same color sensitivity as described in JP-A-59-202464.

In addition, the layer arrangement can be made in the order of high-speed emulsion layer/low-speed emulsion layer/medium-speed emulsion layer, or in the order of low-speed emulsion layer/medium-speed emulsion layer/high-speed emulsion layer.

Furthermore, the layer arrangement can be changed as mentioned above even when four or more layers are formed.

It is preferable to utilize an inter layer inhibitory effect as means for improving a color reproduction.

It is also preferred to provide by coating a donor layer of the inter layer inhibitory effect to a red-sensitive layer. That is, it is preferred that λG of a green-sensitive silver halide emulsion layer, which is weight-average sensitivity wavelength of spectral sensitivity distribution of a green-sensitive silver halide emulsion layer, meets 520 nm$<\lambda_G<$580 nm and $\lambda_{-R}$, which is weight-average wavelength of spectral sensitivity distribution of an inter layer effect to a red-sensitive silver halide emulsion layer from other layers in a rage of 500 nm to 600 nm, meets 500 nm$<\lambda_{-R}<$560 nm, and $\lambda G-\lambda_{-R}$ is 5 nm or more, preferably 10 nm or more.

$$\lambda_G = \frac{\int_{500}^{600} \lambda S_G(\lambda)\, d\lambda}{\int_{500}^{600} S_G(\lambda)\, d\lambda}$$

In the formula, $S_G(\lambda)$ signifies spectral sensitivity distribution curve of a green-sensitive silver halide emulsion layer. $S_R$ at a specific wavelength λ is represented by an inverse number of an exposure amount that gives magenta density of fog+0.5 when the exposure was given at the specific wavelength.

In order to provide an inter layer effect to a red-sensitive layer at a specific wavelength range described above, it is preferable to separately provide an inter layer effect-donating layer containing silver halide grains that are spectrally sensitized with a given sensitivity. In order to realize the spectral sensitivity of the present invention, the weight-average sensitivity wavelength of the inter layer effect-donating layer is preferably set from 510 nm to 540 nm.

Herein, the weight-average wavelength $\lambda_{-R}$ of distribution of wavelength of the inter layer effect to a red-sensitive layer from other silver halide emulsion layers, may be determined by a method described in JP-B-3-10287.

In the present invention, the weight-average wavelength $\lambda_R$ of a red-sensitive layer is preferably 630 nm or less. Herein, the weight-average wavelength $\lambda_R$ of a red-sensitive layer is defined by the following formula (I):

$$\lambda_R = \frac{\int_{550}^{700} \lambda S_R(\lambda)\, d\lambda}{\int_{550}^{700} S_R(\lambda)\, d\lambda} \quad \text{(I)}$$

In the formula, Sr(λ) signifies spectral sensitivity distribution curve of a red-sensitive silver halide emulsion layer, and $S_R$ at a specific wavelength λ is represented by an inverse number of an exposure amount that gives cyan density of fog +0.5 when the exposure was given with the specific wavelength.

As a material for providing the inter layer effect, a compound that releases a development inhibitor or a precursor thereof through a reaction with an oxidized product of a developing agent obtained by development. For example, DIR (development inhibitor-releasing type) couplers, DIR-hydroquinones, couplers that release DIR-hydroquinone or precursor thereof may be used. When the development inhibitor has a high diffusibility, the development inhibiting effect may be attained wherever the donating layer is provided among a laminated multi-layer structure. However, a development inhibiting effect toward an unintended direction also arises. In order to compensate this, the donor layer is preferably a color-forming layer (e.g., a layer that forms the same color as the layer that suffers an undesired effect of the development inhibitor). In order to attain desired spectral sensitivity of the photosensitive material of the present invention, the inter layer effect-donating layer preferably forms magenta color.

The silver halide grains used in the inter layer effect-donating layer to red-sensitive layer are not particularly limited regarding, for example, the size thereof, and a shape, but so called tabular grains of a high aspect ratio or a monodisperse emulsion having a uniform grain size or silver iodobromide grains having a layer structure of iodide, are preferably used. Also, in order to enlarge exposure latitude, it is preferable to mix two or more kinds of emulsions having different grain sizes.

Although an inter layer effect-donating layer to a red-sensitive layer may be provided by coating on any position on a support, it is preferred that the interlayer-donating layer be provided by coating at a position which is closer to the support than the blue-sensitive layer and which is more remote from the support than the red-sensitive layer. It is further preferred that the interlayer-donating layer be positioned closer to the support than the yellow filter layer.

It is more preferred that the interlayer effect-donating layer to a red-sensitive layer be provided at a position which is closer to the support than the green-sensitive layer and which is more remote from the support than the red-sensitive layer. The interlayer-donating layer is most preferably arranged at a position adjacent to a side of the green-sensitive layer close to the support. The terminology "adjacent" used herein means that an inter layer or the like is not interposed therebetween.

There may be a plurality of interlayer effect-donating layers to a red-sensitive layer. These layers may be positioned so that they are adjacent to each other or are apart from each other.

In the present invention, use can be made of solid disperse dyes described in JP-A-11-305396.

The emulsions for use in the photosensitive material of the present invention may be any of the surface latent image type in which latent images are mainly formed in the surface, the internal latent image type in which latent images are formed in the internal portion of grains and the type in which latent images exist in both the surface and the internal portion of grains. However, it is requisite that the emulsion be a negative type. The emulsion of the internal latent image type may specifically be, for example, a core/shell internal-latent-image type emulsion described in JP-A-63-264740, whose preparation method is described in JP-A-59-133542. The thickness of the shell of this emulsion, although varied depending on development processing, etc., is preferably in the range of 3 to 40 nm, more preferably 5 to 20 nm.

The silver halide emulsions are generally subjected to physical ripening, chemical sensitization and spectral sensitization before use. Additives employed in these steps are described in RD Nos. 17643, 18716 and 307105. Positions where the description is made are listed in the following table.

In the photosensitive material of the present invention, two or more emulsions which are different from each other in at least one of the characteristics, specifically the grain size, grain size distribution, halogen composition, grain configuration and speed of light-sensitive silver halide emulsion, can be mixed together and used in the same layer.

It is preferred that silver halide grains having a grain surface fogged as described in U.S. Pat. No. 4,082,553 and silver halide grains or colloidal silver having a grain internal portion fogged as described in U.S. Pat. No. 4,626,498 and JP-A-59-214852 be used in light-sensitive silver halide emulsion layers and/or substantially non-light-sensitive hydrophilic colloid layers. The expression "silver halide grains having a grain surface or grain internal portion fogged" refers to silver halide grains which can be developed uniformly (nonimagewise) irrespective of the nonexposed or exposed zone of photosensitive material. The process for producing them is described in U.S. Pat. No. 4,626,498 and JP-A-59-214852. The silver halides constituting internal nuclei of core/shell silver halide grains having a grain internal portion fogged may have different halogen composition. Any of silver chloride, silver chlorobromide, silver iodobromide and silver chloroiodobromide can be used as the silver halide having a grain surface or grain internal portion fogged. The average grain size of these fogged silver halide grains is preferably in the range of 0.01 to 0.75 μm, more preferably 0.05 to 0.6 μm. With respect to the grain configuration, although both regular grains and a polydisperse emulsion can be used, monodispersity (at least 95% of the weight or number of silver halide grains have grain diameters falling within ±40% of the average grain diameter) is preferred.

In the present invention, it is preferred to use non-light-sensitive fine-grain silver halides. The expression "non-light-sensitive fine-grain silver halides" refers to silver halide fine grains which are not sensitive to light at the time of imagewise exposure for obtaining dye images and which are substantially not developed at the time of development processing thereof. Those not having been fogged in advance are preferred. The fine-grain silver halides have a silver bromide content of 0 to 100 mol %, and, if necessary, may contain silver chloride and/or silver iodide. Preferably, silver iodide is contained in an amount of 0.5 to 10 mol %. The average grain diameter (average of equivalent circular diameters of projected areas) of fine-grain silver halides is preferably in the range of 0.01 to 0.5 μm, more preferably 0.02 to 0.2 μm.

The fine-grain silver halides can be prepared by the same process as used in the preparation of common light-sensitive silver halides. It is not needed to optically sensitize the surface of silver halide grains. Further, any spectral sensitization thereof is also not needed. However, it is preferred to add known stabilizers, such as triazole-type, azaindene-type, benzothiazolium-type and mercapto-type compounds or zinc compounds, thereto prior to the addition of fine-grain silver halides to a coating liquid. Colloidal silver can be incorporated in layers containing fine-grain silver halides.

Various additives mentioned above are used in the photosensitive material regarding the technique of the invention, and other various additives may be used depending on purposes.

The additives are described in detail in Research Disclosure Item 17643 (December 1978), Item 18716 (November 1979) and Item 308119 (December 1989). A summary of the locations where they are described will be listed in the following table.

| | Types of additives | RD17643 | RD18716 | RD308119 |
|---|---|---|---|---|
| 1 | Chemical sensitizing dyes | page 23 | page 648 right column | page 996 |
| 2 | Sensitivity-increasing agents | | page 648 right column | |
| 3 | Spectral sensitizing dye, super-sensitizers | pages 23–24 | page 648, right column to page 649, right column | page 996, right column to page 998, right column |
| 4 | Brighteners | page 24 | | page 998 right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column page 1005, left column |
| 10 | Binders | page 26 | page 651, left column | page 1003, right column to page 1004, right column |
| 11 | Plasticizers, lubricants | page 27 | page 650, right column | page 1006, left to right columns |
| 12 | Coating aids, surfactants | pages 26–27 | page 650, right column | page 1005, left column to page 1006, left column |
| 13 | Antistatic agents | page 27 | page 650, right column | page 1006, right column to page 1007, left column |
| 14 | Matting agents | | | page 1008, left column to page 1009, left column |

With respect to the photosensitive material of the present invention and the emulsion suitable for use in the photosensitive material and also with respect to layer arrangement and related techniques, silver halide emulsions, dye forming couplers, DIR couplers and other functional couplers, various additives and development processing which can be used in the photographic photosensitive material, reference can be made to EP 0565096A1 (published on Oct. 13, 1993) and patents cited therein. Individual particulars and the locations where they are described will be listed below.

1. Layer arrangement: page 61 lines 23 to 35, page 61 line 41 to page 62 line 14,
2. Interlayers: page 61 lines 36 to 40,
3. Interlayer effect-donating layers: page 62 lines 15 to 18,
4. Silver halide halogen compositions: page 62 lines 21 to 25,
5. Silver halide grain crystal habits: page 62 lines 26 to 30,
6. Silver halide grain sizes: page 62 lines 31 to 34,
7. Emulsion preparation methods: page 62 lines 35 to 40,
8. Silver halide grain size distributions: page 62 lines 41 to 42,
9. Tabular grains: page 62 lines 43 to 46,
10. Internal structures of grains: page 62 lines 47 to 53,
11. Latent image forming types of emulsions: page 62 line 54 to page 63 to line 5,
12. Physical ripening and chemical sensitization of emulsion: page 63 lines 6 to 9,
13. Emulsion mixing: page 63 lines 10 to 13,
14. Fogged emulsions: page 63 lines 14 to 31,
15. Non light-sensitive emulsions: page 63 lines 32 to 43,
16. Silver coating amounts: page 63 lines 49 to 50,
17. Formaldehyde scavengers: page 64 lines 54 to 57,
18. Mercapto antifoggants: page 65 lines 1 to 2,
19. Fogging agent, etc. releasing agents: page 65 lines 3 to 7,
20. Dyes: page 65, lines 7 to 10,
21. Color coupler summary: page 65 lines 11 to 13,
22. Yellow, magenta and cyan couplers: page 65 lines 14 to 25,
23. Polymer couplers: page 65 lines 26 to 28,
24. Diffusive dye forming couplers: page 65 lines 29 to 31,
25. Colored couplers: page 65 lines 32 to 38,
26. Functional coupler summary: page 65 lines 39 to 44,
27. Bleaching accelerator-releasing couplers: page 65 lines 45 to 48,
28. Development accelerator-releasing couplers: page 65 lines 49 to 53,
29. Other DIR couplers: page 65 line 54 to page 66 to line 4,
30. Method of dispersing couplers: page 66 lines 5 to 28,
31. Antiseptic and mildewproofing agents: page 66 lines 29 to 33,
32. Types of photosensitive materials: page 66 lines 34 to 36,
33. Thickness of light-sensitive layer and swelling speed: page 66 line 40 to page 67 line 1,
34. Back layers: page 67 lines 3 to 8,
35. Development processing summary: page 67 lines 9 to 11, 36. Developing solutions and developing agents: page 67 lines 12 to 30,
37. Developing solution additives: page 67 lines 31 to 44,
38. Reversal processing: page 67 lines 45 to 56,
39. Processing solution open ratio: page 67 line 57 to page 68 line 12,
40. Development time: page 68 lines 13 to 15,
41. Bleach-fix, bleaching and fixing: page 68 line 16 to page 69 line 31,
42. Automatic processor: page 69 lines 32 to 40,
43. Washing, rinse and stabilization: page 69 line 41 to page 70 line 18,
44. Processing solution replenishment and reuse: page 70 lines 19 to 23,
45. Developing agent built-in sensitive material: page 70 lines 24 to 33,
46. Development processing temperature: page 70 lines 34 to 38, and
47. Application to film with lens: page 70 lines 39 to 41.

Moreover, preferred use can be made of a bleaching solution containing 2-pyridinecarboxylic acid or 2,6-pyridinedicarboxylic acid, a ferric salt such as ferric nitrate and a persulfate as described in EP 602,600. When this bleaching solution is used, it is preferred that the steps of stop and water washing be conducted between the steps of color development and bleaching. An organic acid such as acetic acid, succinic acid or maleic acid is preferably used as a stop solution. For pH adjustment and bleaching fog, it is preferred that the bleaching solution contains an organic acid such as acetic acid, succinic acid, maleic acid, glutaric acid or adipic acid in an amount of 0.1 to 2 mol/liter (hereinafter liter is referred to as "L", and milliliter is referred to as "mL".).

A magnetic recording layer usable in the present invention will be described below.

This magnetic recording layer is formed by coating the surface of a support with an aqueous or organic solvent-based coating solution which is prepared by dispersing magnetic grains in a binder.

As the magnetic grains, it is possible to use grains of, e.g., ferromagnetic iron oxide such as $\gamma Fe_2O_3$, Co-deposited $\gamma Fe_2O_3$, Co-deposited magnetite, Co-containing magnetite, ferromagnetic chromium dioxide, a ferromagnetic metal, ferromagnetic alloy, Ba ferrite of a hexagonal system, Sr ferrite, Pb ferrite, and Ca ferrite. Co-deposited ferromagnetic iron oxide such as Co-deposited $\gamma Fe_2O_3$ is preferable. The grain can take the shape of any of, e.g., a needle, rice grain, sphere, cube, and plate. The specific area is preferably 20 $m^2/g$ or more, and more preferably 30 $m^2/g$ or more as $S_{BET}$.

The saturation magnetization (as) of the ferromagnetic substance is preferably $3.0\times10^4$ to $3.0\times10^5$ A/m, and especially preferably $4.0\times10^4$ to $2.5\times10^5$ A/m. A surface treatment can be performed for the ferromagnetic grains by using silica and/or alumina or an organic material. Also, the surface of the ferromagnetic grain can be treated with a silane coupling agent or a titanium coupling agent as described in JP-A-6-161032. A ferromagnetic grain whose surface is coated with an inorganic or organic substance described in JP-A-4-259911 or 5-81652 can also be used.

As a binder used together with the magnetic grains, it is possible to use a thermoplastic resin described in JP-A-4-219569, thermosetting resin, radiation-curing resin, reactive resin, acidic, alkaline, or biodegradable polymer, natural polymer (e.g., a cellulose derivative and sugar derivative), and their mixtures. The Tg of the resin is −40° C. to 300° C., and its weight average molecular weight is 2,000 to 1,000,000. Examples are a vinyl-based copolymer, cellulose derivatives such as cellulosediacetate, cellulosetriacetate, celluloseacetatepropionate, celluloseacetatebutylate, and cellulosetripropionate, acrylic resin, and polyvinylacetal resin. Gelatin is also preferable. Cellulosedi(tri)acetate is particularly preferable. This binder can be hardened by the addition of an epoxy-, aziridine-, or isocyanate-based crosslinking agent. Examples of the isocyanate-based crosslinking agent are isocyanates such as tolylenediisocyanate, 4,4'-diphenylmethanediisocyanate, hexamethylenediisocyanate, and xylylenediisocyanate, reaction products of these isocyanates and polyalcohol (e.g., a reaction product of 3 mols of tolylenediisocyanate and 1 mol of trimethylolpropane), and polyisocyanate produced by condensation of any of these isocyanates. These examples are described in JP-A-6-59357.

As a method of dispersing the magnetic substance in the binder, as described in JP-A-6-35092, a kneader, pin type mill, and annular mill are preferably used singly or together. Dispersants described in JP-A-5-088283 and other known dispersants can be used. The thickness of the magnetic recording layer is 0.1 to 10 μm, preferably 0.2 to 5 μm, and more preferably 0.3 to 3 μm. The weight ratio of the magnetic grains to the binder is preferably 0.5:100 to 60:100, and more preferably 1:100 to 30:100. The coating amount of the magnetic grains is 0.005 to 3 $g/m^2$, preferably 0.01 to 2 $g/m^2$, and more preferably 0.02 to 0.5 $g/m^2$. The transmitting yellow density of the magnetic recording layer is preferably 0.01 to 0.50, more preferably 0.03 to 0.20, and especially preferably 0.04 to 0.15. The magnetic recording layer can be formed in the whole area of, or into the shape of stripes on, the back surface of a photographic support by coating or printing. As a method of coating the magnetic recording layer, it is possible to use any of an air doctor, blade, air knife, squeegee, impregnation, reverse roll, transfer roll, gravure, kiss, cast, spray, dip, bar, and extrusion. A coating solution described in JP-A-5-341436 is preferable.

The magnetic recording layer can be given a lubricating property improving function, curling adjusting function, antistatic function, adhesion preventing function, and head polishing function. Alternatively, another functional layer can be formed and these functions can be given to that layer. A polishing agent in which at least one type of grains are aspherical inorganic grains having a Mohs hardness of 5 or more is preferable. The composition of this aspherical inorganic grain is preferably an oxide such as aluminum oxide, chromium oxide, silicon dioxide, titanium dioxide, and silicon carbide, a carbide such as silicon carbide and titanium carbide, or a fine powder of diamond. The surfaces of the grains constituting these polishing agents can be treated with a silane coupling agent or titanium coupling agent. These grains can be added to the magnetic recording layer or overcoated (as, e.g., a protective layer or lubricant layer) on the magnetic recording layer. A binder used together with the grains can be any of those described above and is preferably the same binder as in the magnetic recording layer. Sensitive materials having the magnetic recording layer are described in U.S. Pat. Nos. 5,336,589, 5,250,404, 5,229,259, and 5,215,874, and EP 466,130.

A polyester support used in the present invention will be described below. Details of the polyester support and sensitive materials, processing, cartridges, and examples (to be described later) are described in Journal of Technical Disclosure No. 94-6023 (JIII; 1994, Mar. 15). Polyester used in the present invention is formed by using diol and aromatic dicarboxylic acid as essential components. Examples of the aromatic dicarboxylic acid are 2,6-, 1,5-, 1,4-, and 2,7-naphthalenedicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanolterephthalate. Polyester containing 50 to 100 mol % of 2,6-naphthalenedicarboxylic acid is particularly preferable. Polyethylene-2,6-naphthalate is especially preferable among other polymers. The weight-average molecular weight ranges between about 5,000 and 200,000. The Tg of the polyester of the present invention is 50° C. or higher, preferably 90° C. or higher.

To give the polyester support a resistance to curling, the polyester support is heat-treated at a temperature of 40° C. to less than Tg, more preferably Tg−20° C. to less than Tg. The heat treatment can be performed at a fixed temperature within this range or can be performed together with cooling. The heat treatment time is 0.1 to 1500 hrs, more preferably 0.5 to 200 hrs. The heat treatment can be performed for a roll-like support or while a support is conveyed in the form of a web. The surface shape can also be improved by roughening the surface (e.g., coating the surface with conductive inorganic fine grains such as $SnO_2$ or $Sb_2O_5$). It is desirable to knurl and slightly raise the end portion, thereby preventing the cut portion of the core from being photographed. These heat treatments can be performed in any stage after support film formation, after surface treatment, after back layer coating (e.g., an antistatic agent or lubricating agent), and after undercoating. A preferable timing is after the antistatic agent is coated.

An ultraviolet absorbent can be incorporated into this polyester. Also, to prevent light piping, dyes or pigments such as Diaresin manufactured by Mitsubishi Kasei Corp. or Kayaset manufactured by NIPPON KAYAKU CO. LTD. commercially available for polyester can be incorporated.

In the present invention, it is preferable to perform a surface treatment in order to adhere the support and the sensitive material constituting layers. Examples of the surface treatment are surface activation treatments such as a chemical treatment, mechanical treatment, corona discharge treatment, flame treatment, ultraviolet treatment, high-frequency treatment, glow discharge treatment, active plasma treatment, laser treatment, mixed acid treatment, and ozone oxidation treatment. Among other surface treatments, the ultraviolet radiation treatment, flame treatment, corona treatment, and glow treatment are preferable.

An undercoating layer can include a single layer or two or more layers. Examples of an undercoating layer binder are copolymers formed by using, as a starting material, a monomer selected from vinylchloride, vinylidenechloride, butadiene, methacrylic acid, acrylic acid, itaconic acid, and maleic anhydride. Other examples are polyethyleneimine, an epoxy resin, grafted gelatin, nitrocellulose, and gelatin. Resorcin and p-chlorophenol are examples of a compound which swells a support. Examples of a gelatin hardener added to the undercoating layer are chromium salt (e.g., chromium alum), aldehydes (e.g., formaldehyde and glutaraldehyde), isocyanates, an active halogen compound (e.g., 2,4-dichloro-6-hydroxy-s-triazine), epichlorohydrin resin, and active vinylsulfone compound. $SiO_2$, $TiO_2$, inorganic fine grains, or polymethylmethacrylate copolymer fine grains (0.01 to 10 μm) can also be contained as a matting agent.

In the present invention, an antistatic agent is preferably used. Examples of this antistatic agent are carboxylic acid, carboxylate, a macromolecule containing sulfonate, cationic macromolecule, and ionic surfactant compound.

As the antistatic agent, it is especially preferable to use fine grains of at least one crystalline metal oxide selected from ZnO, $TiO_2$, $SnO_2$, $Al_2O_3$, $In_2O_3$, $SiO_2$, MgO, BaO, $MoO_3$, and $V_2O_5$, and having a volume resistivity of $10^7$ Ω·cm or less, more preferably $10^5$ Ω·cm or less and a grain size of 0.001 to 1.0 μm, fine grains of composite oxides (e.g., Sb, P, B, In, S, Si, and C) of these metal oxides, fine grains of sol metal oxides, or fine grains of composite oxides of these sol metal oxides.

The content in a sensitive material is preferably to 500 $mg/m^2$, and especially preferably 10 to 350 $mg/m^2$. The ratio of a conductive crystalline oxide or its composite oxide to the binder is preferably 1/300 to 100/1, and more preferably 1/100 to 100/5.

A sensitive material of the present invention preferably has a slip property. Slip agent-containing layers are preferably formed on the surfaces of both a sensitive layer and back layer. A preferable slip property is 0.01 to 0.25 as a coefficient of kinetic friction. This represents a value obtained when a stainless steel sphere 5 mm in diameter is conveyed at a speed of 60 cm/min (25° C., 60% RH). In this evaluation, a value of nearly the same level is obtained when the surface of a sensitive layer is used as a sample to be measured.

Examples of a slip agent usable in the present invention are polyorganocyloxane, higher fatty acid amide, higher fatty acid metal salt, and ester of higher fatty acid and higher alcohol. As the polyorganocyloxane, it is possible to use, e.g., polydimethylcyloxane, polydiethylcyloxane, polystyrylmethylcyloxane, or polymethylphenylcyloxane. A layer to which the slip agent is added is preferably the outermost emulsion layer or back layer. Polydimethylcyloxane or ester having a long-chain alkyl group is particularly preferable.

A sensitive material of the present invention preferably contains a matting agent. This matting agent can be added to either the emulsion surface or back surface and is especially preferably added to the outermost emulsion layer. The matting agent can be either soluble or insoluble in processing solutions, and the use of both types of matting agents is preferable. Preferable examples are polymethylmethacrylate grains, poly(methylmethacrylate/methacrylic acid)=9/1 or 5/5 (molar ratio)) grains, and polystyrene grains. The grain size is preferably 0.8 to 10 μm, and a narrow grain size distribution is preferable. It is preferable that 90% or more of all grains have grain sizes 0.9 to 1.1 times the average grain size. To increase the matting property, it is preferable to simultaneously add fine grains with a grain size of 0.8 μm or smaller. Examples are polymethylmethacrylate grains (0.2 μm), poly(methylmethacrylate/methacrylic acid)=9/1 (molar ratio, 0.3 μm) grains, polystyrene grains (0.25 μm), and colloidal silica grains (0.03 μm).

The support used in the Examples may be prepared according to the method described in Example 1 of JP-2000-281815.

The film patrone employed in the present invention will be described below. The main material composing the patrone for use in the present invention may be a metal or a synthetic plastic.

Examples of preferable plastic materials include polystyrene, polyethylene, polypropylene and polyphenyl ether. The patrone for use in the present invention may contain various types of antistatic agents and can preferably contain, for example, carbon black, metal oxide grains, nonionic, anionic, cationic or betaine type surfactants and polymers. Such an antistatic patrone is described in JP-A's-1-312537 and 1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 $cm^3$ or less, more preferably 25 $cm^3$ or less. The weight of the plastic used in each patrone or patrone case preferably ranges from 5 to 15 g.

The patrone for use in the present invention may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. Nos. 4,834,306 and 5,226,613. The photographic film for use in the present invention may be a generally so termed raw stock having not yet been developed or a developed photographic film. The raw stock and the developed photographic film may be accommodated in the same new patrone or in different patrones.

The color photographic lightsensitive material of the present invention is suitably used as a negative film for Advanced Photo System (hereinafter referred to as "AP system"). It is, for example, one obtained by working the film into AP system format and accommodating the same in a special purpose cartridge, such as NEXIA A, NEXIA F or NEXIA H (sequentially, ISO 200/100/400) produced by Fuji Photo Film Co., Ltd. (hereinafter referred to as "Fuji Film"). This cartridge film for AP system is charged in a camera for AP system such as Epion series, e.g., Epion 300Z, produced by Fuji Film and put to practical use. Moreover, the color photographic lightsensitive material of the present invention is suitable to a lens equipped film, such as Fuji Color Utsurundesu Super Slim (Quick Snap) produced by Fuji Film.

The thus photographed film is printed through the following steps in a minilabo system:

(1) acceptance (receiving an exposed cartridge film from a customer), (2) detaching (transferring the film from the above cartridge to an intermediate cartridge for development), (3) film development, (4) re-attaching (returning the developed negative film to the original cartridge), (5) printing (continuous automatic printing of C/H/P three type print and index print on color paper (preferably, Super FA8 produced by Fuji Film)), and (6) collation and delivery (collating the cartridge and index print with ID number and delivering the same with prints).

The above system is preferably Fuji Film Minilabo Champion Super FA-298/FA-278/FA-258/FA-238 or Fuji Film Digital Labo System Frontier. Film processor of the Minilabo Champion is, for example, FP922AL/FP562B/FP562B, AL/FP362B/FP362B, AL, and recommended processing chemical is Fuji Color Just It CN-16L or CN-16Q. Printer processor is, for example, PP3008AR/PP3008A/PP1828AR/PP1828A/PP1258AR/PP1258A/PP72 8AR/PP728A, and recommended processing chemical thereof is Fuji Color Just It CP-47L or CP-40FAII.

In the Frontier System, use is made of scanner & image processor SP-1000 and laser printer & paper processor LP-1000P or Laser Printer LP-1000W. Fuji Film DT200/DT100 and AT200/AT100 are preferably used as detacher in the detaching step and as re-attacher in the reattaching step, respectively.

The AP system can be enjoyed by photo joy system whose center unit is Fuji Film digital image work station Aladdin 1000. For example, developed AP system cartridge film is directly charged in Aladdin 1000, or negative film, positive film or print image information is inputted with the use of 35 mm film scanner FE-550 or flat head scanner PE-550 therein, and obtained digital image data can easily be worked and edited. The resultant data can be outputted as prints by current labo equipment, for example, by means of digital color printer NC-550AL based on photofixing type thermal color printing system or Pictrography 3000 based on laser exposure thermal development transfer system or through a film recorder. Moreover, Aladdin 1000 is capable of directly outputting digital information to a floppy disk or Zip disk or outputting it through a CD writer to CD-R.

On the other hand, at home, photographs can be enjoyed on TV only by charging the developed AP system cartridge film in photoplayer AP-1 manufactured by Fuji Film. Charging it in Photoscanner AS-1 manufactured by Fuji Film enables continuously feeding image information into a personal computer at a high speed. Further, Photovision FV-10/FV-5 manufactured by Fuji Film can be utilized for inputting a film, print or three-dimensional object in a personal computer. Still further, image information recorded on a floppy disk, Zip disk, CD-R or a hard disk can be enjoyed by conducting various workings on the personal computer by the use of Fuji Film Application Soft Photofactory. Digital color printer NC-2/NC-2D based on photofixing type thermal color printing system, manufactured by Fuji Film, is suitable for outputting high-quality prints from a personal computer.

Fuji Color Pocket Album AP-5 Pop L, AP-1 Pop L, AP-1 Pop KG or Cartridge File 16 is preferably employed for storing the developed AP system cartridge film.

Examples of the present invention will be described below, which, however, in no way limit the scope of the present invention.

EXAMPLE 1

Silver halide emulsions Em-A to Em-O specified in Table 1 were prepared with reference to the process for preparing emulsions Em-A to Em-O described in Example 1 of JP-A-2001-281815.

TABLE 1

| Emulsion name | Average AgI content (mol %) | Average equivalent sphere diameter (μm) | Average aspect ratio | Average equivalent circle diameter (μm) | Average grain thickness (μm) | Shape |
|---|---|---|---|---|---|---|
| A | 4 | 1.0 | 25 | 2.8 | 0.11 | Tabular |
| B | 5 | 0.7 | 15 | 1.6 | 0.11 | Tabular |
| C | 4.7 | 0.51 | 7 | 0.85 | 0.12 | Tabular |
| D | 1 | 0.51 | 11 | 1.0 | 0.09 | Tabular |
| E | 5 | 1.0 | 25 | 2.8 | 0.11 | Tabular |
| F | 5.5 | 0.75 | 15 | 1.6 | 0.11 | Tabular |
| G | 4.7 | 0.73 | 9.9 | 1.39 | 0.14 | Tabular |
| H | 2.5 | 0.51 | 9 | 0.42 | 0.10 | Tabular |
| I | 1.5 | 0.37 | 9 | 0.67 | 0.074 | Tabular |
| J | 5 | 0.8 | 12 | 1.6 | 0.13 | Tabular |
| K | 3.7 | 0.47 | 3 | 0.53 | 0.18 | Tabular |
| L | 5.5 | 1.6 | 12 | 3.2 | 0.27 | Tabular |
| M | 8.8 | 0.64 | 5.2 | 0.85 | 0.16 | Tabular |
| N | 3.7 | 0.37 | 4.6 | 0.55 | 0.12 | Tabular |
| O | 1.8 | 0.19 | — | — | — | Cubic |

Referring to Table 1, dislocation lines as described in JP-A-3-237450 were observed in the tabular grains when the observation was conducted through a high-voltage electron microscope.

Emulsions Em-A1 and Em-A2 were prepared in the same manner as in the preparation of emulsion Em-A except that after the completion of chemical sensitization of emulsion Em-A, the temperature of the chemically sensitized emulsion was lowered to 40° C. and then electron-releasing compounds according to the present invention were added in the contents based on the quantity of silver contained in the emulsion, as specified in Table 2.

Similarly, emulsions Em-B1, B2, C1, C2, D1, D2, E1, E2, F1, F2, G1, G2, H1, H2, L1, L2, M1, M2, N1, N2, O1 and O2 were prepared except that after the completion of chemical sensitization of emulsions Em-B to H and Em-L to 0, the temperature of the chemically sensitized emulsion was lowered to 40° C. and then electron-releasing compounds according to the present invention were added in the contents based on the quantity of silver contained in the emulsion, as specified in Table 2.

TABLE 2

| Emulsion number | Electron-releasing compound | Addition amount to silver amount (mol/mol-Ag) |
|---|---|---|
| Em-A1 | Exemplified compound 14 | $1 \times 10^{-6}$ |
| Em-A2 | Exemplified compound 45 | $2 \times 10^{-6}$ |
| Em-B1 | Exemplified compound 14 | $3 \times 10^{-6}$ |
| Em-B2 | Exemplified compound 45 | $1 \times 10^{-6}$ |
| Em-C1 | Exemplified compound 14 | $1 \times 10^{-6}$ |
| Em-C2 | Exemplified compound 45 | $2 \times 10^{-6}$ |
| Em-D1 | Exemplified compound 14 | $3 \times 10^{-6}$ |
| Em-D2 | Exemplified compound 45 | $6 \times 10^{-6}$ |
| Em-E1 | Exemplified compound 14 | $1 \times 10^{-6}$ |
| Em-E2 | Exemplified compound 45 | $2 \times 10^{-6}$ |
| Em-F1 | Exemplified compound 14 | $4 \times 10^{-6}$ |
| Em-F2 | Exemplified compound 45 | $4 \times 10^{-6}$ |
| Em-G1 | Exemplified compound 14 | $5 \times 10^{-6}$ |
| Em-G2 | Exemplified compound 45 | $7 \times 10^{-6}$ |
| Em-H1 | Exemplified compound 14 | $3 \times 10^{-6}$ |
| Em-H2 | Exemplified compound 45 | $8 \times 10^{-6}$ |
| Em-L1 | Exemplified compound 7 | $4 \times 10^{-6}$ |
| Em-L2 | Exemplified compound 37 | $5 \times 10^{-6}$ |
| Em-M1 | Exemplified compound 7 | $6 \times 10^{-6}$ |
| Em-M2 | Exemplified compound 37 | $4 \times 10^{-6}$ |
| Em-N1 | Exemplified compound 7 | $7 \times 10^{-6}$ |

TABLE 2-continued

| Emulsion number | Electron-releasing compound | Addition amount to silver amount (mol/mol-Ag) |
|---|---|---|
| Em-N2 | Exemplified compound 37 | $9 \times 10^{-6}$ |
| Em-O1 | Exemplified compound 7 | $5 \times 10^{-6}$ |
| Em-O2 | Exemplified compound 37 | $4 \times 10^{-6}$ |

(Preparation of Sample 101)

A triacetylcellulose support was coated with multiple layers of the following respective compositions, thereby obtaining a color negative film (sample 101).

(Composition of Light-Sensitive Layer)

Main materials used in each of the layers are classified as follows:

ExC: cyan coupler, UV: ultraviolet absorber,
ExM: magenta coupler, HBS: high b.p. org. solvent,
ExY: yellow coupler, H: gelatin hardener.

(For each specific compound, in the following description, figure is assigned after the character, and the chemical formula thereof is shown thereafter).

The numeric value given beside the description of each component is for the coating amount expressed in the unit of $g/m^2$. With respect to the silver halides, the coating amount is in terms of silver quantity.

| | | |
|---|---|---|
| 1st layer (First antihalation layer) | | |
| Black colloidal silver | silver | 0.127 |
| Silver iodobromide emulsion (av. equiv. sphere diam: 0.07 μm, silver iodide content: 2 mol %) | silver | 0.008 |
| Gelatin | | 0.900 |
| ExC-1 | | 0.002 |
| ExC-3 | | 0.002 |
| Cpd-2 | | 0.001 |
| HBS-1 | | 0.005 |
| HBS-2 | | 0.002 |
| F-8 | | 0.001 |
| 2nd layer (Second antihalation layer) | | |
| Black colloidal silver | silver | 0.019 |
| Gelatin | | 0.425 |
| ExF-1 | | 0.002 |

-continued

| | | |
|---|---|---|
| Solid disperse dye ExF-9 | | 0.120 |
| HBS-1 | | 0.074 |
| F-8 | | 0.001 |
| 3rd layer (Interlayer) | | |
| Cpd-1 | | 0.080 |
| HBS-1 | | 0.042 |
| Gelatin | | 0.300 |
| 4th layer (Low-speed red-sensitive emulsion layer) | | |
| Em-D | silver | 0.407 |
| Em-C | silver | 0.457 |
| ExC-1 | | 0.233 |
| ExC-2 | | 0.026 |
| ExC-3 | | 0.129 |
| ExC-4 | | 0.155 |
| ExC-5 | | 0.029 |
| ExC-6 | | 0.013 |
| Cpd-2 | | 0.025 |
| Cpd-4 | | 0.025 |
| ExC-8 | | 0.050 |
| HBS-1 | | 0.114 |
| HBS-5 | | 0.038 |
| Gelatin | | 1.474 |
| 5th layer (Medium-speed red-sensitive emulsion layer) | | |
| Em-B | silver | 0.601 |
| Em-C | silver | 0.301 |
| ExC-1 | | 0.154 |
| ExC-2 | | 0.037 |
| ExC-3 | | 0.018 |
| ExC-4 | | 0.103 |
| ExC-5 | | 0.037 |
| ExC-6 | | 0.050 |
| Cpd-2 | | 0.036 |
| Cpd-4 | | 0.028 |
| Cpd-6 | | 0.060 |
| ExC-7 | | 0.010 |
| HBS-1 | | 0.129 |
| Gelatin | | 1.086 |
| 6th layer (High-speed red-sensitive emulsion layer) | | |
| Em-A | silver | 0.950 |
| ExC-1 | | 0.072 |
| ExC-3 | | 0.035 |
| ExC-10 | | 0.080 |
| Cpd-2 | | 0.064 |
| Cpd-4 | | 0.077 |
| Cpd-6 | | 0.060 |
| ExC-7 | | 0.040 |
| HBS-1 | | 0.329 |
| HBS-2 | | 0.120 |
| Gelatin | | 1.245 |
| 7th layer (Interlayer) | | |
| Cpd-1 | | 0.094 |
| Cpd-7 | | 0.369 |
| A-1 | | 0.043 |
| Solid disperse dye ExF-4 | | 0.030 |
| HBS-1 | | 0.049 |
| Polyethyl acrylate latex | | 0.088 |
| Gelatin | | 0.886 |
| 8th layer (Layer capable of exerting interlayer effect on red-sensitive layer) | | |
| Em-J | silver | 0.300 |
| Em-K | silver | 0.200 |
| Cpd-4 | | 0.030 |
| ExM-2 | | 0.057 |
| ExM-3 | | 0.016 |
| ExM-4 | | 0.051 |
| ExY-1 | | 0.008 |
| ExY-6 | | 0.042 |
| ExC-9 | | 0.011 |
| HBS-1 | | 0.090 |
| HBS-3 | | 0.003 |
| HBS-5 | | 0.030 |
| Gelatin | | 0.610 |

-continued

| | | |
|---|---|---|
| 9th layer (Low-speed green-sensitive emulsion layer) | | |
| Em-H | silver | 0.200 |
| Em-G | silver | 0.220 |
| Em-I | silver | 0.130 |
| ExM-2 | | 0.378 |
| ExM-3 | | 0.047 |
| ExY-1 | | 0.009 |
| ExC-9 | | 0.007 |
| HBS-1 | | 0.098 |
| HBS-3 | | 0.010 |
| HBS-4 | | 0.077 |
| HBS-5 | | 0.548 |
| Cpd-5 | | 0.010 |
| Gelatin | | 1.470 |
| 10th layer (Medium-speed green-sensitive emulsion layer) | | |
| Em-F | silver | 0.536 |
| ExM-2 | | 0.049 |
| ExM-3 | | 0.035 |
| ExM-4 | | 0.014 |
| ExY-1 | | 0.003 |
| ExY-5 | | 0.006 |
| ExC-6 | | 0.007 |
| ExC-8 | | 0.010 |
| ExC-9 | | 0.012 |
| HBS-1 | | 0.065 |
| HBS-3 | | 0.002 |
| HBS-5 | | 0.020 |
| Cpd-5 | | 0.004 |
| Gelatin | | 0.446 |
| 11th layer (High-speed green-sensitive emulsion layer) | | |
| Em-E | silver | 0.493 |
| Em-G | silver | 0.440 |
| ExC-7 | | 0.010 |
| ExM-1 | | 0.022 |
| ExM-2 | | 0.045 |
| ExM-3 | | 0.014 |
| ExM-4 | | 0.010 |
| ExM-5 | | 0.010 |
| Cpd-3 | | 0.004 |
| Cpd-4 | | 0.007 |
| Cpd-5 | | 0.010 |
| HBS-1 | | 0.148 |
| HBS-5 | | 0.037 |
| Polyethyl acrylate latex | | 0.099 |
| Gelatin | | 0.939 |
| 12th layer (Yellow filter layer) | | |
| Cpd-1 | | 0.094 |
| Solid disperse dye ExF-2 | | 0.150 |
| Solid disperse dye ExF-5 | | 0.010 |
| Oil soluble dye ExF-7 | | 0.010 |
| HBS-1 | | 0.049 |
| A-1 | | 0.043 |
| Gelatin | | 0.630 |
| 13th layer (Low-speed blue-sensitive emulsion layer) | | |
| Em-O | silver | 0.060 |
| Em-M | silver | 0.404 |
| Em-N | silver | 0.076 |
| ExC-1 | | 0.048 |
| ExY-1 | | 0.012 |
| ExY-2 | | 0.350 |
| ExY-6 | | 0.060 |
| ExY-7 | | 0.300 |
| ExC-9 | | 0.012 |
| Cpd-2 | | 0.100 |
| Cpd-3 | | 0.004 |
| HBS-1 | | 0.222 |
| HBS-5 | | 0.074 |
| Gelatin | | 2.058 |
| 14th layer (High-speed blue-sensitive emulsion layer) | | |
| Em-L | silver | 0.974 |
| ExY-2 | | 0.100 |
| ExY-7 | | 0.100 |
| Cpd-2 | | 0.075 |

-continued

| | | |
|---|---|---|
| Cpd-3 | | 0.001 |
| HBS-1 | | 0.071 |
| Gelatin | | 0.678 |
| 15th layer (First protective layer) | | |
| Silver iodobromide emulsion (av. equiv. sphere diam: 0.07 μm, silver iodide content: 2 mol %) | silver | 0.280 |
| UV-1 | | 0.100 |
| UV-2 | | 0.060 |
| UV-3 | | 0.095 |
| UV-4 | | 0.013 |
| UV-5 | | 0.200 |
| F-11 | | 0.009 |
| S-1 | | 0.086 |
| HBS-1 | | 0.175 |
| HBS-4 | | 0.050 |
| Gelatin | | 1.984 |
| 16th layer (Second protective layer) | | |
| H-1 | | 0.400 |
| B-1 (diameter 1.7 μm) | | 0.050 |
| B-2 (diameter 1.7 μm) | | 0.150 |
| B-3 | | 0.050 |
| W-5 | | 0.025 |
| W-1 | | $9.0 \times 10^{-3}$ |
| S-1 | | 0.200 |
| Gelatin | | 0.750 |

In addition, B-4 to B-6, F-1 to F-17, a lead salt, a platinum salt, an iridium salt and a rhodium salt were appropriately added to the individual layers in order to improve the storage life, processability, resistance to pressure, antiseptic and mildewproofing properties, antistatic properties and coating property thereof.

Preparation of dispersion of organic solid disperse dye:

The ExF-2 of the 12th layer was dispersed by the following method. Specifically,

| | |
|---|---|
| Wet cake of ExF-2 (containing 17.6 wt. % water) | 2.800 kg |
| Sodium octylphenyldiethoxymethanesulfonate (31 wt. % aqueous solution) | 0.376 kg |
| F-15 (7% aqueous solution) | 0.011 kg |
| Water | 4.020 kg |
| Total (adjusted to pH = 7.2 with NaOH). | 7.210 kg |

Slurry of the above composition was agitated by means of a dissolver to thereby effect a preliminary dispersion, and further dispersed by means of agitator mill LMK-4 under such conditions that the peripheral speed, delivery rate and packing ratio of 0.3 mm-diameter zirconia beads were 10 m/s, 0.6 kg/min and 80%, respectively, until the absorbance ratio of the dispersion became 0.29. Thus, a solid particulate dispersion was obtained, wherein the average particle diameter of dye particulate was 0.29 μm.

Solid dispersions of ExF-4 and ExF-9 were obtained in the same manner. The average particle diameters of these dye particulates were 0.28 μm and 0.49 μm, respectively. ExF-5 was dispersed by the microprecipitation dispersion method described in Example 1 of EP. No. 549,489A. The average particle diameter thereof was 0.06 μm.

Compounds used in the preparation of each layer are shown below.

ExC-1

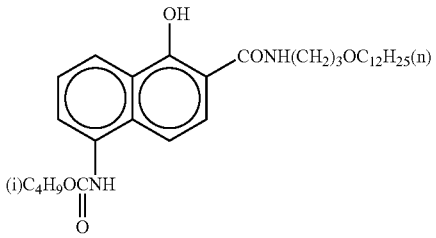

ExC-2

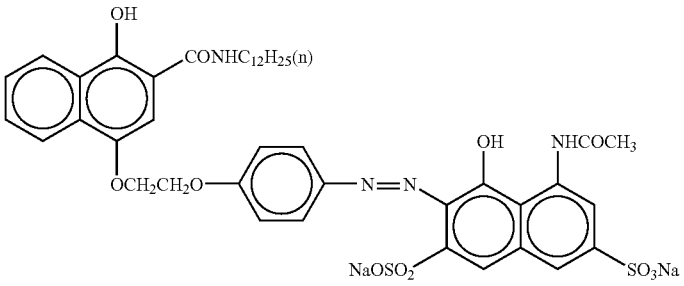

-continued
ExC-3
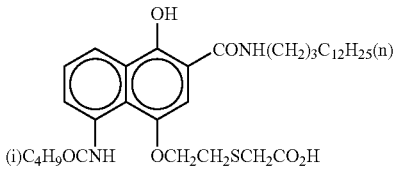
ExC-4
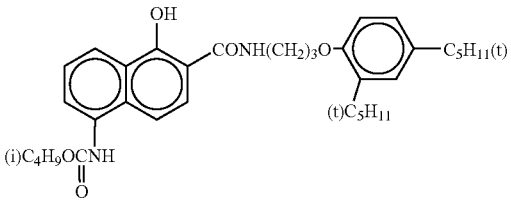
ExC-5
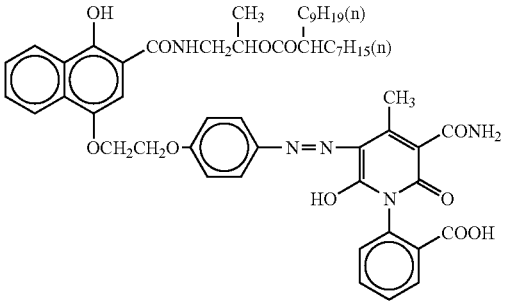
ExC-6
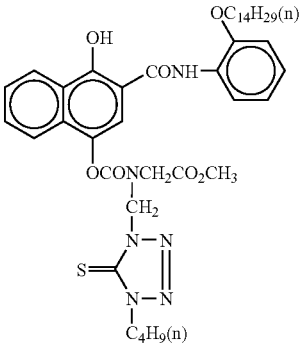
ExC-7
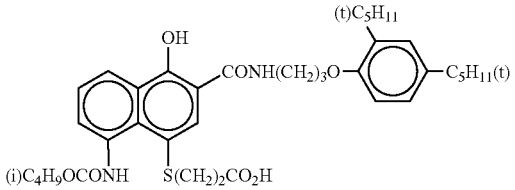
ExC-8
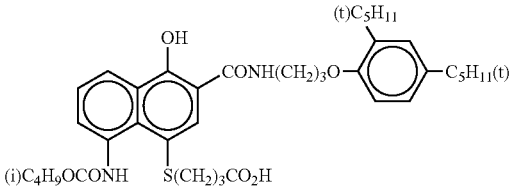
ExC-9
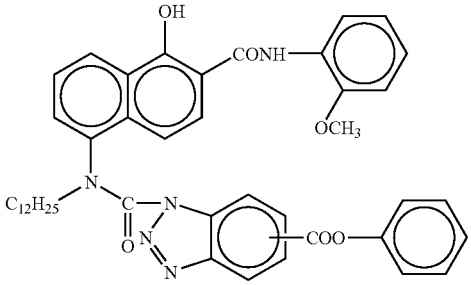
ExC-10
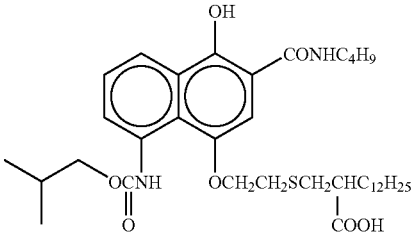
ExM-1
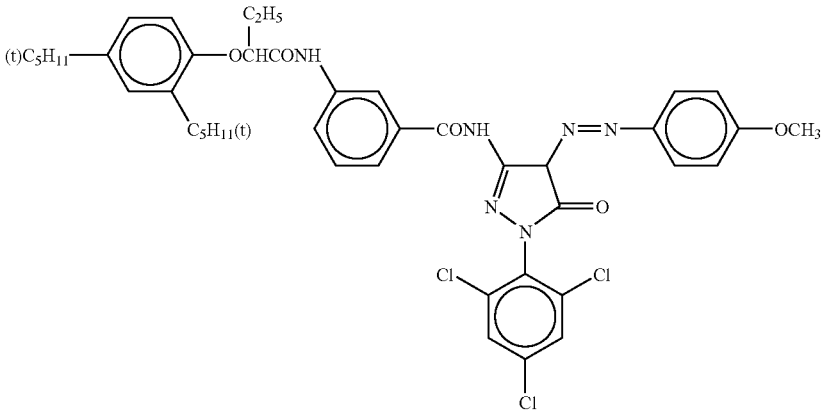

-continued
ExM-2
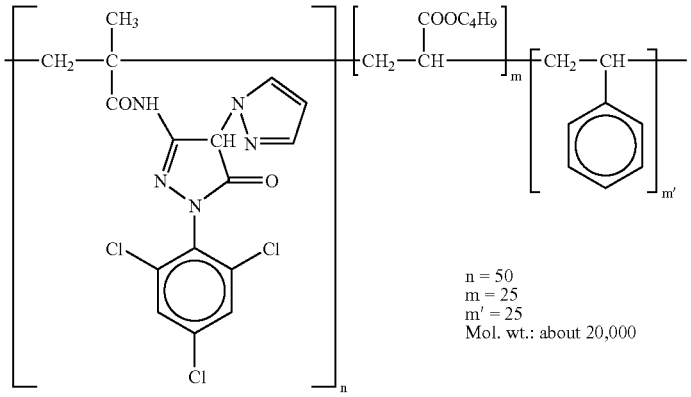
ExM-3
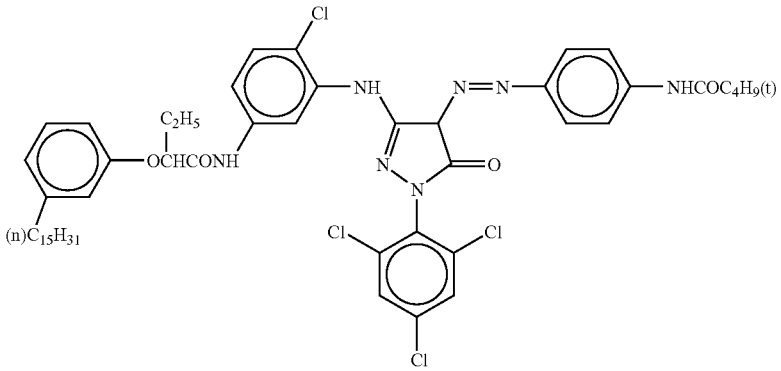
ExM-4
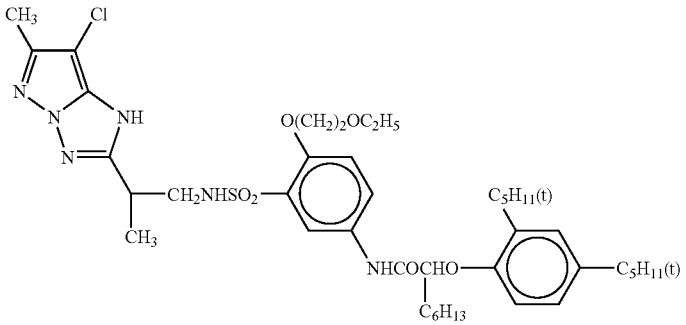
ExM-5
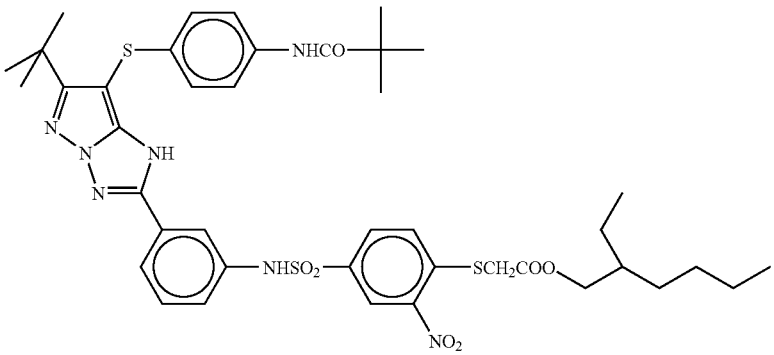

-continued
ExY-1
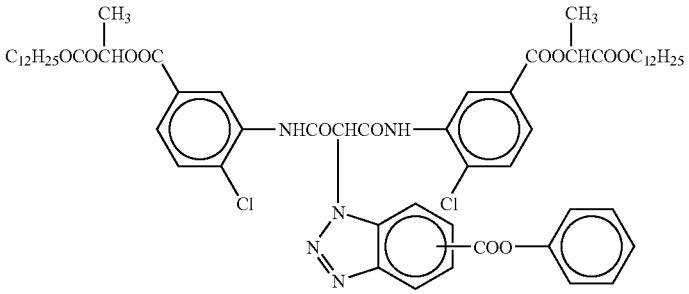
ExY-2
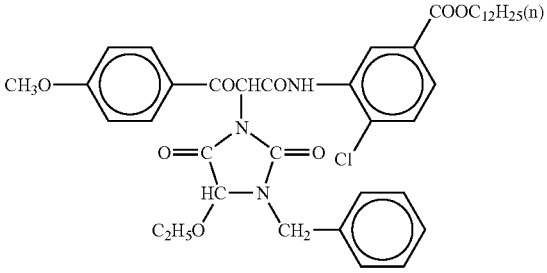
ExY-5
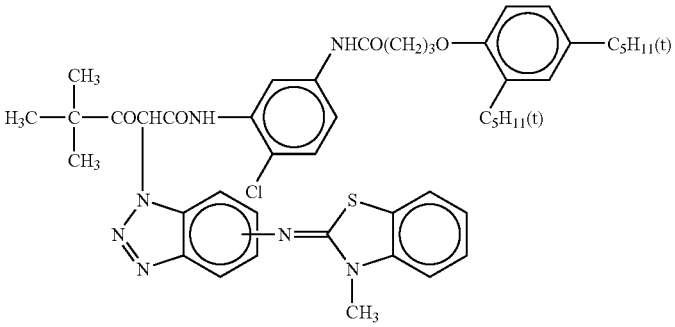
ExY-6
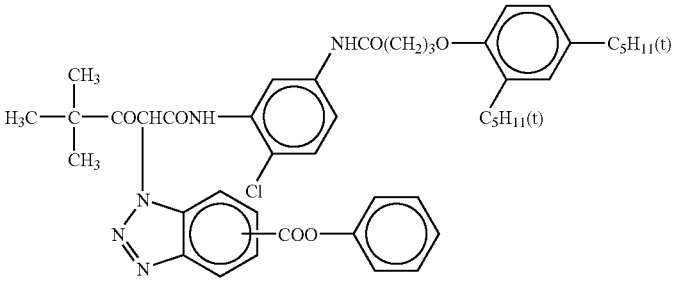

-continued
ExY-7
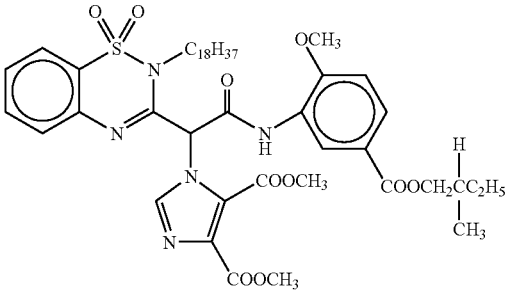
Cpd-1
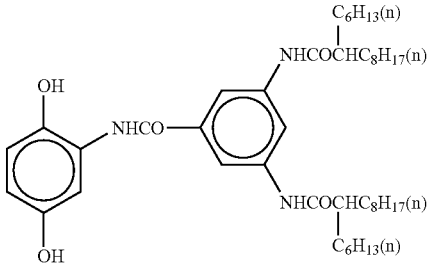
Cpd-2
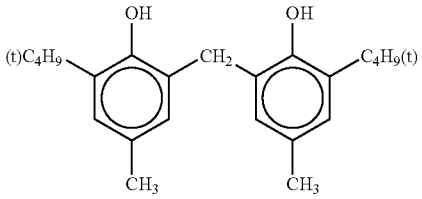
Cpd-3
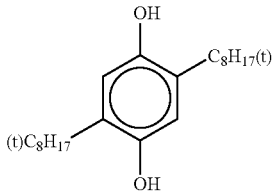
Cpd-4
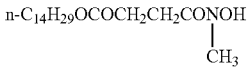
Cpd-5
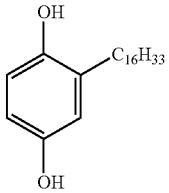
Cpd-6
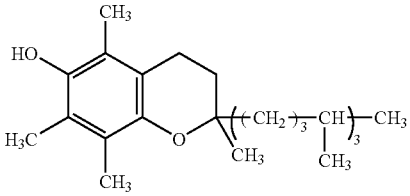
UV-1
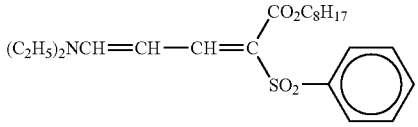
UV-2
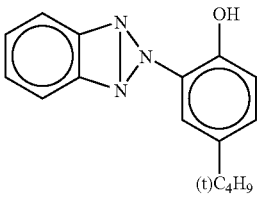
UV-3
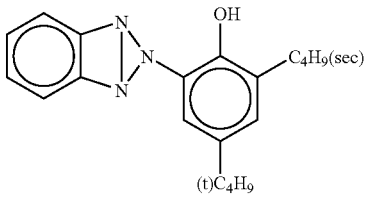
UV-4
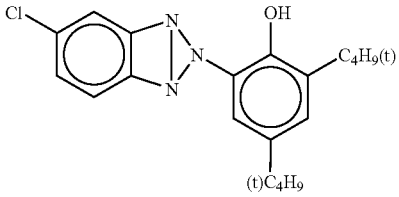
UV-5
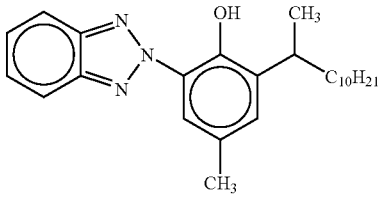

-continued
B-1
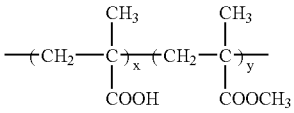
x/y = 10/90 (Wt. ratio)
Weight-average mol. wt.:
about 35,000
B-2
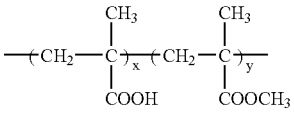
x/y = 40/60 (Wt. ratio)
Weight-average mol. wt.:
about 20,000
B-3
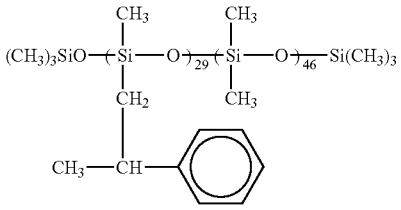
(Mol. ratio)
Weight-average mol. wt.:
about 8,000
H-1
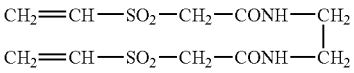
S-1
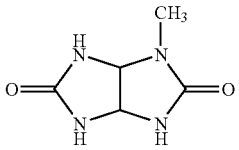
HBS-1
Tricresyl phosphate
HBS-2
Di (n-butyl) phthalate
HBS-3
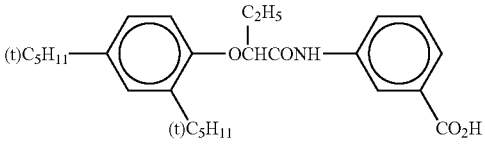
HBS-4
Tri (2-ehtylhexyl) phosphate
HBS-5
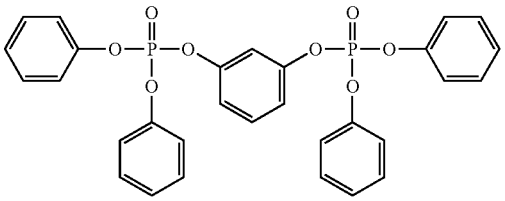
F-1
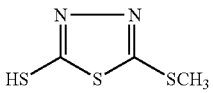
F-2
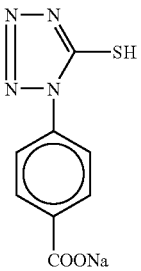

-continued
F-3
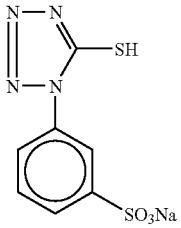
F-4
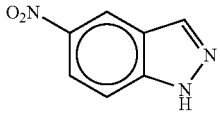
F-5
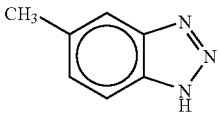
F-6
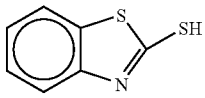
F-7
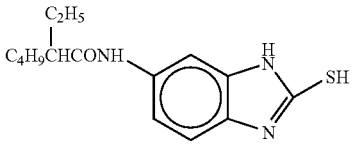
F-8
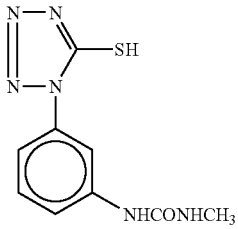
F-9
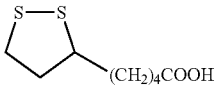
F-10
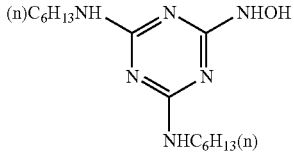
F-11
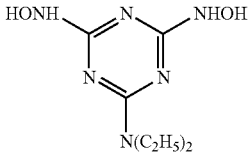
F-12
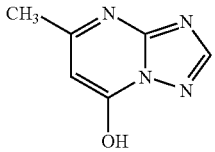
F-13
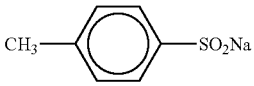
F-14
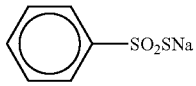
F-15
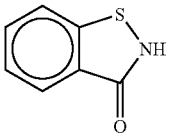
F-16
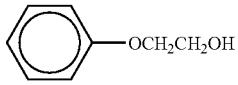
F-17
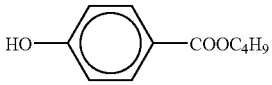
W-1
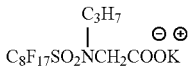

-continued
W-5
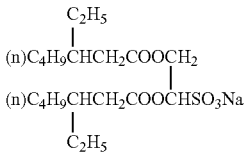
B-4
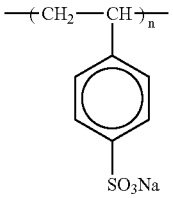
Weight-average mol. wt.: about 750,000
B-5
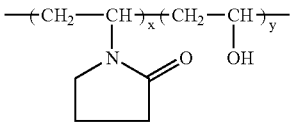
x/y = 70/30 (Wt. ratio)
Weight-average mol. wt.: about 17,000
B-6
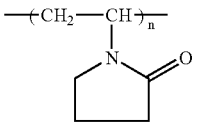
Weight-average mol. wt.: about 10,000
Cpd-7
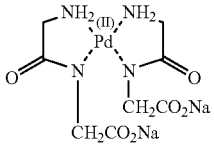
ExF-1
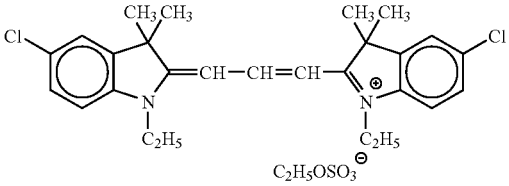
ExF-2
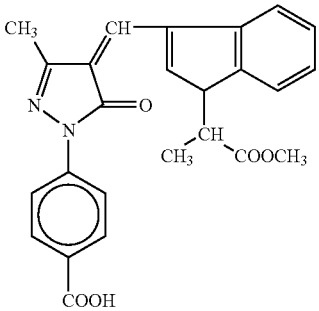
ExF-4
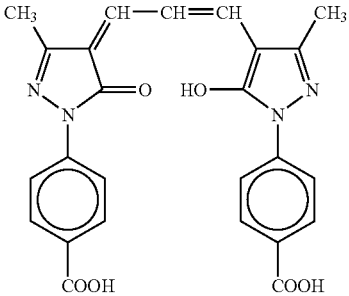
ExF-5
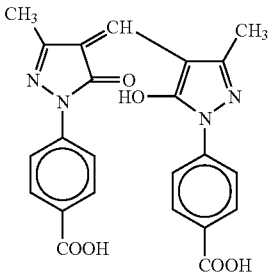
ExF-7
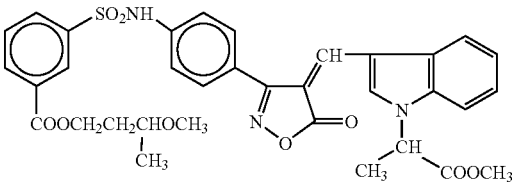
ExF-9
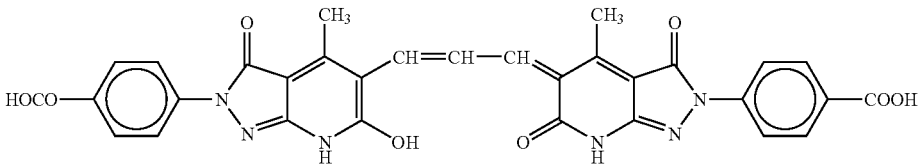

-continued

A-1

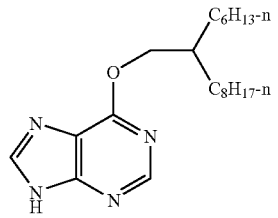

The thus prepared color negative photosensitive material was referred to as sample 101.

(Preparation of Samples 102 to 115)

Samples 102 to 115 each having at a density of Dmin+0.5 a spectral sensitivity distribution of blue-sensitive layer as specified in Table 3 were prepared by effecting equal-silver-quantity changes of the emulsions Em-0, Em-M and Em-N of the 13th layer and the emulsion Em-L of the 14th layer to emulsions Em-O1, Em-M1, Em-N1 and Em-L1, respectively, or emulsions Em-$O_2$, Em-M2, Em-N2 and Em-L2, respectively, and further by changing the amount of compounds UV-1 to −5 in the 15th layer (first protective layer) so as to change the spectral sensitivity in the ultraviolet region.

With respect to the thus obtained samples, the film speed, charge conditioning capability and radiation tolerance were estimated.

(Estimation of Speed)

Each of the samples was exposed through gelatin filter SC-39 (long-wavelength light transmission filter of 390 nm cutoff wavelength) produced by Fuji Photo Film Co., Ltd. and a continuous wedge for 1/100 sec. The exposed samples were developed with the use of automatic processor FP-360B manufactured by Fuji Photo Film Co., Ltd. under the following conditions.

With respect to the processed samples, the density thereof was measured through a blue filter to thereby estimate the photographic characteristics thereof.

The film speed was expressed by the relative value, in logarithmic number, of inverse number of exposure amount required for reaching a density of fog density plus 0.2 (the speed of sample 101 was assumed to be a control).

(Estimation of Charge Conditioning Capability)

Each of the samples was wrought into 135-format, placed in a film cartridge and charged in a camera. High-speed winding was performed in an atmosphere of 15° C. temperature and 15% humidity, and film development was carried out by the following processing. The developed samples were visually inspected with respect to fog.

(Estimation of Radiation Tolerance)

The coating samples 101 to 115 were exposed to 0.2 R γ-radiation (1.173, 1.333 MeV) from radioactive isotope element $Co^{60}$. The exposed samples were developed by the same processing as mentioned above, and with respect to the developed samples, the value of fog density was determined by carrying out density measurement through a blue filter. The fog increase attributed to the exposure to radiation was calculated from this fog value and the fog density of samples used in the above film speed estimation. The radiation tolerance was estimated by the relative value of fog increase on the basis of that of the sample 101.

The processing steps and compositions of processing solutions are as follows.

(Processing Steps)

| Step | Time | Temp. | Qty. Of replenisher* | Tank volume |
|---|---|---|---|---|
| Color Development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate is a value per 1.1 m of a 35-mm wide photosensitive material (equivalent to one role of 24 Ex. film).

The stabilizer was fed from stabilization (2) to stabilization (1) by counter current. All the overflow of washing water was introduced into fixing bath (2). The amounts of drag-in of developer into the bleaching step, drag-in of bleaching solution into the fixing step and drag-in of fixer into the washing step were 2.5 mL, 2.0 mL and 2.0 mL, respectively, per 1.1 m of a 35-mm wide photosensitive material. Each crossover time was 6 sec, which was included in the processing time of the previous step.

The open area of the above processor was 100 $cm^2$ for the color developer, 120 $cm^2$ for the bleaching solution and about 100 $cm^2$ for the other processing solutions.

The composition of each of the processing solutions was as follows.

| | Tank solution (g) | Replenisher(g) |
|---|---|---|
| (Color developer) | | |
| Diethylenetriamine-pentaacetic acid | 3.0 | 3.0 |
| Disodium catechol-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl)hydroxylamine | 1.5 | 2.0 |
| Potassium bromide | 1.3 | 0.3 |
| Potassium iodide | 1.3 mg | — |
| 4-Hydroxy-6-methyl-1,3,3a,7-tetrazaindene | 0.05 | — |

-continued

| | Tank solution (g) | Replenisher(g) |
|---|---|---|
| Hydroxylamine sulfate | 2.4 | 3.3 |
| 2-Methyl-4-[N-ethyl-N-(β-hydroxyethyl)amino]-aniline sulfate | 4.5 | 6.5 |
| Water to make | 1.0 L | 1.0 L |
| pH (adjusted by the use of potassium hydroxide and sulfuric acid) | 10.05 | 10.18 |
| (Bleaching solution) | | |
| Fe(III) ammonium 1,3-diamino-propanetetraacetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by the use of aqueous ammonia) | 4.6 | 4.0 |
| (Fixing (1) tank solution) | | |
| 5:95 (by volume) mixture of the above bleaching tank solution and the following fixing tank solution (pH 6.8) | | |
| (Fixing (2)) | | |
| Aqueous solution of ammonium thiosulfate (750 g/L) | 240 mL | 720 mL |
| Imidazole | 7 | 21 |
| Ammonium methanethiosulfonate | 5 | 15 |
| Ammonium methanesulfonate | 10 | 30 |
| Ethylenediaminetetraacetic acid | 13 | 39 |
| Water to make | 1.0 L | 1.0 L |

-continued

| | Tank solution (g) | Replenisher(g) |
|---|---|---|
| pH (adjusted by the use of aqueous ammonia and acetic acid) | 7.4 | 7.45 |
| (Washing water) | | |

Tap water was passed through a mixed-bed column filled with H-type strongly acidic cation exchange resin (Amberlite IR-120B produced by Rohm & Haas Co.) and OH-type strongly basic anion exchange resin (Amberlite IR-400 produced by the same maker) so as to set the concentration of calcium and magnesium ions at 3 mg/L or less. Subsequently, 20 mg/L of sodium dichloroisocyanurate and 150 mg/L of sodium sulfate were added. The pH of the solution ranged from 6.5 to 7.5.

(Stabilizer): common to tank solution and replenisher

| | (g) |
|---|---|
| Sodium p-toluenesulfinate | 0.03 |
| Polyoxyethylene p-monononylphenyl ether (average polymerization degree 10) | 0.2 |
| Sodium salt of 1,2-benzoisothiazolin-3-one | 0.10 |
| Disodium ethylenediaminetetraacetate | 0.05 |
| 1,2,4-triazole | 1.3 |
| 1,4-bis(1,2,4-triazol-1-ylmethyl)-piperazine | 0.75 |
| Water to make | 1.0 L |
| pH | 8.5 |

TABLE 3

| Sample | Electron-releasing compound | $S_B$(370 nm)/$S_B$(420 nm) | Relative speed | static-induced fog | Increment in fog due to radiation | Remarks |
|---|---|---|---|---|---|---|
| 101 | None | 0.76 | 100 | X | 100 | Comp. |
| 102 | None | 0.65 | 99 | Δ | 98 | Comp. |
| 103 | None | 0.57 | 99 | Δ | 96 | Comp. |
| 104 | None | 0.44 | 101 | ○ | 95 | Comp. |
| 105 | None | 0.22 | 100 | ◎ | 84 | Comp. |
| 106 | Exemplified compound 7 | 0.75 | 151 | XX | 120 | Comp. |
| 107 | Exemplified compound 7 | 0.65 | 152 | Δ | 110 | Inv. |
| 108 | Exemplified compound 7 | 0.57 | 155 | ○ | 100 | Inv. |
| 109 | Exemplified compound 7 | 0.43 | 153 | ◎ | 91 | Inv. |
| 110 | Exemplified compound 7 | 0.22 | 150 | ◎ | 87 | Inv. |
| 111 | Exemplified compound 37 | 0.77 | 139 | XX | 131 | Comp. |
| 112 | Exemplified compound 37 | 0.65 | 140 | Δ | 119 | Inv. |
| 113 | Exemplified compound 37 | 0.57 | 140 | ○ | 95 | Inv. |
| 114 | Exemplified compound 37 | 0.46 | 136 | ○ | 91 | Inv. |
| 115 | Exemplified compound 37 | 0.21 | 139 | ◎ | 85 | Inv. |

◎: No fog arose;
○: Very slight fog arose;
Δ: Slight fog arose;
X: Much fog arose.

With respect to the samples 101 to 115, the results of relative sensitivity, charge conditioning capability characteristics and radiation tolerance are listed in Table 3.

As apparent from Table 3, in the Comparative Examples, the addition of electron-releasing compound, although exerting a high sensitivity increasing effect, intensifies the static-induced fog and radiation-induced fog. In the present invention, it is seen that the excellence in static tolerance and radiation tolerance while maintaining the advantage of sensitivity increase is realized through achieving of the spectral sensitivity distribution of the present invention by, while adding an electron-releasing compound, increasing the amount of ultraviolet absorber used.

EXAMPLE 2

Samples 201 to 206 were prepared in the same manner as in the preparation of samples 110 and 115 except that the compound W-1 of the 16th layer (second protective layer) was replaced in equivalent weight by compounds specified in Table 4.

With respect to the samples 110, 115 and 201 to 206, the speed, charge conditioning capability and radiation tolerance were estimated in the same manner as in Example 1. Further, estimation of the high speed coatability thereof was carried out.

(Estimation of High Speed Coatability)

The 16th layer in which the particle diameter of B-1 was set at 3 μm was applied at a speed of 1 m/sec in accordance with the slide bead coating method and immediately dried. The number of cissings having occurred on the coating film surface was visually counted and assessed in terms of cissing degree. The cissing degree refers to the percentage of the number of cissings of each of the samples based on the number of cissings of the sample 110. The smaller the value of cissing degree, the greater the cissing inhibiting effect.

TABLE 4

| Sample | Electron-releasing compound | S(370 nm)/(420 nm) | Surfactant in 16th layer | Relative sensitivity (See foot note) | Static-induced fog | Increment in fog due to radiation (See foot note) | Cissing characteristics | Remarks |
|---|---|---|---|---|---|---|---|---|
| 110 | Exemplified compound 7 | 0.22 | W-1 | 150 | ⊙ | 87 | 100 | Inv. |
| 201 | Exemplified compound 7 | 0.23 | FS-201 | 152 | ⊙ | 84 | 78 | Inv. |
| 202 | Exemplified compound 7 | 0.22 | FS-204 | 151 | ⊙ | 86 | 81 | Inv. |
| 203 | Exemplified compound 7 | 0.22 | FS-312 | 151 | ⊙ | 85 | 83 | Inv. |
| 115 | Exemplified compound 37 | 0.21 | W-1 | 139 | ⊙ | 85 | 114 | Inv. |
| 204 | Exemplified compound 37 | 0.20 | FS-201 | 138 | ⊙ | 87 | 65 | Inv. |
| 205 | Exemplified compound 37 | 0.22 | FS-204 | 138 | ⊙ | 87 | 66 | Inv. |
| 206 | Exemplified compound 37 | 0.22 | FS-312 | 139 | ⊙ | 86 | 64 | Inv. |

⊙: No fog arose;
○: Very slight fog arose;
Δ: Slight fog arose;
X: Much fog arose.
(Note)
Relative speed and increment in fog due to radiation are indicated assuming those of Sample 101 as 100.

The results are listed in Table 4.

As apparent from Table 4, a striking effect in high speed coatability can be exerted, without detriment to the high sensitivity, static tolerance and radiation tolerance, by the use of the surfactant according to the present invention.

EXAMPLE 3

The support was prepared by the following procedure.

1) First Layer and Substratum:

Both major surfaces of a 90 μm thick polyethylene naphthalate support were treated with glow discharge under such conditions that the treating ambient pressure was 2.66×10 Pa, the $H_2O$ partial pressure of ambient gas 75%, the discharge frequency 30 kHz, the output 2500 W, and the treating strength 0.5 kV·A·min/$m^2$. This support was coated, in a coating amount of 5 mL/$m^2$, with a coating liquid of the following composition to provide the 1st layer in accordance with the bar coating method described in JP-B-58-4589.

| | |
|---|---|
| Conductive fine grain dispersion ($SnO_2/Sb_2O_5$ grain conc. 10% water dispersion, secondary agglomerate of 0.005 μm diam. primary grains which has an av. grain size of 0.05 μm) | 50 pts. wt. |
| Gelatin | 0.5 pt. wt. |
| Water | 49 pts. wt. |
| Polyglycerol polyglycidyl ether | 0.16 pt. wt. |
| Polyoxyethylene sorbitan monolaurate (polymn. degree 20) | 0.1 pt. wt. |

The support furnished with the first coating layer was wound round a stainless steel core of 20 cm diameter and heated at 110° C. (Tg of PEN support: 119° C.) for 48 hr to thereby effect heat history annealing. The other side of the support opposite to the first layer was coated, in a coating amount of 10 mL/$m^2$, with a coating liquid of the following composition to provide a substratum for emulsion in accordance with the bar coating method.

| | |
|---|---|
| Gelatin | 1.01 pts. wt. |
| Salicylic acid | 0.30 pt. wt. |
| Resorcin | 0.40 pt. wt. |
| Polyoxyethylene nonylphenyl ether (polymn. degree 10) | 0.11 pt. wt. |
| Water | 3.53 pts. wt. |
| Methanol | 84.57 pts. wt. |
| n-Propanol | 10.08 pts. wt. |

Furthermore, the following second layer and third layer were superimposed in this sequence on the first layer by coating. Finally, multilayer coating of a color negative photosensitive material of the composition indicated below was performed on the opposite side. Thus, a transparent magnetic recording medium with silver halide emulsion layers was obtained.

2) Second Layer (Transparent Magnetic Recording Layer):

(i) Dispersion of Magnetic Substance:

1100 parts by weight of Co-coated $\gamma$-$Fe_2O_3$ magnetic substance (average major axis length: 0.25 μm, $S_{BET}$: 39 $m^2/g$, Hc: $65649\times10^4$ A/m, σs: 77.1 $Am^2/kg$, and σr: 37.4 $Am^2/kg$), 220 parts by weight of water and 165 parts by weight of silane coupling agent (3-(poly(polymerization degree: 10)oxyethyl)oxypropyltrimethoxysilane) were fed into an open kneader, and blended well for 3 hr. The resultant coarsely dispersed viscous liquid was dried at 70° C. round the clock to thereby remove water, and heated at 110° C. for 1 hr. Thus, surface treated magnetic grains were obtained.

Further, in accordance with the following recipe, a composition was prepared by blending by means of the open kneader once more for 4 hr:

| | |
|---|---|
| Thus obtained surface treated magnetic grains | 855 g |
| Diacetylcellulose | 25.3 g |
| Methyl ethyl ketone | 136.3 g |
| Cyclohexanone | 136.3 g |

Still further, in accordance with the following recipe, a composition was prepared by carrying out fine dispersion by means of a sand mill (¼G sand mill) at 2000 rpm for 4 hr. Glass beads of 1 mm diameter were used as medium.

| | |
|---|---|
| Thus obtained blend liquid | 45 g |
| Diacetylcellulose | 23.7 g |
| Methyl ethyl ketone | 127.7 g |
| Cyclohexanone | 127.7 g |

Moreover, in accordance with the following recipe, a magnetic substance containing intermediate liquid was prepared.

(ii) Preparation of Magnetic Substance Containing Intermediate Liquid:

| | |
|---|---|
| Thus obtained fine dispersion of magnetic substance | 674 g |
| Diacetylcellulose solution (solid content 4.34%, solvent: methyl ethyl ketone/cyclohexanone = 1/1) | 24,280 g |
| Cyclohexanone | 46 g |

These were mixed together and agitated by means of a disperser to thereby obtain a "magnetic substance containing intermediate liquid".

An α-alumina abrasive dispersion of the present invention was produced in accordance with the following recipe.

(a) Preparation of Sumicorundum AA-1.5 (Average Primary Grain Diameter: 1.5 μm, Specific Surface Area: 1.3 $m^2/g$) Grain Dispersion

| | |
|---|---|
| Sumicorundum AA-1.5 | 152 g |
| Silane coupling agent KBM903 (produced by Shin-Etsu Silicone) | 0.48 g |
| Diacetylcellulose solution (solid content 4.5%, solvent: methyl ethyl ketone/cyclohexanone = 1/1) | 227.52 g |

In accordance with the above recipe, fine dispersion was carried out by means of a ceramic-coated sand mill (¼G sand mill) at 800 rpm for 4 hr. Zirconia beads of 1 mm diameter were used as medium.

(b) Colloidal Silica Grain Dispersion (Fine Grains)

Use was made of "MEK-ST" produced by Nissan Chemical Industries, Ltd.

This is a dispersion of colloidal silica of 0.015 μm average primary grain diameter in methyl ethyl ketone as a dispersion medium, wherein the solid content is 30%.

(iii) Preparation of a Coating Liquid for Second Layer:

| | |
|---|---|
| Thus obtained magnetic substance containing intermediate liquid | 19,053 g |
| Diacetylcellulose solution (solid content 4.5%, solvent: methyl ethyl ketone/cyclohexanone = 1/1) | 264 g |
| Colloidal silica dispersion "MEK-ST" (dispersion b, solid content: 30%) | 128 g |
| AA-1.5 dispersion (dispersion a) | 12 g |
| Millionate MR-400 (produced by Nippon Polyurethane) diluent (solid content 20%, dilution solvent: methyl ethyl ketone/cyclohexanone = 1/1) | 203 g |
| Methyl ethyl ketone | 170 g |
| Cyclohexanone | 170 g |

A coating liquid obtained by mixing and agitating these was applied in a coating amount of 29.3 $mL/m^2$ with the use of a wire bar. Drying was performed at 110° C. The thickness of magnetic layer after drying was 1.0 μm.

3) Third Layer (Higher Fatty Acid Ester Sliding Agent Containing Layer)

(i) Preparation of Raw Dispersion of Sliding Agent

The following liquid A was heated at 100° C. to thereby effect dissolution, added to liquid B and dispersed by means of a high-pressure homogenizer, thereby obtaining a raw dispersion of sliding agent.

| | |
|---|---|
| Liquid A: | |
| Compd. of the formula: $C_6H_{13}CH(OH)(CH_2)_{10}COOC_{50}H_{101}$ | 399 pts. wt. |
| Compound of the formula: $n\text{-}C_{50}H_{101}O(CH_2CH_2O)_{16}H$ | 171 pts. wt. |
| Cyclohexanone | 830 pts. wt. |
| Liquid B: | |
| Cyclohexanone | 8600 pts. wt. |

(iii) Preparation of spherical inorganic grain dispersion

Spherical inorganic grain dispersion (c1) was prepared in accordance with the following recipe.

| | |
|---|---|
| Isopropyl alcohol | 93.54 pts. wt. |
| Silane coupling agent KBM903 (produced by Shin-Etsu Silicone) Compound 1-1: $(CH_3O)_3Si—(CH_2)_3—NH_2$) | 5.53 pts. wt. |
| W-5 | 2.93 pts. wt. |
| Seahostar KEP50 (amorphous spherical silica, av. grain size 0.5 μm, produced by Nippon Shokubai Kagaku Kogyo | 88.00 pts. wt. |
| This composition was agitated for 10 min, and further the following was added. | |
| Diacetone alcohol | 252.93 pts. wt. |

The resultant liquid was dispersed by means of ultrasonic homogenizer "Sonifier 450 (manufactured by Branson)" for 3 hr while cooling with ice and stirring, thereby finishing spherical inorganic grain dispersion c1.

(iii) Preparation of Spherical Organic Polymer Grain Dispersion

| Spherical organic polymer grain dispersion (c2) was prepared in accordance with the following recipe. | |
|---|---|
| XC99-A8808 (produced by Toshiba Silicone Co., Ltd., spherical crosslinked polysiloxane grain, av. grain size 0.9 μm) | 60 pts. wt. |
| Methyl ethyl ketone | 120 pts. wt. |
| Cyclohexanone | 120 pts. wt. |
| (solid content 20%, solvent: methyl ethyl ketone/cyclohexanone = 1/1) | |

This mixture was dispersed by means of ultrasonic homogenizer "Sonifier 450 (manufactured by Branson)" for 2 hr while cooling with ice and stirring, thereby finishing spherical organic polymer grain dispersion c2.

(iv) Preparation of Coating Liquid for 3rd Layer

A coating liquid for 3rd layer was prepared by adding the following components to 542 g of the aforementioned raw dispersion of sliding agent:

| | |
|---|---|
| Diacetone alcohol | 5950 g |
| Cyclohexanone | 176 g |
| Ethyl acetate | 1700 g |
| Above Seahostar KEP50 dispersion (c1) | 53.1 g |
| Above spherical organic polymer grain dispersion (c2) | 300 g |
| FC431 (produced by 3M, solid content 50%, solvent: ethyl acetate) | 2.65 g |
| BYK310 (produced by BYK ChemiJapan, solid content 25%) | 5.3 g. |

The above third layer coating liquid was applied onto the second layer in a coating amount of 10.35 mL/$m^2$, dried at 110° C. and further post-dried at 97° C. for 3 min.

4) Superimposing of Light-Sensitive Layer by Coating

Subsequently, multiple layers of compositions of the samples 101 to 115 were applied by coating onto the side opposite to obtained back layer, thereby obtaining color negative films.

The resultant samples were tested and evaluated in the same manner as in Example 1. The same excellent results as in Example 1 were obtained.

EXAMPLE 4

Samples whose spectral sensitivity in the ultraviolet region was changed were prepared by replacing (in equal silver amounts) the emulsions Em-H and Em-G in 9th layer, emulsion Em-F in 10th layer and emulsions Em-E and Em-G in 11th layer of the sample 101 with emulsions Em-H1, Em-G1, Em-F1, Em-E1 and Em-G1, respectively, or with emulsions Em-H2, Em-G2, Em-F2, Em-E2 and Em-G2, respectively, and by further changing the amounts of compounds UV-1 to −5 in 15th layer (first protective layer). Estimations of the obtained samples were performed in the same manner as in Example 1 except that density measurement was carried out through a green filter. When the amount of ultraviolet absorber used was small, the addition of electron-releasing compound, although a high sensitivity increasing effect was exerted, resulted in intensification of static-induced fog and radiation-induced fog. Photographic characteristics ensuring excellence in static tolerance and radiation tolerance while maintaining the advantage of sensitivity increase was realized through achieving of the spectral sensitivity distribution of the present invention by, while adding an electron-releasing compound, increasing the amount of ultraviolet absorber used.

EXAMPLE 5

Samples whose spectral sensitivity in the ultraviolet region was changed were prepared by replacing (in equal silver amounts) the emulsions Em-C and Em-D of 4th layer, emulsions Em-B and Em-C of 5th layer and emulsion Em-A of 6th layer of the sample 101 with emulsions Em-C1, Em-D1, Em-B1, Em-C1 and Em-A1, respectively, or with emulsions Em-C2, Em-D2, Em-B2, Em-C2 and Em-A2, respectively, and by further changing the amounts of compounds UV-1 to −5 of 15th layer (first protective layer). Estimations of the obtained samples were performed in the same manner as in Example 1 except that density measurement was carried out through a red filter. When the amount of ultraviolet absorber used was small, the addition of electron-releasing compound, although a high sensitivity increasing effect was exerted, resulted in intensification of static-induced fog and radiation-induced fog. Photographic characteristics ensuring excellence in static tolerance and radiation tolerance while maintaining the advantage of sensitivity increase was realized through achieving of the spectral sensitivity distribution of the present invention by, while adding an electron-releasing compound, increasing the amount of ultraviolet absorber used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide color photosensitive material comprising at least one each of a blue-sensitive layer, a green-sensitive layer, a red-sensitive layer and a non-light-sensitive layer on a support, wherein the silver halide color photosensitive material contains a compound selected from among the following type 1 and type 2 compounds, and wherein the blue-sensitive layer meets the relationship of the following formula (I):

$$S_B(370\ nm)/S_B(420\ nm)<0.7 \quad (I)$$

wherein $S_B(\lambda)$ represents a spectral sensitivity at a wavelength of $\lambda$, (type 1)

a compound capable of undergoing a one-electron oxidation to thereby form a one-electron oxidation product thereof, wherein the one-electron oxidation product is capable of releasing further one or more electrons accompanying a subsequent bond cleavage reaction, and (type 2)

a compound capable of undergoing a one-electron oxidation to thereby form a one-electron oxidation product thereof, wherein the one-electron oxidation product is capable of releasing further one or more electrons accompanying a subsequent bond-forming reaction.

2. The silver halide color photosensitive material according to claim 1, wherein the silver halide color photosensitive material further contains at least one fluorinated surfactant selected from the group consisting of compounds represented by formula (A) and compounds represented by formula (B):

General formula (A)

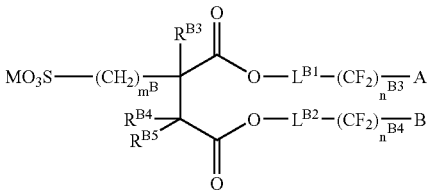

wherein each of $R^{B3}$, $R^{B4}$ and $R^{B5}$ independently represents a hydrogen atom or substituent, each of A and B independently represents a fluorine atom or hydrogen atom, each of $n^{B3}$ and $n^{B4}$ is independently an integer of 4 to 8, each of $L^{B1}$ and $L^{B2}$ independently represents a substituted or unsubstituted alkylene group, substituted or unsubstituted alkyleneoxy group, or bivalent linking group composed of a combination thereof, $m^B$ is 0 or 1, and M represents a cation;

General formula (B)

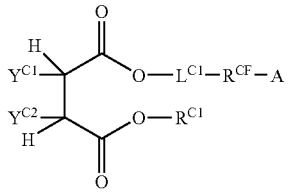

wherein $R^{C1}$ represents a substituted or unsubstituted alkyl group, provided that the substituent does not include a fluorine atom, $R^{CF}$ represents a perfluoroalkylene group, A represents a hydrogen atom or fluorine atom, $L^{C1}$ represents a substituted or unsubstituted alkylene group, substituted or unsubstituted alkyleneoxy group, or bivalent linking group composed of a combination thereof, one of $Y^{C1}$ and $Y^{C2}$ represents a hydrogen atom while the other represents $-L^{C2}-SO_3M$ wherein $L^{C2}$ represents a single bond or substituted or unsubstituted alkylene group, and M represents a cation.

3. The silver halide color photosensitive material according to claim 1, wherein the compound selected from among type 1 and type 2 has an adsorptive group to silver halide in the molecule thereof.

* * * * *